US011478836B2

(12) United States Patent
Suzuki et al.

(10) Patent No.: US 11,478,836 B2
(45) Date of Patent: Oct. 25, 2022

(54) PRESS-FORMED ARTICLE MANUFACTURING METHOD AND PRESS LINE

(71) Applicants: NIPPON STEEL CORPORATION, Tokyo (JP); Toyoda Iron Works Co., Ltd., Toyota (JP)

(72) Inventors: Toshiya Suzuki, Tokyo (JP); Yoshiaki Nakazawa, Tokyo (JP); Makoto Murai, Toyota (JP); Yasunobu Ishino, Okazaki (JP)

(73) Assignees: NIPPON STEEL CORPORATION, Tokyo (JP); TOYODA IRON WORKS CO., LTD., Toyota (JP)

( * ) Notice: Subject to any disclaimer, the term of this patent is extended or adjusted under 35 U.S.C. 154(b) by 200 days.

(21) Appl. No.: 16/619,813

(22) PCT Filed: Jun. 7, 2018

(86) PCT No.: PCT/JP2018/021917
§ 371 (c)(1),
(2) Date: Dec. 5, 2019

(87) PCT Pub. No.: WO2018/225832
PCT Pub. Date: Dec. 13, 2018

(65) Prior Publication Data

US 2020/0101514 A1 Apr. 2, 2020

(30) Foreign Application Priority Data

Jun. 7, 2017 (JP) ..... JP2017-112876

(51) Int. Cl.
*B21D 22/20* (2006.01)
*B21D 22/26* (2006.01)
(Continued)

(52) U.S. Cl.
CPC ..... *B21D 22/206* (2013.01); *B21D 22/26* (2013.01); *B21D 24/005* (2013.01); *B21D 24/04* (2013.01); *B30B 13/00* (2013.01)

(58) Field of Classification Search
CPC .... B21D 22/206; B21D 24/04; B21D 24/005; B21D 22/26; B30B 13/00
(Continued)

(56) References Cited

U.S. PATENT DOCUMENTS 10,940,518 B2 * 3/2021 Hayashi ..... B21D 24/005
2014/0356643 A1 12/2014 Nakata et al.
(Continued)

FOREIGN PATENT DOCUMENTS

EP 3 266 534 A1 1/2018
JP 63-133821 U 9/1988
(Continued)

OTHER PUBLICATIONS

International Search Report, issued in PCT/JP2018/021917, dated Jul. 10, 2018.
Japanese Notice of Allowance, issued in Application No. 2018-562375, dated Mar. 26, 2019.
Written Opinion of the international Searching Authority, issued in PCT/JP2018/021917, dated Jul. 10, 2018.

*Primary Examiner* — Jessica Cahill
*Assistant Examiner* — Smith Oberto Bapthelus
(74) *Attorney, Agent, or Firm* — Birch, Stewart, Kolasch & Birch, LLP

(57) ABSTRACT

Provided is a press-formed article manufacturing method including pressing a blank with the first pressing apparatus to form a first intermediate formed article having a pair of bent portions bent to one side in the plate thickness direction and having a spacing between the bent portions narrower than the width of the top plate and equal to or more than the width of the top portion of the convex portion, and moving
(Continued)

the second die relative to the second punch side punch with respect to the die pad and the second punch and forming a second intermediate formed article in a state where a portion between the bent portions is sandwiched between the die pad and the convex portion, with one side of the first intermediate formed article in the plate thickness direction as the convex portion side of the second pressing apparatus.

14 Claims, 34 Drawing Sheets

(51) Int. Cl.
*B21D 24/00* (2006.01)
*B21D 24/04* (2006.01)
*B30B 13/00* (2006.01)

(58) Field of Classification Search
USPC ..... 72/404
See application file for complete search history.

(56) References Cited

U.S. PATENT DOCUMENTS

| | | | | |
|---|---|---|---|---|
| 2018/0078986 | A1 | 3/2018 | Suzuki et al. | |
| 2019/0176204 | A1* | 6/2019 | Suzuki | B21D 5/01 |

FOREIGN PATENT DOCUMENTS

| | | | | |
|---|---|---|---|---|
| JP | 2007-111725 | A | 5/2007 | |
| JP | 4681420 | B2 | 5/2011 | |
| JP | 2012-51005 | A | 3/2012 | |
| JP | 5079655 | B2 | 11/2012 | |
| JP | 6028885 | B1 | 11/2016 | |
| JP | 6069223 | B2 | 2/2017 | |
| WO | WO-2012161050 | A1 * | 11/2012 | B21D 22/26 |
| WO | WO 2013/094705 | A1 | 6/2013 | |
| WO | WO 2016/140287 | A1 | 9/2016 | |
| WO | WO 2016/175281 | A1 | 11/2016 | |

* cited by examiner

PRESS-FORMED ARTICLE MANUFACTURING METHOD AND PRESS LINE

TECHNICAL FIELD OF THE INVENTION

The present disclosure relates to a press-formed article manufacturing method and a press line.

Priority is claimed on Japanese Patent Application No. 2017-112876, filed Jun. 7, 2017, the content of which is incorporated herein by reference.

RELATED ART

For example, the following Patent Document 1 and Patent Document 2 disclose a method of manufacturing a press-formed article having a substantially U-shaped (groove-shaped) section by using a pressing apparatus including a punch having a punch-side pad (inner pad) and a die having a die-side pad (die pad). In this press-formed article manufacturing method, a material metal plate is sandwiched by the punch-side pad protruding from the punch and the die-side pad protruding from the die, and in this state, the die is pushed to the punch side to form the press-formed article. Accordingly, the occurrence of springback in the press-formed article is suppressed.

That is, in this press-formed article manufacturing method, when the die is pushed the punch side to form standing walls, the punch-side pad protrudes from the punch. Therefore, inclined loose portions (extra line portions) are generated in the portions of a material metal plate between shoulder portions of the punch-side pad and shoulder portions of the punch. Specifically, the loose portions (extra line portions) are convexly deformed to the front side of the material metal plate. Also, the die-side pad and the die are pushed to the punch side to form a top plate of the press-formed article. In this case, the portions of the material metal plate bent by the shoulder portions of the punch are pushed out to base end sides of standing walls and are formed as the standing walls. Accordingly, a first moment, which faces the inside of the press-formed article, is generated at a base end portion of a standing wall of the press-formed article before release (refer to an arrow in FIG. 5(b) of Patent Document 2).

Additionally, although the slack portions (extra line portions) are finally crushed by the punch and the die, the loose portions (extra line portions) before being crushed are convexly bent and deformed to the front side of the material metal plate. For this reason, a second moment, which faces the inside of the press-formed article, is generated at each of both end portions of the top plate of the press-formed article in the width direction after being crushed (refer to an arrow in FIG. 5(b) of Patent Document 2).

Also, a third moment, which faces the outside of the press-formed article, is generated at a ridge portion of the press-formed article before release (refer to an arrow in FIG. 5(b) of Patent Document 2). The third moment and the first and second moments are offset (balanced), and the springback in the press-formed article is suppressed.

PRIOR ART DOCUMENT

Patent Document

[Patent Document 1] Japanese Patent No. 5079655

[Patent Document 2] Japanese Unexamined Patent Application, First Publication No. 2012-51005

DISCLOSURE OF THE INVENTION

Problems to be Solved by the Invention

However, in the above press-formed article manufacturing method, as the protruding amount of the punch-side pad from the punch increases, the above first and second moments increase. Therefore, the amount by which the standing wall is displaced to the inside tends to increase. In other words, as the magnitude of the first and second moments changes, the position of the standing wall in a width direction tends to change sensitively with respect to the protruding amount of the punch-side pad from the punch. Accordingly, the range of the protruding amount of the punch-side pad in which the dimension of the standing wall in the width direction can be settled within a set tolerance becomes relatively narrow. For this reason, it is necessary to accurately adjust the protruding amount of the punch-side pad to form the press-formed article. From the viewpoint of productivity, in the press-formed article manufacturing method, even if the range of the protruding amount of the punch-side pad is expanded, it is required that a press-formed article in which the dimension of the standing wall is within the tolerance can be formed.

Additionally, in the above press-formed article manufacturing method, the pads are included in both the punch and the die as components of the die and punch. Therefore, the structure of the pressing apparatus becomes complicated, and the manufacturing cost becomes high. Since the material metal plate is formed while being sandwiched between the punch-side pad and the die-side pad, a suitable bearing capability is required, and a case where facility restrictions increase and the required load of the pad is not obtained depending on part shape or size occurs.

The invention has been made in view of the above circumstances and is to provide a press-formed article manufacturing method and a press line that can expand the allowable range of the protruding amount of a convex portion protruding from a punch by using simplified pressing apparatuses.

Means for Solving the Problem

The invention adopts the following means in order to solve the above problems to achieve the relevant object.

(1) A press-formed article manufacturing method related to one aspect of the invention is a method of manufacturing a press-formed article, using a first pressing apparatus, a second pressing apparatus, and a third pressing device, the first pressing apparatus being configured to include a first die, and a first punch that is disposed to face the first die and includes a pair of first punch shoulder portions, the second pressing apparatus being configured to include a second die including a die pad, and a second punch that is disposed to face the second die, has a convex portion having a width equal to or less than a spacing between the first punch shoulder portions at a top portion thereof, and includes a pair of second punch shoulder portions having a spacing wider than the spacing between the first punch shoulder portions, the third pressing apparatus being configured to include a third die having a width of a die hole equal to a width of a die hole of the second die, and a third punch including a pair of third punch shoulder portions having a spacing equal to the spacing between the second punch shoulder portions, and the press-formed article having a top plate, a pair of ridge portions located on both sides of a top plate in a width direction, and a pair of standing walls extending from the ridge portions to one side of the top plate in a plate thickness direction, the press-formed article manufacturing method including a first step of pressing a blank with the first pressing apparatus to form a first intermediate formed article having a pair of bent portions that is bent to one side in the plate thickness direction and having a spacing between the bent portions that is narrower than the width of the top plate and equal to or more than the width of the top portion of the convex portion; a second step of moving the second die to the second punch side relative to the die pad and the second punch and forming a second intermediate formed article, having the standing wall formed therein, with the second die and the second punch, in a state where a portion between the bent portions is sandwiched between the die pad protruding from the second die to the second punch side, and the convex portion, with one side of the first intermediate formed article in the plate thickness direction as the convex portion side of the second pressing apparatus; and a third step of pressing the second intermediate formed article with the third die and the third punch of the third pressing apparatus to form the press-formed article in which the pair of bent portions are bent and stretched.

When the press-formed article is formed, in the first step, the blank is pressed by the first die and the first punch of the first pressing apparatus. Accordingly, the first intermediate formed article having the pair of bent portions that is bent to one side in the plate thickness direction and having the spacing between the bent portions that is narrower than the width of the top plate and equal to or more than the width of the top portion of the convex portion of the second pressing apparatus is formed.

Next, in the second step, a disposition is made in a second pressing apparatus with one side of the first intermediate formed article in the plate thickness direction is the convex portion side of the second pressing apparatus, and the portion between the bent portions of the first intermediate formed article is sandwiched between the die pad protruding from the second die to the second punch side, and the convex portion of the second punch.

In this state, the second die is moved to the second punch side relative to the die pad and the second punch, and the second intermediate formed article having the standing wall formed therein is formed by the second die and the second punch.

In this case, the pair of bent portions, which is bent to one side in the plate thickness direction, are formed in the first intermediate formed article, and the second punch shoulder portions can approach in both side portions (portions outside the pair of bent portions in the width direction) of the first intermediate formed article in the width direction in a state where the first intermediate formed article is sandwiched between the convex portion of the second punch and the die pad.

For this reason, when the second die is relatively moved to the second punch side to form the standing walls, bending deformation in which the portions (portions corresponding to the aforementioned loose portions) of the first intermediate formed article disposed between the second punch shoulder portions of the second punch and the shoulder portions of the convex portion becomes convex to the other side in the plate thickness direction is suppressed. Accordingly, the second intermediate formed article in which the curved deformation between the bent portions and the standing walls is suppressed can be obtained.

In the third step, the press-formed article in which the pair of bent portions are bent and stretched by pressing the second intermediate formed article with the third die and the third punch of the third pressing apparatus.

In this case, in this second intermediate formed article, the curved deformation between the bent portions and the standing walls is suppressed. For this reason, in the press-formed article after forming, the generation of the aforementioned second moment can be suppressed. Thus, a moment generated in the press-formed article can be limited mainly to a first moment that faces outward at a base end portion of a standing wall and a third moment that faces outward at a ridge portion.

Accordingly, the third moment can be offset mainly by only the first moment, and the opening amount (position) of the standing walls in the width direction of the press-formed article can be adjusted. Thus, a change in the opening amount (position), in the width direction, of the standing walls that appear sensitively with respect to a change in the protruding amount of the convex portion from the second punch can be made small.

As a result, since the allowable range of the protruding amount of the convex portion can be expanded, management of the dimensional accuracy of the standing walls becomes easy.

Additionally, in the related art, the punch-side pad that is movable in the press direction with respect to the punch is provided when the die is pushed to the punch side to form the standing walls. Accordingly, generating the extra line portions in the portions of the material metal plate between the shoulder portions of the punch-side pad and the shoulder portions of the punch, and crushing the extra line portions are performed in a single forming step by one pressing apparatus. However, in the present invention, after the second intermediate formed article is formed by generating the extra line portions in the portions between the bent portions of the first intermediate formed article and the shoulder portions of the punch with the second pressing apparatus, the press-formed article is formed by crushing the extra line portions of the second intermediate formed article with the third pressing apparatus. Therefore, it is not necessary to crush the extra line portions with the second pressing apparatus. Therefore, the punch-side pad can be eliminated in the second pressing apparatus. Additionally, since it is only necessary to crush the extra line portions of the second intermediate formed article with the third pressing apparatus, the punch-side pad is unnecessary also in the third pressing apparatus.

For this reason, compared to the related art in which the pressing apparatus including the punch-side pad is required, the press line can be configured by the combination of the simplified pressing apparatuses.

(2) In the press-formed article manufacturing method described in the above (1), punch-side inclined surfaces, which are recessed as being closer to a central side of the third punch in the width direction from the third punch shoulder portions, may be formed at a top portion of the third punch, and die-side inclined surfaces corresponding to the punch-side inclined surfaces may be formed at a die bottom of the third die that faces the top portion of the third punch.

(3) In the press-formed article manufacturing method described in the above (1), punch-side inclined surfaces, which are recessed as being closer to a central side of the third punch in the width direction from the third punch shoulder portions, may be formed at a top portion of the third punch, and a die bottom of the third die may be configured to include a die pad, and die-pad-side inclined surfaces corresponding to the punch-side inclined surfaces may be formed on a facing surface of the die pad of the third die that faces the top portion of the third punch.

(4) In the press-formed article manufacturing method described in the above (1) or (2), a spacing between end portions of the two punch-side inclined surfaces on the central side of the third punch in the width direction and a spacing between the pair of the bent portions of the second intermediate formed article may be equal to each other.

(5) A press line related to one aspect of the invention includes a first pressing apparatus configured to include a first die, and a first punch that is disposed to face a first direction and includes a pair of first punch shoulder portions; a second pressing apparatus including a second punch including a top portion that crosses a press direction, a convex portion that is disposed at the top portion and has a width equal to or less than a spacing between the first punch shoulder portions, a pair of second punch shoulder portions provided on both sides of the top portion, and punch wall surfaces that extend from the respective second punch shoulder portions, a second die including a die hole having a die hole wall surface corresponding to the punch wall surface, and a die pad that has a convex-portion facing surface facing the convex portion, is disposed in the die hole, and is movable in a press direction; and a third pressing apparatus configured to include a third die having a width of a die hole equal to a width of the die hole of the second die, and a third punch including a pair of third punch shoulder portions having a spacing equal to a spacing between the second punch shoulder portions.

(6) In the press line described in the above (5), punch-side inclined surfaces, which are recessed as being closer to a central side of the third punch in the width direction from the third punch shoulder portions, may be formed at a top portion of the third punch, and die-side inclined surfaces corresponding to the punch-side inclined surfaces may be formed at a die bottom of the third die that faces the top portion of the third punch.

(7) In the press line in the above (5), punch-side inclined surfaces, which are recessed as being closer to a central side of the third punch in the width direction from the third punch shoulder portions, may be formed at a top portion of the third punch, and a die bottom of the third die may be configured to include a die pad, and die-pad-side inclined surfaces corresponding to the punch-side inclined surfaces may be formed on a facing surface of the die pad of the third die that faces the top portion of the third punch.

(8) In the press line described in the above (6) or (7), a spacing between end portions of the two punch-side inclined surfaces on the central side of the third punch in the width direction and a spacing between the first punch shoulder portions of the first punch may be equal to each other.

(9) In the press line described in any one of the above (5) to (8), the second punch may include a split die that constitutes the convex portion, and a second punch body that constitutes a portion other than the convex portion.

(10) In the press line described in the above (9), a spacer may be provided between the split die and the second punch body in a press direction.

Effects of the Invention

According to the above aspects, the allowable range of the protruding amount of the convex portion protruded from a punch can be expanded using the simplified pressing apparatuses.

EMBODIMENTS OF THE INVENTION

First Embodiment

Figure 1:
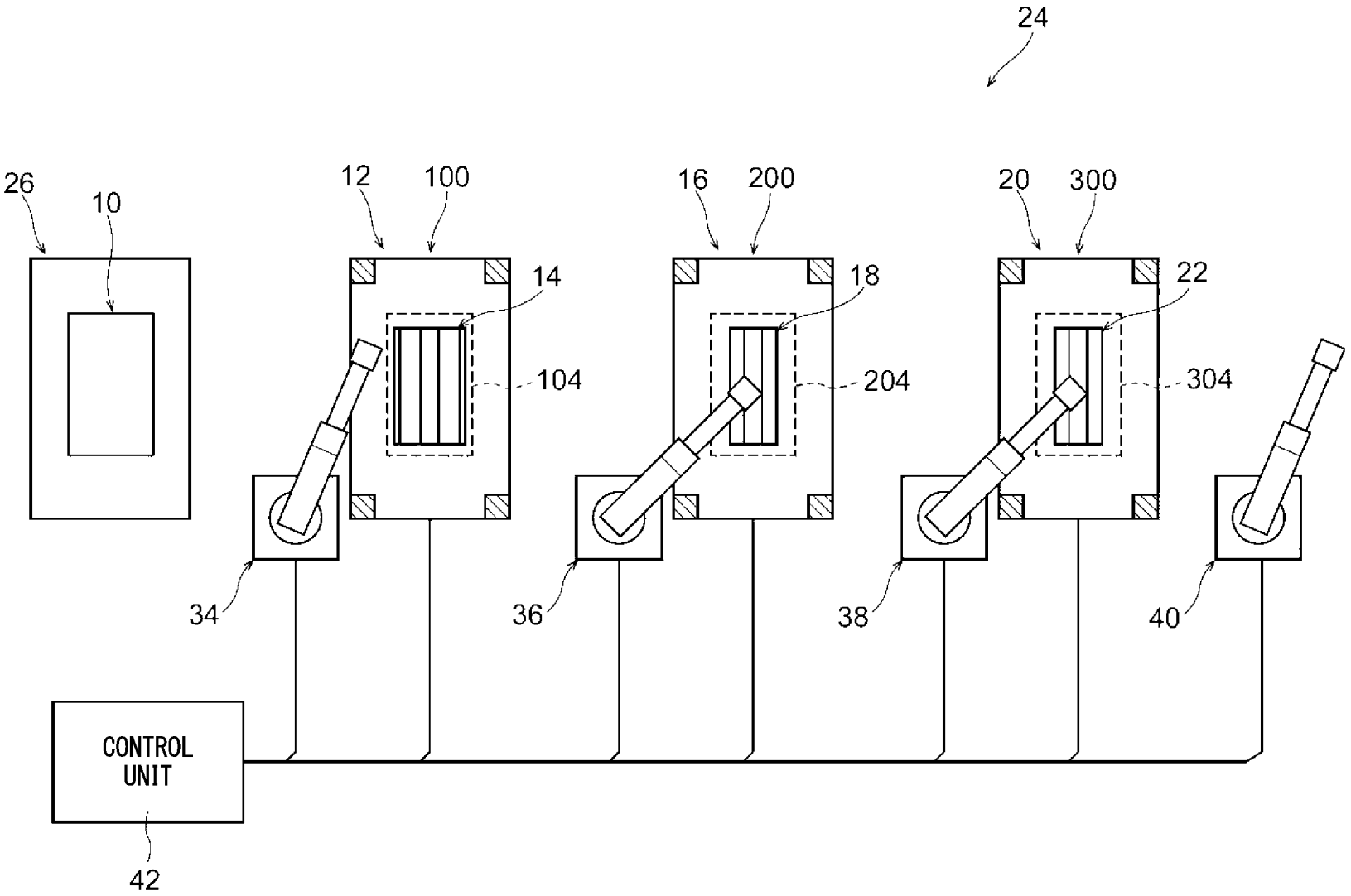
FIG. 1 is a plan view illustrating a press line related to a first embodiment of the invention.

Hereinafter, a press-formed article manufacturing method related to a first embodiment of the invention will be described referring to FIGS. 1 to 13.

In this press-formed article manufacturing method, a flat-plate-shaped blank 10 is used as a first intermediate formed article 14 in a first step 12. Then, after the first intermediate formed article 14 is used as a second intermediate formed article 18 by in a second step 16, a press-formed article 22, which is a final formed article, is formed using the second intermediate formed article 18 in a third step 20.

First, a press line 24 will first be described, and then, the configuration of the press-formed article 22, the configuration of the first intermediate formed article 14, the configuration of the second intermediate formed article 18, and the press-formed article manufacturing method will be described. In addition, in the drawings, the same members will be designated by the same reference signs, and the description of the same members earlier described in the following description will be appropriately omitted.

(Press Line)

FIG. 1 is a view illustrating an example of the press line 24. In the present embodiment, a tandem press line in which a plurality of arranged pressing apparatuses are connected to each other by a conveying device will be described as an example. However, the invention is not limited to this. For example, a transfer press line in which a formed article is sequentially formed while being fed to a plurality of dies and punches provided within a single device may be adopted.

In the press line 24, a material table 26, a first pressing apparatus 100, a second pressing apparatus 200, and a third pressing apparatus 300 are sequentially arranged from an upstream side in a conveyance direction. The blank 10 made of a flat steel sheet is supplied to the material table 26. The blank 10 on the material table 26 is conveyed to the first pressing apparatus 100 by a first manipulator 34 constituted of a multi-joint robot, which is an example of conveying means, is formed by the first pressing apparatus 100, and becomes the first intermediate formed article 14.

The first intermediate formed article 14 formed by the first pressing apparatus 100 is conveyed to the second pressing apparatus 200 by a second manipulator 36, is formed by the second pressing apparatus 200, and becomes the second intermediate formed article 18. The second intermediate formed article 18 formed by the second pressing apparatus 200 is conveyed to the third pressing apparatus 300 by a third manipulator 38, is formed by the third pressing apparatus 300, and becomes the press-formed article 22. Then, the press-formed article 22 formed by the third pressing apparatus 300 is delivered to the following step by a fourth manipulator 40.

In addition, at least some of the conveying means may be constituted of those other than the manipulators. The conveying means includes, for example, a conveyor.

The first pressing apparatus 100, the second pressing apparatus 200, the third pressing apparatus 300, and the respective manipulators 34, 36, 38, and 40 are connected to a control unit 42 constituted of an industrial computer or the like, and performs processing in accordance with a control signal from the control unit 42.

(Press-Formed Article)

Figure 2:
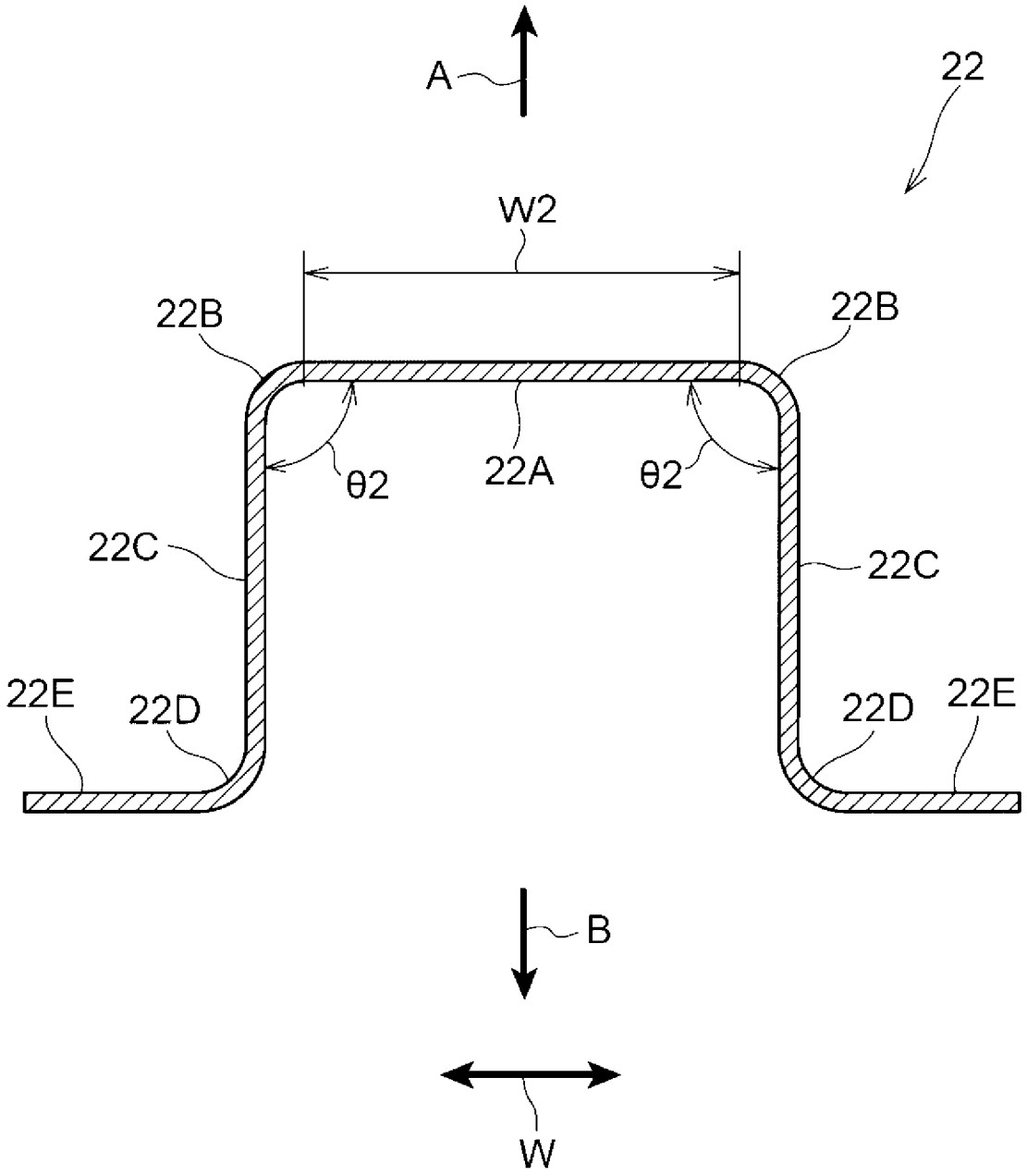
FIG. 2 is a sectional view, seen from the front, illustrating a press-formed article formed by the press line.

FIG. 2 is a view illustrating an example of the press-formed article 22 formed in the present embodiment. In FIG. 2, an arrow W indicates a width direction of the press-formed article 22, and an arrow A indicates an upper side of the press-formed article 22. Additionally, an arrow B indicates a lower side of the press-formed article 22.

The press-formed article 22 is constituted of a high strength steel sheet having a tensile strength exceeds 980 MPa, for example, and includes a steel sheet having a tensile strength of 1180 MPa as an example. The press-formed article 22 is, for example, an elongated skeleton member that constitutes the skeleton of an automobile. Also, the press-formed article 22 has a hat shape as seen from the front that is one side in the longitudinal direction thereof.

Specifically, the press-formed article 22 includes a flat top plate 22A that extends in the width direction W of the press-formed article 22, and a pair of ridge portions 22B that is located on both sides of the top plate 22A in the width direction W, and each ridge portion 22B is constituted of a curved surface protruding to the front side. Additionally, the press-formed article 22 includes a pair of standing walls 22C that extends from the respective ridge portions 22B, respectively, to a rear surface side that is one side (lower side B) of the top plate 22A in a plate thickness direction, and a pair of ridge portions 22D that is located at lower ends of the respective standing walls 22C, and the ridge portion 22D is constituted of a curved surface that protrudes to the rear surface side. Moreover, the press-formed article 22 includes a pair of flanges 22E that extends from the pair of ridge portions 22D, to both sides of the top plate 22A in the width direction W, that is, the front sides of the standing walls 22C, respectively.

In addition, in the following description, the rear surface side, which is one side of the press-formed article 22 in the plate thickness direction, is referred to as the inside of the press-formed article 22, and the front side, which is the other side of the press-formed article 22 in the plate thickness direction, is referred to as the outside of the press-formed article 22. As described above, the pair of ridge portions 22B is boundary portions between the top plate 22A and the standing wall 22C and is bent portions that are convex to the outside of the press-formed article 22 in a front view.

(First Intermediate Formed Article)

Figure 3:
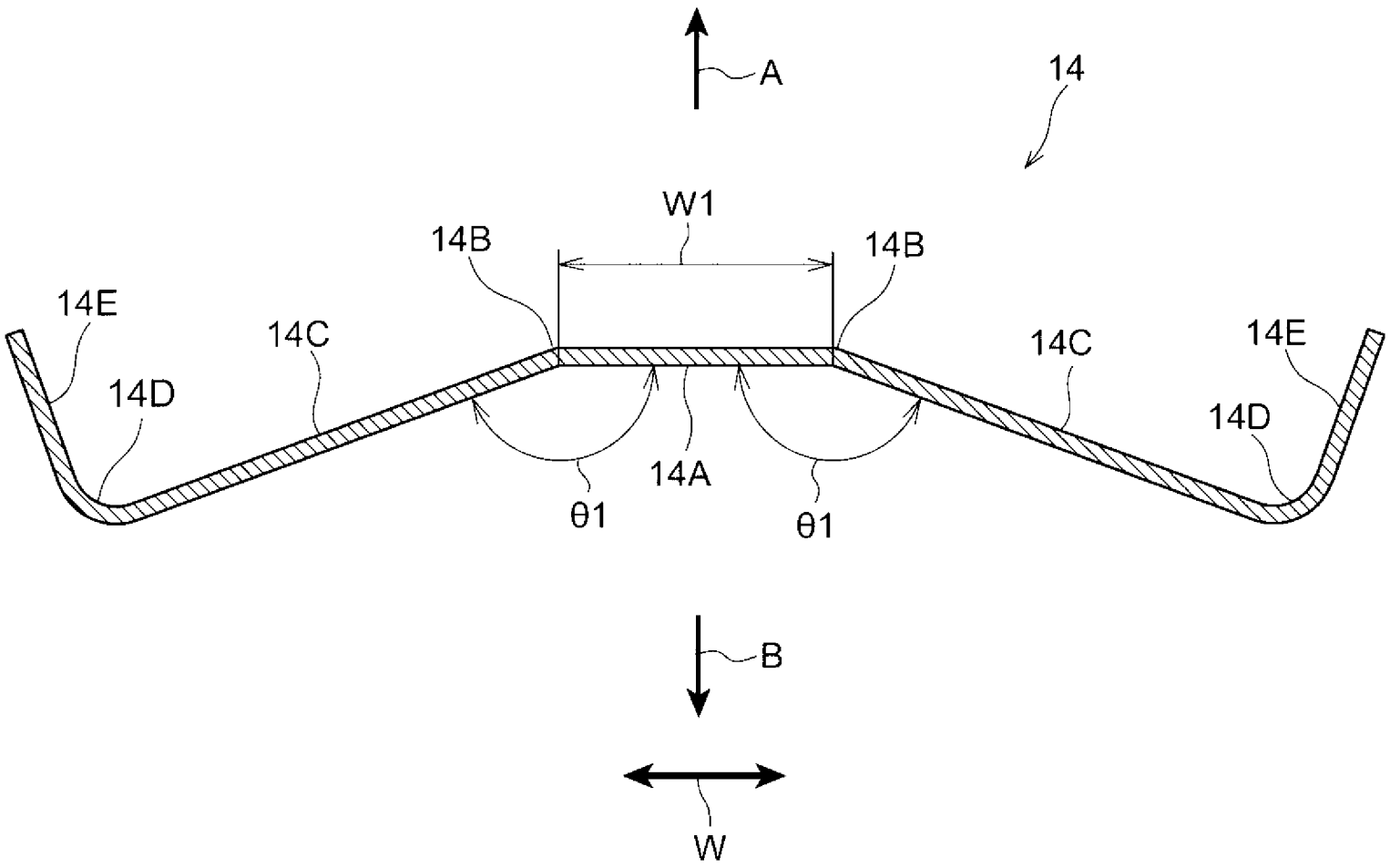
FIG. 3 is a sectional view, seen from the front, illustrating a first intermediate formed article used in a press-formed article manufacturing method.

FIG. 3 is a view illustrating an example of the first intermediate formed article 14 formed in the present embodiment. In FIG. 3, the arrow W indicates a width direction of the first intermediate formed article 14, and the arrow A indicates an upper side of the first intermediate formed article 14. Additionally, the arrow B indicates a lower side of the first intermediate formed article 14. The width direction W of a top plate 14A of the first intermediate formed article 14, as illustrated in FIGS. 2 and 3, coincides with the width direction W of the top plate 22A of the press-formed article 22, and an upward-downward direction of the top plate 14A of the first intermediate formed article 14 coincides with an upward-downward direction of the top plate 22A of the press-formed article 22.

The first intermediate formed article 14 is W-shaped as seen from the front. Specifically, the first intermediate formed article 14 includes the top plate 14A corresponding to a center portion of the top plate 22A of the press-formed article 22 in the width direction, bent portions 14B, and inclined walls 14C corresponding to both side portions of the top plate 22A of the press-formed article 22 in the width direction, the ridge portions 22B, and the standing walls 22C.

The inclined walls 14C are inclined to the lower side B that is one side in the plate thickness direction as being closer to both end sides in the width direction from the top plate 14A, and the bent portions 14B, which are bent to the lower side B that is one side in the plate thickness direction, are formed between the top plate 14A and the inclined walls 14C.

Figure 26:
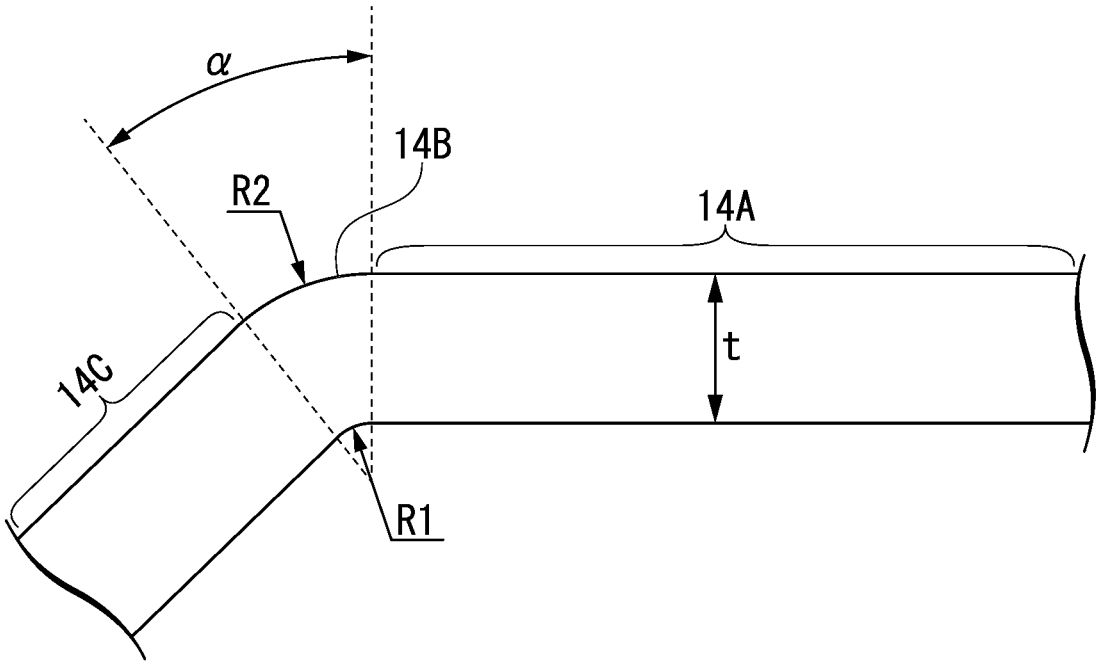
FIG. 26 is an enlarged view of the periphery of a bent portion 14B in FIG. 3.

FIG. 26 is an enlarged view of the periphery of a bent portion 14B in FIG. 3. As illustrated in FIG. 26, the bent portion 14B is an area formed by bending the flat-plate-shaped blank 10 such that the inner curvature radius thereof is R1 (mm) and the bending angle thereof is alpha (deg.). In addition, when the outer curvature radius of the bent portion 14B is R2 (mm) and the plate thickness (that is, the plate thickness of the blank 10) of the first intermediate formed article 14 is t (mm), the outer curvature radius R2 of the bent portion 14B is expressed by the following Formula (1).

$$R2=R1+t \quad (1)$$

Figure 11:
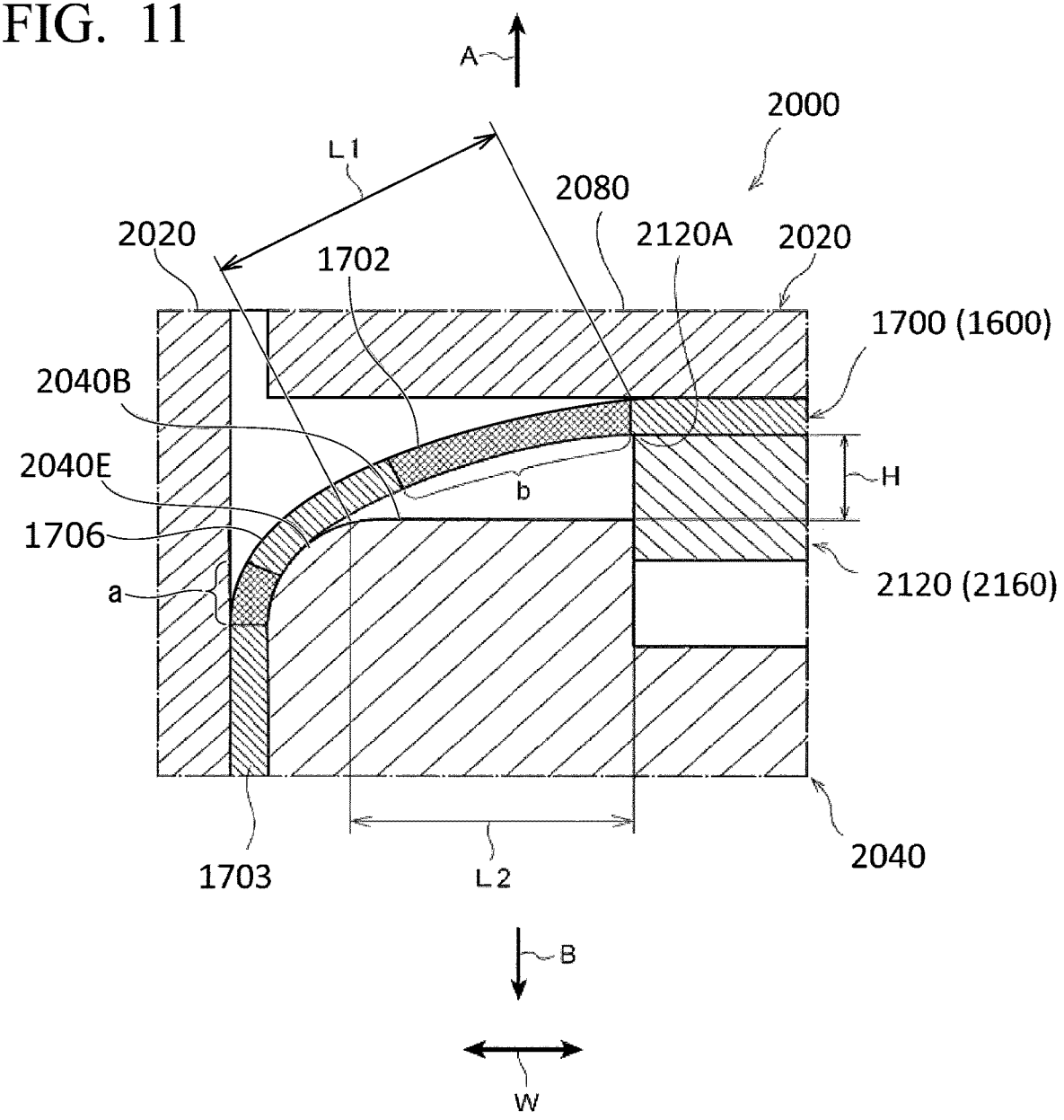
FIG. 11 is a sectional view of essential portions illustrating the second step of a comparative example.

In the present embodiment, it should be noted that the expression "the bent portion that is bent to one side in the plate thickness direction" means the bent portion 14B having such a bending angle alpha, an inner curvature radius R1, and an outer curvature radius R2 and is completely different from a loose portion 1702 that is curved in a wide range of a length L1 as illustrated in FIG. 11 relating to a comparative example. The comparative example will be described below.

Additionally, the first intermediate formed article 14 includes ridge portions 14D corresponding to the ridge portions 22D of the press-formed article 22, and flanges 14E corresponding to the flanges 22E of the press-formed article 22.

As illustrated in FIGS. 2 and 3, a width W1 on the rear surface side of the top plate 14A indicating the spacing between the pair of bent portions 14B in the width direction W of the first intermediate formed article is narrower than a width W2 of the top plate 22A indicating the spacing between the pair of ridge portions 22B in the width direction W of the press-formed article 22. Here, the width W2 of the top plate 22A of the press-formed article 22 indicates the distance from an edge of a curved portion formed by one ridge portion 22B to an edge of a curved portion formed by the other ridge portion 22B.

For the relationship between the width W1 and the width W2, for example, a difference between the width W1 and the width W2 is at least twice or more the plate thickness of the first intermediate formed article 14, and desirably, 10 mm or more. In this case, when the center of the first intermediate formed article 14 in the width direction and the center of the press-formed article 22 in the width direction are made to coincide with each other, an end of the top plate 22A of the press-formed article 22 is located outside an end of the top plate 14A of the first intermediate formed article 14 in the width direction by the plate thickness or more of the first intermediate formed article 14, desirably, 5 mm or more.

Accordingly, as described above, the top plate 14A of the first intermediate formed article 14 is formed as the center portion of the top plate 22A of the press-formed article 22 in the width direction. Additionally, portions on base end sides that are top plate 14A sides of the inclined walls 14C of the first intermediate formed article 14 become both the side portions of the top plate 22A of the press-formed article 22 in the width direction.

As illustrated in FIGS. 2 and 3, a pre-curvature angle θ1 formed between the top plate 14A of the first intermediate formed article 14 and an inclined wall 14C is larger than an angle θ2 (refer to FIG. 2) formed between the top plate 22A of the press-formed article 22, and a standing wall 22C, and is an obtuse angle. The angle of the pre-curvature angle θ1 will be described below.

(Second Intermediate Formed Article)

Figure 4:
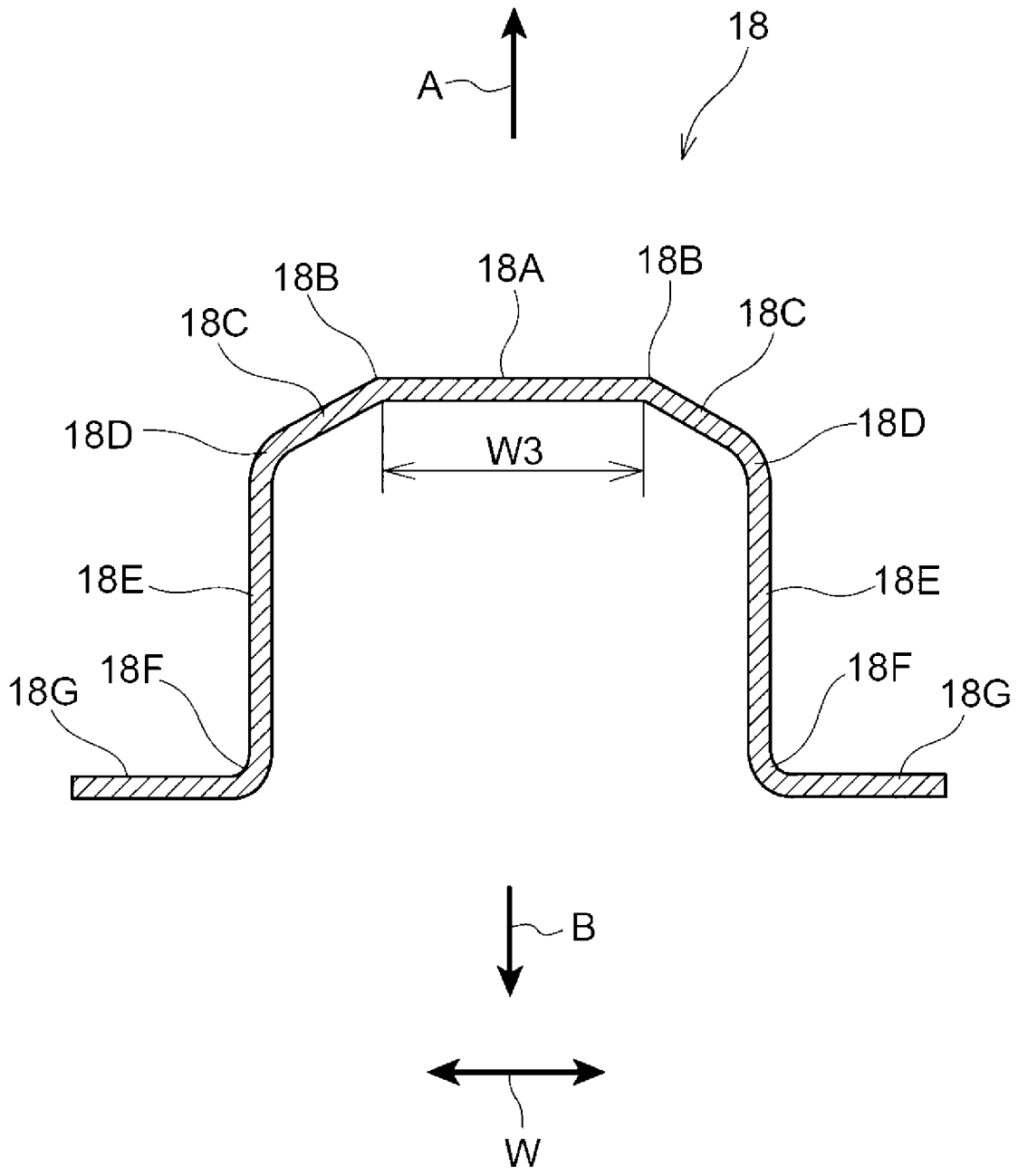
FIG. 4 is a sectional view, seen from the front, illustrating a second intermediate formed article used in the press-formed article manufacturing method.

FIG. 4 is a view illustrating an example of the second intermediate formed article 18 formed in the present embodiment. In FIG. 4, the arrow W indicates a width direction of the second intermediate formed article 18, and the arrow A indicates an upper side of the second intermediate formed article 18. Additionally, the arrow B indicates a lower side of the second intermediate formed article 18.

As illustrated in FIGS. 2 to 4, the width direction W of a top plate 18A of the second intermediate formed article 18 coincides with the width direction W of the top plate 14A of the first intermediate formed article 14 and the width direction W of the top plate 22A of the press-formed article 22. Additionally, an upward-downward direction of the top plate 18A of the second intermediate formed article 18 coincides with the upward-downward direction of the top plate 14A of the first intermediate formed article 14 and the upward-downward direction of the top plate 22A of the press-formed article 22.

The shape of the second intermediate formed article 18 is a hat shape close to the press-formed article 22. Specifically, the second intermediate formed article 18 includes the top plate 18A, bent portions 18B, and inclined walls 18C. The top plate 18A corresponds to the center portion of the top plate 22A of the press-formed article 22 in the width direction, and the inclined walls 18C correspond to both the side portions of the top plate 22A of the press-formed article 22 in the width direction.

The inclined walls 18C are inclined to the lower side B of the second intermediate formed article 18 that is the one side in the plate thickness direction of the top plate 18A as being closer to both end sides of the second intermediate formed article 18 in the width direction. The bent portions 18B correspond to the bent portions 14B of the first intermediate formed article 14.

Additionally, the second intermediate formed article 18 includes punch shoulder bent portions 18D, standing wall portions 18E, ridge portions 18F, and the flange portions 18G. The punch shoulder bent portions 18D correspond to the ridge portions 22B of the press-formed article 22, and the standing wall portions 18E correspond to the standing walls 22C of the press-formed article 22. As for the second intermediate formed article 18, a region between the pair of standing wall portions 18E protrudes to the upper side A as compared to the press-formed article 22.

The ridge portions 18F of the second intermediate formed article 18 correspond to the ridge portions 22D of the press-formed article 22, and the flange portions 18G correspond to the flanges 22E of the press-formed article 22.

As illustrated in FIGS. 3 and 4, a width W3 on the rear surface side of the top plate 18A indicating the spacing between the pair of bent portions 18B of the second intermediate formed article 18 is equal to the width W1 on the rear surface side of the top plate 14A indicating the spacing between the pair of bent portions 14B in the width direction W of the first intermediate formed article 14.

(Press-Formed Article Manufacturing Method)

Next, the press-formed article manufacturing method will be described.

Figure 5:
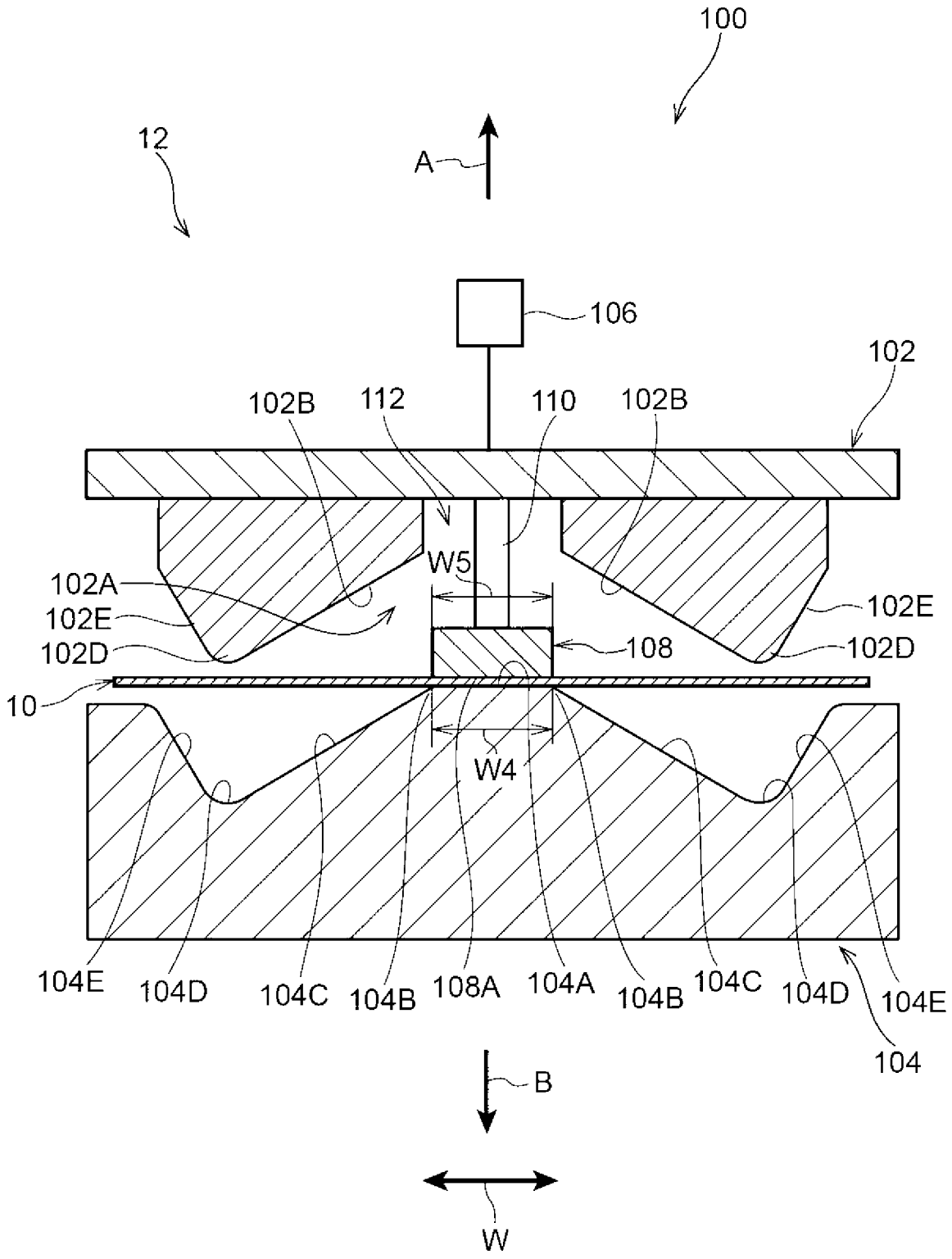
FIG. 5 is a sectional view, seen from the front of a first pressing apparatus, illustrating a first step of pressing a blank to manufacture the first intermediate formed article.
Figure 6:
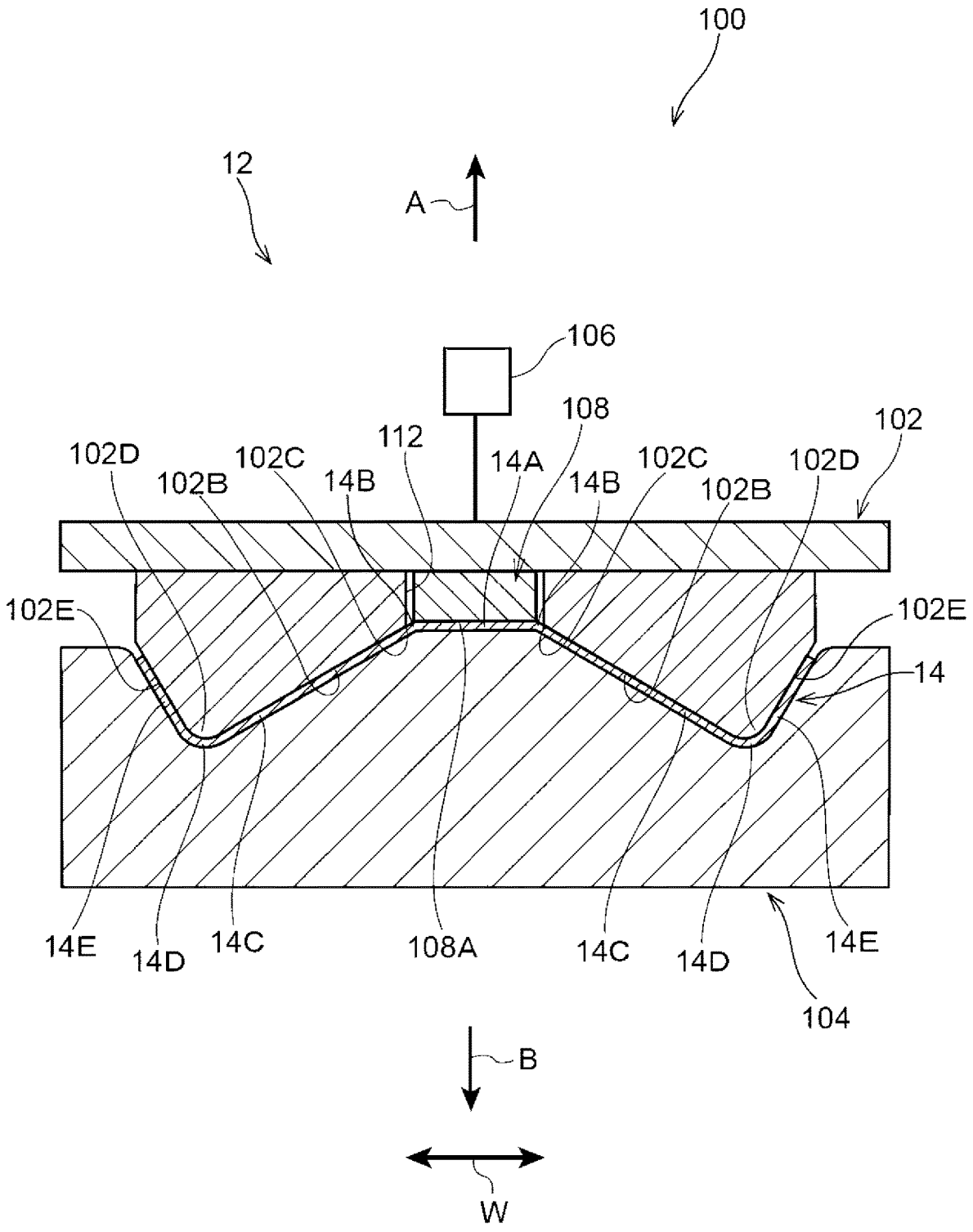
FIG. 6 is a sectional view, seen from the front of the first pressing apparatus, illustrating the first step subsequent to FIG. 5.
Figure 7:
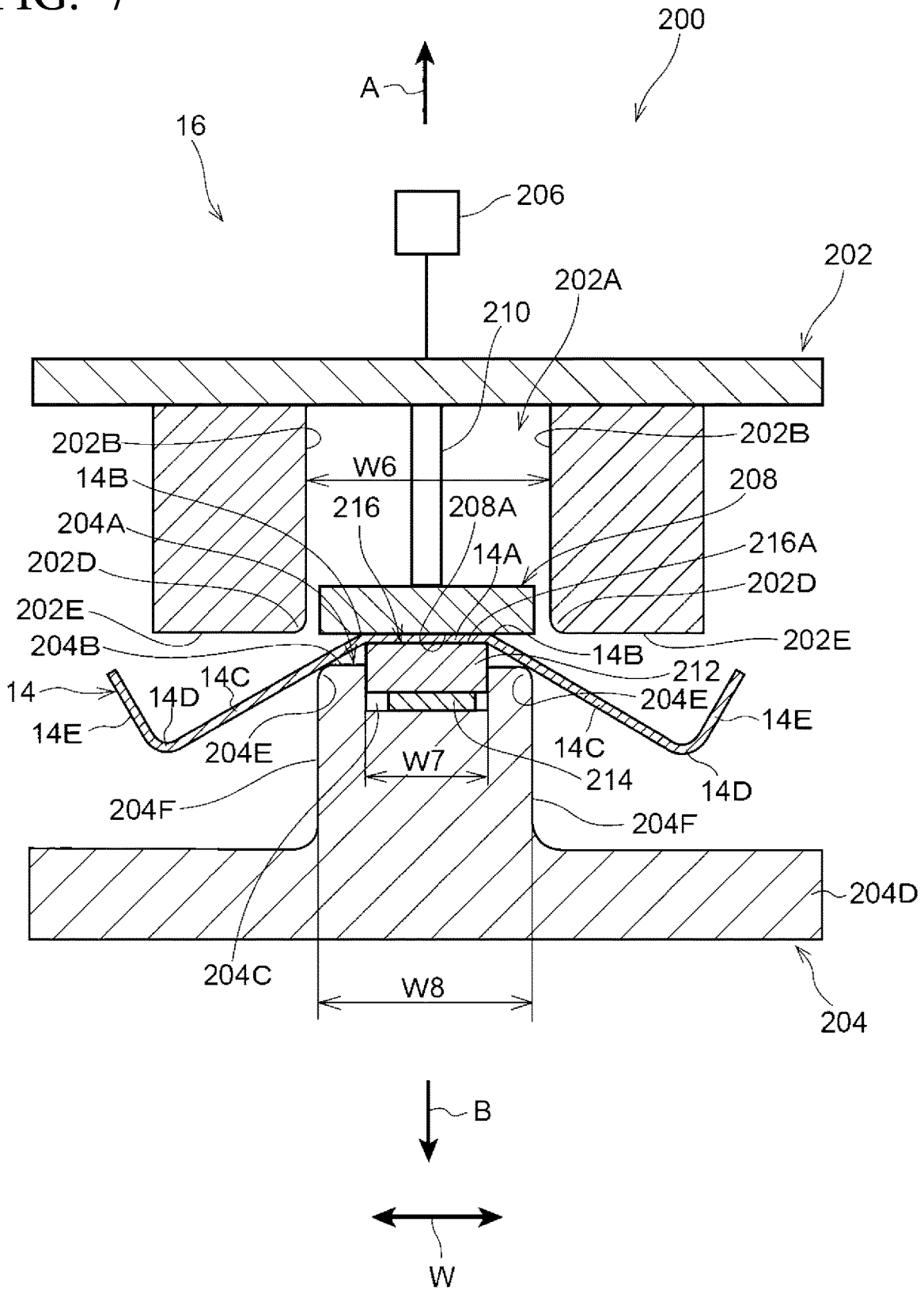
FIG. 7 is a sectional view, seen from the front of a second pressing apparatus, illustrating a second step of pressing the first intermediate formed article to manufacture the second intermediate formed article.
Figure 8:
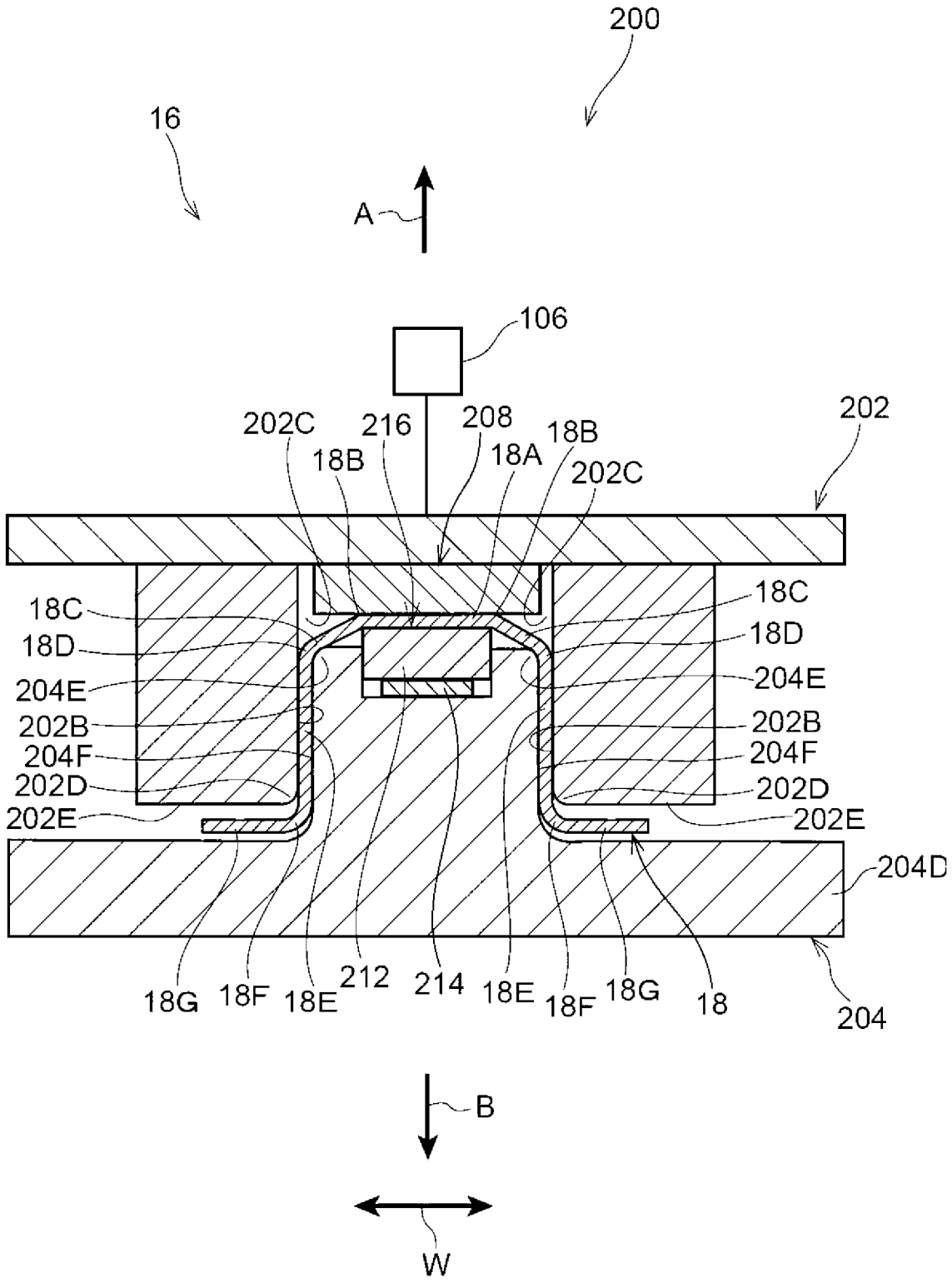
FIG. 8 is a sectional view, seen from the front of the second pressing apparatus, illustrating the second step subsequent to FIG. 7.
Figure 9:
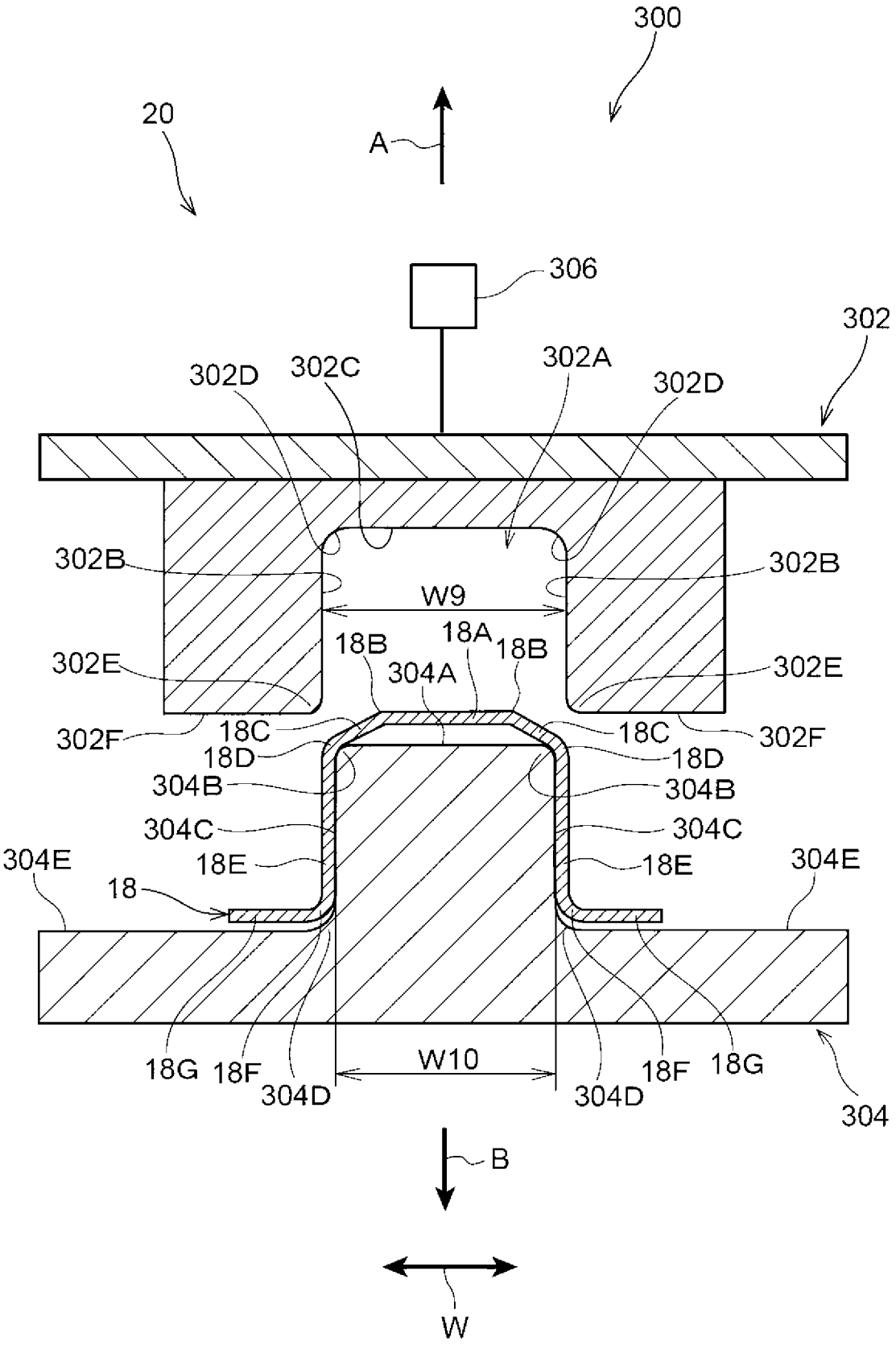
FIG. 9 is a sectional view, seen from the front of a third pressing apparatus, illustrating a third step of pressing the second intermediate formed article to manufacture a press-formed article.
Figure 10:
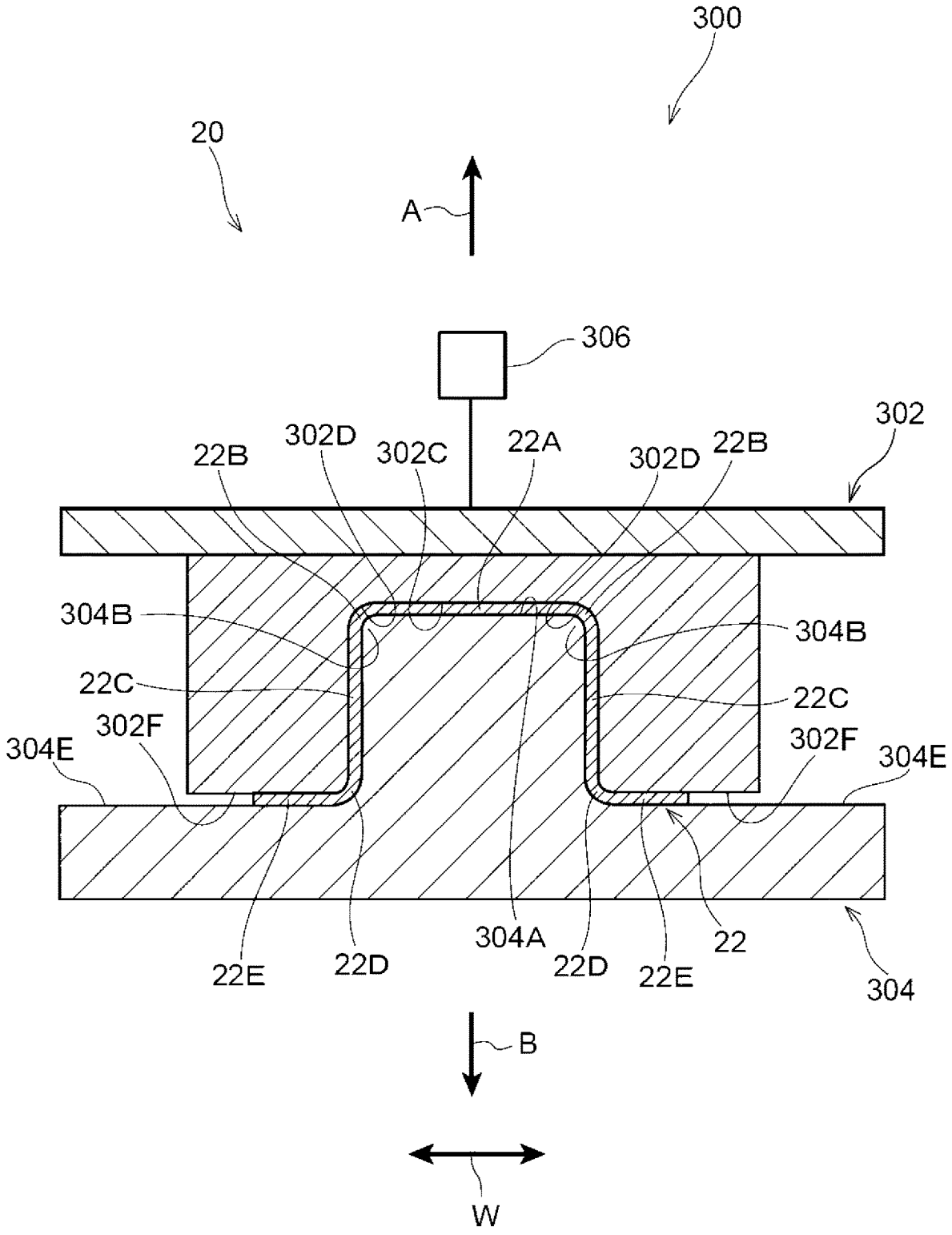
FIG. 10 is a sectional view, seen from the front of the third pressing apparatus, illustrating the third step subsequent to FIG. 9.

The press-formed article manufacturing method has the first step 12 using the first pressing apparatus 100 as illustrated in FIGS. 5 and 6, and the second step 16 using the second pressing apparatus 200 as illustrated in FIGS. 7 and 8. Additionally, as illustrated in FIGS. 9 and 10, the press-formed article manufacturing method has the third step 20 using the third pressing apparatus 300 and will be described in order of the first step 12, the second step 16, and the third step 20. Additionally, in the description of the respective steps 12, 16, and 20, the pressing apparatuses 100, 200, and 300 used in the respective steps 12, 16, and 20 will first be described.

[First Step Using First Pressing Apparatus]

In the first step 12, as illustrated in FIGS. 5 and 6, the first intermediate formed article 14 is formed from the blank 10 by using the first pressing apparatus 100.

In addition, in FIGS. 5 and 6, the arrow W indicates a width direction of the first pressing apparatus 100, and the arrow A indicates an upper side of the first pressing apparatus 100. Additionally, the arrow B indicates a lower side of the first pressing apparatus 100, and the arrow A and the arrow B indicate a press direction. Also, the width direction W of the first pressing apparatus 100 coincides with the width direction W of the first intermediate formed article 14, and a device upward-downward direction of the first pressing apparatus 100 coincides with the upward-downward direction of the first intermediate formed article 14.

"First Pressing Apparatus"

The first pressing apparatus 100 used in the first step 12 includes a first die 102 that constitutes a device upper portion of the first pressing apparatus 100, and a first punch 104 that constitutes a device lower portion of the first pressing apparatus 100, and the first die 102 and the first punch 104 face each other in the press direction.

(First Die)

The first die 102 has a forming surface corresponding to the front-side shapes of the top plate 14A, the bent portions 14B, the inclined walls 14C, the ridge portions 14D, and the flanges 14E of the first intermediate formed article 14. The first die 102 is coupled to a moving device 106, and the moving device 106 includes, for example, a hydraulic device, an electric drive device, or the like. The moving device 106 moves the first die 102 in the device upward-downward direction, which is the press direction, to approach or separate from the first punch 104.

A first die recessed part 102A that becomes narrower as being closer to the upper side A is formed in the first die 102, and wall surfaces of the first die recessed part 102A constitute first die recessed part inclined surfaces 102B that are inclined to a center side in the width direction as being closer to the upper side A.

The first die 102 includes a first die pad 108, and the first die pad 108 is coupled to the first die 102 by a first pad pressing device 110. The first pad pressing device 110 includes, for example, a gas cushion, a hydraulic device, a spring, an electric drive device, or the like.

The first pad pressing device 110 moves the first die pad 108 relative to the first die 102 in the device upward-downward direction that is the press direction. At a bottom dead point where the first die 102 approaches the first punch 104 most, the first die pad 108 is housed in a first die pad housing portion 112 provided in the first die 102 (refer to FIG. 6).

A die bottom of the first die recessed part 102A is constituted of a first die pad lower surface 108A of the first die pad 108 housed in the first die pad housing portion 112, and the first die pad lower surface 108A crosses the press direction that is the device upward-downward direction. The first die pad lower surface 108A has a shape based on the product shape of the press-formed article 22, and in the present embodiment, the shape of the first die pad lower surface 108A is flat.

At the bottom dead point where the first die 102 has approached the first punch 104 most, first die recessed part corner portions 102C are formed between the first die pad lower surface 108A and the first die recessed part inclined surfaces 102B. In addition, although FIG. 5 illustrates an example in which the full width of the die bottom is used as a die pad, a configuration in which a part of the width of the die bottom is used as the die pad and the first die recessed part corner portions 102C are formed in the first die 102 may be adopted. Also, first die shoulder portions 102D are formed on both sides of the first die recessed part 102A, and first die side wall surface 102E inclined with respect to the device upward-downward direction extends from the first die shoulder portions 102D.

(First Punch)

The first punch 104, which faces the first die 102, has the forming surface corresponding to the back-side shapes of the top plate 14A, the bent portions 14B, the inclined walls 14C, the ridge portions 14D, and the flanges 14E of the first intermediate formed article 14.

A first punch top surface 104A corresponding to the first die pad lower surface 108A, first punch shoulder portions 104B, and first punch inclined surfaces 104C corresponding to the first die recessed part inclined surfaces 102B are formed in the first punch 104. The first punch shoulder portions 104B are located between the first punch top surface 104A and the first punch inclined surfaces 104C.

Additionally, first punch corner portions 104D corresponding to the first die shoulder portions 102D and first punch wall surfaces 104E corresponding to the first die side wall surfaces 102E are formed in the first punch 104.

Also, a width W4 in the width direction W of the first punch top surface 104A indicating the spacing between the first punch shoulder portions 104B, and a width W5 of the first die pad lower surface 108A are the same dimension. However, in the case of the configuration in which a part of the width of the die bottom is used as the die pad and the first die recessed part corner portions 102C are formed in the first die 102 the width W4 in the width direction W of the first punch top surface 104A and the spacing between the first die recessed part corner portions 102C are equal to each other.

Here, the region of the other (for example, the first die 102) of the die and punch corresponding to the region of one (for example, the first punch 104) of the die and punch that constitutes each of the pressing apparatuses 100, 200, and 300 refers to portions that face each other at the bottom dead point where both the die and punch have approached each other most (the same applies). Additionally, a case where the region of one of the die and punch and the region of the other of the die and punch are constituted of surfaces, and a case where the surface one of the die and punch and the surface of the other of the die and punch are not parallel to each other are also included.

"First Step"

Next, the first step 12 of pressing the blank 10 by the first pressing apparatus 100 to form the first intermediate formed article 14 will be described.

As illustrated in FIG. 1, the blank 10 supplied to the material table 26 is conveyed to the first pressing apparatus 100 by the first manipulator 34, and the blank 10 is disposed on the first punch top surface 104A of the first punch 104 in a state where the first die pad 108 is separated from the first punch 104 to the upper side A (refer to FIG. 5). Then, as illustrated in FIG. 5, the first die pad 108 is moved to the lower side B by the first pad pressing device 110, and the center portion of the blank 10 is sandwiched between the first die pad lower surface 108A of the first die pad 108 and the first punch top surface 104A of the first punch 104.

In this state, the first die 102 is moved to the lower side B relative to the first punch 104 by the moving device 106 to approach the first punch 104, and the first die 102 and the first die pad 108 are made to reach the bottom dead point as illustrated in FIG. 6.

Then, the blank 10 is pressed by the first die 102, the first die pad 108 and the first punch 104 to obtain the first intermediate formed article 14 including the top plate 14A, the bent portions 14B bent from the top plate 14A to one side in the plate thickness direction (refer to FIG. 26), the inclined walls 14C, the ridge portions 14D, and the flanges 14E.

In this case, as illustrated in FIGS. 2 and 3, the width W1 of the top plate 14A indicating the spacing between the bent portions 14B of the first intermediate formed article 14 is narrower than the width W2 of the top plate 22A of the press-formed article 22 and is equal to or more than a width W7 of a convex portion top surface 216A of the second pressing apparatus 200 to be described below.

[Second Step Using Second Pressing Apparatus]

In the second step 16, as illustrated in FIGS. 7 and 8, the second intermediate formed article 18 is formed from the first intermediate formed article 14 by using the second pressing apparatus 200.

In addition, in FIGS. 7 and 8, the arrow W indicates a width direction of the second pressing apparatus 200, and the arrow A indicates an upper side of the second pressing apparatus 200. Additionally, the arrow B indicates a lower side of the second pressing apparatus 200, and the arrow A and the arrow B (device upward-downward direction) indicate a press direction. Also, the width direction W of the second pressing apparatus 200 coincides with the width direction W of the first intermediate formed article 14 and the second intermediate formed article 18, and a device upward-downward direction of the second pressing apparatus 200 coincides with the upward-downward direction of the first intermediate formed article 14 and the second intermediate formed article 18.

"Second Pressing Apparatus"

The second pressing apparatus 200 used in the second step 16 includes a second die 202 that constitutes a device upper portion of the second pressing apparatus 200, and a second punch 204 that constitutes a device lower portion of the second pressing apparatus 200, and the second die 202 and the second punch 204 face each other in the press direction.

(Second Die)

The second die 202 has a forming surface corresponding to the front-side shapes of the top plate 18A and the standing wall portions 18E of the second intermediate formed article 18. The second die 202 is coupled to a moving device 206, and the moving device 206 includes, for example, a hydraulic device, an electric drive device, or the like. The moving device 206 moves the second die 202 in the press direction to approach or separate from the second punch 204.

A second die hole 202A opening to the lower side B is formed at a center portion of the second die 202 in the width direction, and the spacing between second die hole wall surfaces 202B of the second die hole 202A indicates a width W6 in the width direction W of the second die hole 202A. A second die pad 208 is housed in the second die hole 202A, and the second die hole 202A also serves as a second die pad housing portion that houses the second die pad 208.

The second die pad 208 is coupled to the second die 202 by a second pad pressing device 210, and the second pad pressing device 210 includes, for example, a gas cushion, a hydraulic device, a spring, an electric drive device, or the like. The second pad pressing device 210 moves the second die pad 208 relative to the second die 202 in the device upward-downward direction that is the press direction. At the bottom dead point where the second die 202 approaches the second punch 204 most, the second die pad 208 moves back up to the back of the second die hole 202A (refer to FIG. 8).

A die bottom of the second die 202 is constituted of a lower surface of the second die pad 208 that has moved back to the back of the second die hole 202A, and the lower surface of the second die pad 208 constitutes a convex-portion facing surface 208A that faces the convex portion top surface 216A to be described below. The convex-portion facing surface 208A crosses the press direction that is the device upward-downward direction. The convex-portion facing surface 208A has a shape based on the product shape of the press-formed article 22, and in the present embodiment, the shape of the convex-portion facing surface 208A is flat.

At the bottom dead point where the second die 202 has approached the second punch 204 most, as illustrated to FIG. 8, second die hole corner portions 202C are formed by the convex-portion facing surface 208A and the second die hole wall surfaces 202B. Second die shoulder portions 202D are formed on both sides of the second die hole 202A in the width direction W, and second die end surfaces 202E extend from the second die shoulder portions 202D.

(Second Punch)

The second punch 204, which faces the second die 202, has a forming surface corresponding to the back-side shapes of the top plate 18A and the standing wall portions 18E of the second intermediate formed article 18.

The second punch 204 includes a second punch top portion 204A that crosses the press direction, and a second punch recessed part 204C recessed from a second punch top surface 204B is formed in the second punch top portion 204A. A split die 212, which is split from a second punch body 204D constituting a main body portion of the second punch 204, is housed in the second punch recessed part 204C. A spacer 214 is disposed between the split die 212 and a bottom surface of the second punch recessed part 204C, which is provided in the second punch body 204D, in the press direction.

The split die 212 constitutes a convex portion 216 that protrudes to the upper side A from the second punch top surface 204B. The protruding amount of the convex portion 216 from the second punch top surface 204B is obtained by simulating the shape of the press-formed article 22 formed on the basis of the tensile strength, plate thickness, or the like of a material metal plate (blank 10) to be used, and is appropriately set depending on the simulation result. Alternatively, on the basis of the tendency in which a standing wall is displaced relatively inward as the protruding amount is larger, press forming may be formed instead of the protruding amount under several conditions in actual machines, and an appropriate protruding amount may be obtained.

The convex portion top surface 216A of the convex portion 216 crosses the press direction that is the device upward-downward direction. The convex portion top surface 216A has a shape based on the product shape of the press-formed article 22, and in the present embodiment, the shape of the convex portion top surface 216A is flat.

Since the split die 212 that forms the convex portion top surface 216A is replaceable, the split die can be changed in accordance with the product shape of the press-formed article 22. Additionally, the protruding amount of the convex portion 216 from the punch top surface 204B can be changed by the replacement of the spacer 214. In this way, although the protruding amount (a position in the press direction) of the convex portion 216 provided in the second punch 204 can be adjusted by the replacement of the spacer 214, it is natural that the protruding amount of the convex portion 216 under pressing is constant. That is, the convex portion 216 in the present embodiment does not have a mechanism (for example, a gas cushion, a hydraulic device, a spring, an electric drive device, or the like) that is made movable in the press direction during pressing.

The width W7 of the convex portion top surface 216A in the width direction W of the convex portion 216 is equal to or less than the width W4 in the width direction W of the first punch top surface 104A indicating the spacing between the first punch shoulder portions 104B in the first punch 104 of the first pressing apparatus 100.

Second punch shoulder portions 204E are respectively provided on both sides of the second punch top portion 204A, and second punch wall surfaces 204F extend from the second punch shoulder portion 204E, respectively. The second punch wall surfaces 204F correspond to the second die hole wall surfaces 202B, and the second punch wall surfaces 204F constitute a forming surface corresponding to the back-side shape of the standing wall portions 18E of the second intermediate formed article 18.

The width W8 of the shoulder of the second punch 204 indicating the spacing between the second punch shoulder portions 204E is larger than the width W4 in the width direction W of the first punch top surface 104A that is the spacing between the first punch shoulder portions 104B in the first punch 104 of the first pressing apparatus 100.

"Second Step"

Next, the second step 16 of pressing the first intermediate formed article 14 by the second pressing apparatus 200 to form the second intermediate formed article 18 will be described.

As illustrated in FIG. 1, the first intermediate formed article 14 formed by the first pressing apparatus 100 is conveyed to the second pressing apparatus 200 by the second manipulator 36, and the first intermediate formed article 14 is disposed on the convex portion top surface 216A of the second punch 204 in a state where the second die pad 208 is separated from the second punch 204 to the upper side A (refer to FIG. 7). Specifically, the rear surface side, which is one side of the first intermediate formed article 14 in the plate thickness direction, is the second punch 204 side, and the top plate 14A between the bent portions 14B of the first intermediate formed article 14 is disposed on the convex portion 216.

Here, by adjusting (adjustment performed in the first step) the pre-curvature angle θ1 of the first intermediate formed article 14, the inclined walls 14C are supported by the second punch shoulder portions 204E while being kept flat in a state where the top plate 14A of the first intermediate formed article 14 is disposed on the convex portion 216.

Additionally, if the width W1 on the rear surface side of the top plate 14A of the first intermediate formed article 14 and the width W7 of the convex portion top surface 216A are made to coincide with each other, the positional deviation, in the width direction W, of the first intermediate formed article 14 disposed on the convex portion top surface 216A can be suppressed.

Then, as illustrated in FIG. 7, the second die pad 208 is moved to the lower side B by the second pad pressing device 210, the top plate 14A of the first intermediate formed article 14 is sandwiched between the convex-portion facing surface 208A of the second die pad 208 and the convex portion top surface 216A of the convex portion 216.

In this state, the second die 202 is moved to the lower side B relative to the second die pad 208 and the second punch 204 by the moving device 206 to approach the second punch 204, and the second die 202 and the second die pad 208 are made to reach the bottom dead point as illustrated in FIG. 8. In this case, the second die pad 208 and the back of the die hole 202A approach each other with the relative movement of the second die 202 to the lower side B, and the second die pad 208 approaches the back of the second die hole 202A most at the time of the arrival of the bottom dead point.

Then, in the first intermediate formed article 14, the inclined walls 14C are pressed and bent to the lower side B by the second die shoulder portions 202D of the second die 202 and are formed as the punch shoulder bent portions 18D. Additionally, parts of the inclined walls 14C of the first intermediate formed article 14 are pressed by the second die hole wall surfaces 202B and the second punch wall surface 204F and are formed as the standing wall portions 18E.

Accordingly, a region between the punch shoulder bent portions 18D protrudes to the front side that is the upper side A, and the second intermediate formed article 18 having the standing wall portions 18E is formed.

In the second step 16 described above, in the first intermediate formed article 14 in which the top plate 14A is sandwiched between the second die pad 208 and the convex portion 216, the inclined walls 14C approach the second punch shoulder portions 204E.

For this reason, when the second die 202 is relatively moved to the second punch 204 side to form the standing wall portions 18E, curved deformation in which the portions disposed between the second punch shoulder portions 204E of the second punch 204 and the shoulder portions of the convex portion 216 are convex to the front side that is the other side in the plate thickness direction is suppressed. That is, in the second step 16 of the present embodiment, the formation of a loose portion 1702 that is curved in a wide range of a length L1 as illustrated in FIG. 11 relating to the related art can be suppressed.

In this way, in the second intermediate formed article 18, the curved deformation between each bent portion 18B and each punch shoulder bent portion 18D (the formation of the loose portion 1702) is suppressed.

[Third Step Using Third Pressing Apparatus]

In the third step 20, as illustrated in FIGS. 9 and 10, the press-formed article 22, which is the final formed article, is formed from the second intermediate formed article 18 by using the third pressing apparatus 300.

In addition, in FIGS. 9 and 10, the arrow W indicates a width direction of the third pressing apparatus 300, and the arrow A indicates an upper side of the third pressing apparatus 300. Additionally, the arrow B indicates a lower side of the third pressing apparatus 300, and the arrow A and the arrow B indicate a press direction. Also, the width direction W of the third pressing apparatus 300 coincides with the width direction W of the second intermediate formed article 18 and the press-formed article 22, and a device upward-downward direction of the third pressing apparatus 300 coincides with the upward-downward direction of the second intermediate formed article 18 and the press-formed article 22.

"Third Pressing Apparatus"

The third pressing apparatus 300 used in the third step 20 includes a third die 302 that constitutes a device upper portion of the third pressing apparatus 300, and a third punch 304 that constitutes a device lower portion of the third pressing apparatus 300, and the third die 302 and the third punch 304 face each other in the press direction.

(Third Die)

The third die 302 has a forming surface corresponding to the front-side shapes of the top plate 22A, the ridge portions 22B, the standing walls 22C, the ridge portions 22D, and the flanges 22E of the press-formed article 22. The third die 302 is coupled to a moving device 306, and the moving device 306 includes, for example, a hydraulic device, an electric drive device, or the like. The moving device 306 moves the third die 302 in the device upward-downward direction, which is the press direction, to approach or separate from the third punch 304.

A third die hole 302A, which opens to the lower side B, is formed at a center portion of the third die 302 in the width direction. The spacing between third die hole wall surfaces 302B of the third die hole 302A indicates a width W9 in the width direction W of the third die hole 302A, and the width W9 is equal to the width W6 of the second die hole 202A in the second die 202 of the second pressing apparatus 200.

A third die hole bottom surface 302C of the third die hole 302A crosses the press direction that is the device upward-downward direction. The third die hole pad bottom surface 302C has a shape based on the product shape of the press-formed article 22, and in the present embodiment, the shape of the third die hole pad bottom surface 302C is flat.

Third die hole corner portions 302D are provided between the third die hole bottom surface 302C and the third die hole wall surfaces 302B, and in the embodiment, the third die hole corner portions 302D constitute a forming surface corresponding to the front-side shape of the ridge portions 22B of the press-formed article 22.

Third die shoulder portions 302E are formed on both sides of the third die hole 302A, and third die end surfaces 302F extend from the third die shoulder portions 302E. The third die end surfaces 302F constitute a forming surface corresponding to the front-side shape of the flanges 22E of the press-formed article 22.

(Third Punch)

The third punch 304 facing the third die 302 has a forming surface corresponding to the back-side shapes of the top plate 22A, the ridge portions 22B, the standing walls 22C, the ridge portions 22D, and the flanges 22E of the press-formed article 22.

The third punch 304 includes a third punch top surface 304A that crosses the press direction, and the third punch top surface 304A crosses the press direction that is the device upward-downward direction. The third punch top surface 304A has a shape based on the product shape of the press-formed article 22, and in the present embodiment, the shape of the third punch top surface 304A is flat.

Third punch shoulder portions 304B are provided on both sides of the third punch top surface 304A. The third punch shoulder portions 304B correspond to the third die hole corner portions 302D and constitute the forming surface corresponding to the back-side shape of the ridge portions 22B of the press-formed article 22.

Third punch wall surfaces 304C extend from the third punch shoulder portions 304B, respectively. The third punch wall surfaces 304C correspond to the third die hole wall surfaces 302B, and the third punch wall surfaces 304C constitute a forming surface corresponding to the back-side shape of the standing walls 22C of the press-formed article 22.

Third punch corner portions 304D are formed at end portions of the third punch wall surfaces 304C. The third punch corner portions 304D corresponds to the third die shoulder portions 302E, and the third punch corner portions 304D constitutes a forming surface corresponding to the back-side shape of the ridge portions 22D of the press-formed article 22.

Third punch base surfaces 304E extend in the width direction W from the third punch corner portions 304D. The third punch base surfaces 304E correspond to the third die end surfaces 302F of the third die 302, and constitute a forming surface corresponding to the back-side shape of the flanges 22E of the press-formed article 22.

A spacing W10 in the width direction W between the third punch shoulder portions 304B is equal to the spacing W8 in the width direction W between the second punch shoulder portions 204E in the second punch 204 of the second pressing apparatus 200.

"Third Step"

Next, the third step 20 of pressing the second intermediate formed article 18 by the third pressing apparatus 300 to form the press-formed article 22 will be described.

As illustrated in FIG. 1, the second intermediate formed article 18 formed by the second pressing apparatus 200 is conveyed to the third pressing apparatus 300 by the third manipulator 38, and the second intermediate formed article 18 is disposed on the third punch top surface 304A of the third punch 304 (refer to FIG. 9). Specifically, the rear surface side, which is one side in the plate thickness direction of the second intermediate formed article 18, is the third punch 304 side, and a portion between the punch shoulder bent portions 18D of the second intermediate formed article 18 is disposed on the third punch top surface 304A.

In this case, the region of the second intermediate formed article 18 between the punch shoulder bent portions 18D protrudes to the front side that is the upper side A, and the punch shoulder bent portions 18D are positioned by being supported by the third punch shoulder portions 304B in a state where the top plate 18A is separated from the third punch top surface 304A.

In this state, the third die 302 is moved to the lower side B relative to the third punch 304 by the moving device 306 to approach the third punch 304, and the third die 302 is made to reach the bottom dead point as illustrated in FIG. 10.

Then, the region of the second intermediate formed article 18 between the punch shoulder bent portions 18D, which protrudes to the front side that is the upper side A, is pressed by the third die hole bottom surfaces 302C and the third punch top surface 304A, and the protrusion portion between the punch shoulder bent portions 18D is crushed. Additionally, in the second intermediate formed article 18, the bent portions 18B are bent and stretched flatly to form the press-formed article 22.

Functions and Effects

Next, the functions and effects of the present embodiment will be described in comparison with a manufacturing method of a comparative example.

First, a press-formed article manufacturing method in a comparative example will be described. The press-formed article manufacturing method of the comparative example has a first step of forming a first intermediate formed article by pressing a flat-plate-shaped blank, a second step of forming a second intermediate formed article by pressing the first intermediate formed article, and a third step of forming a press-formed article, which is an end product, by pressing the second intermediate formed article.

First Step of Comparative Example

Figure 27:
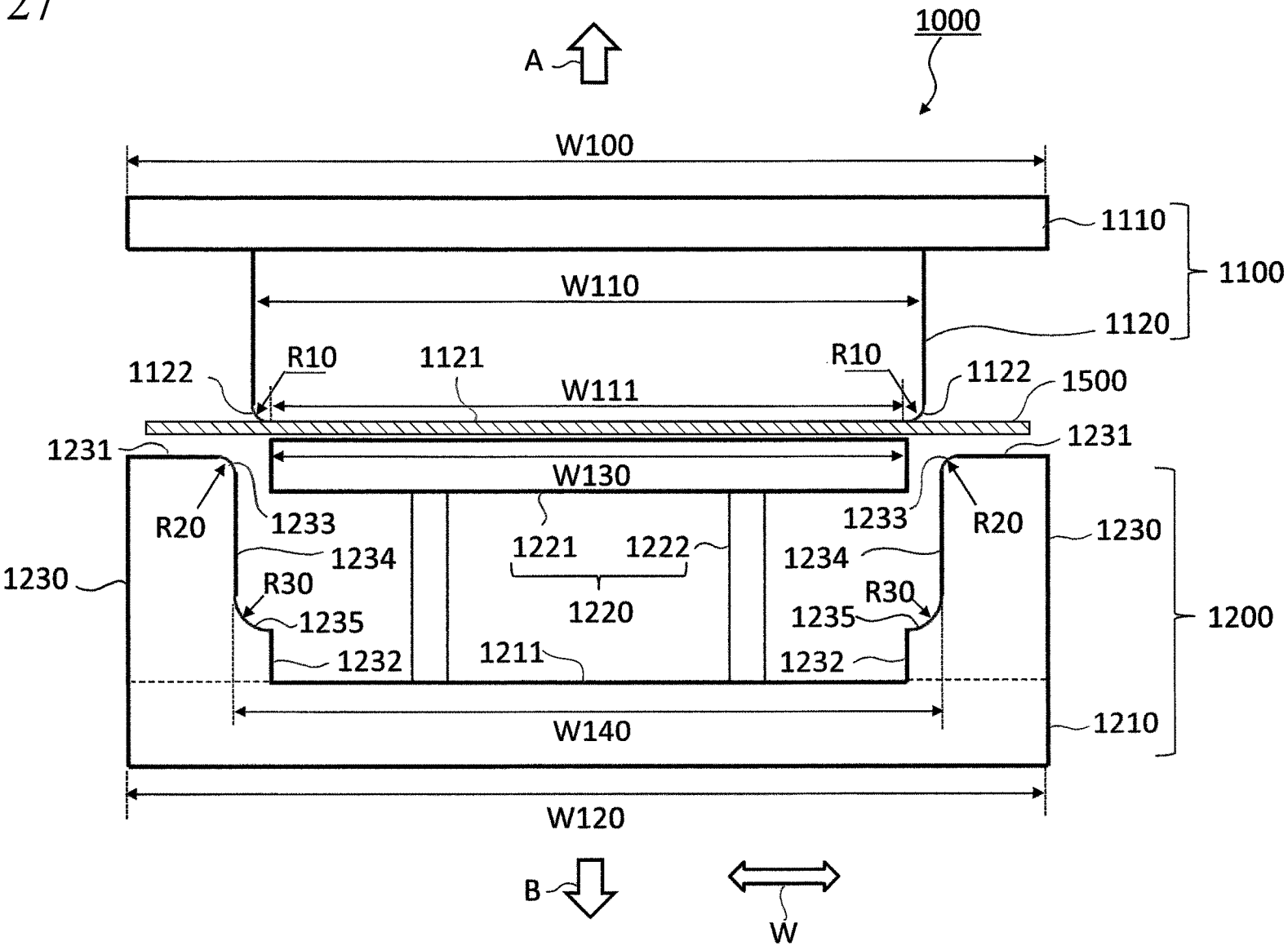
FIG. 27 is a schematic view illustrating a first step (a state before press forming is started) of a comparative example.
Figure 28:
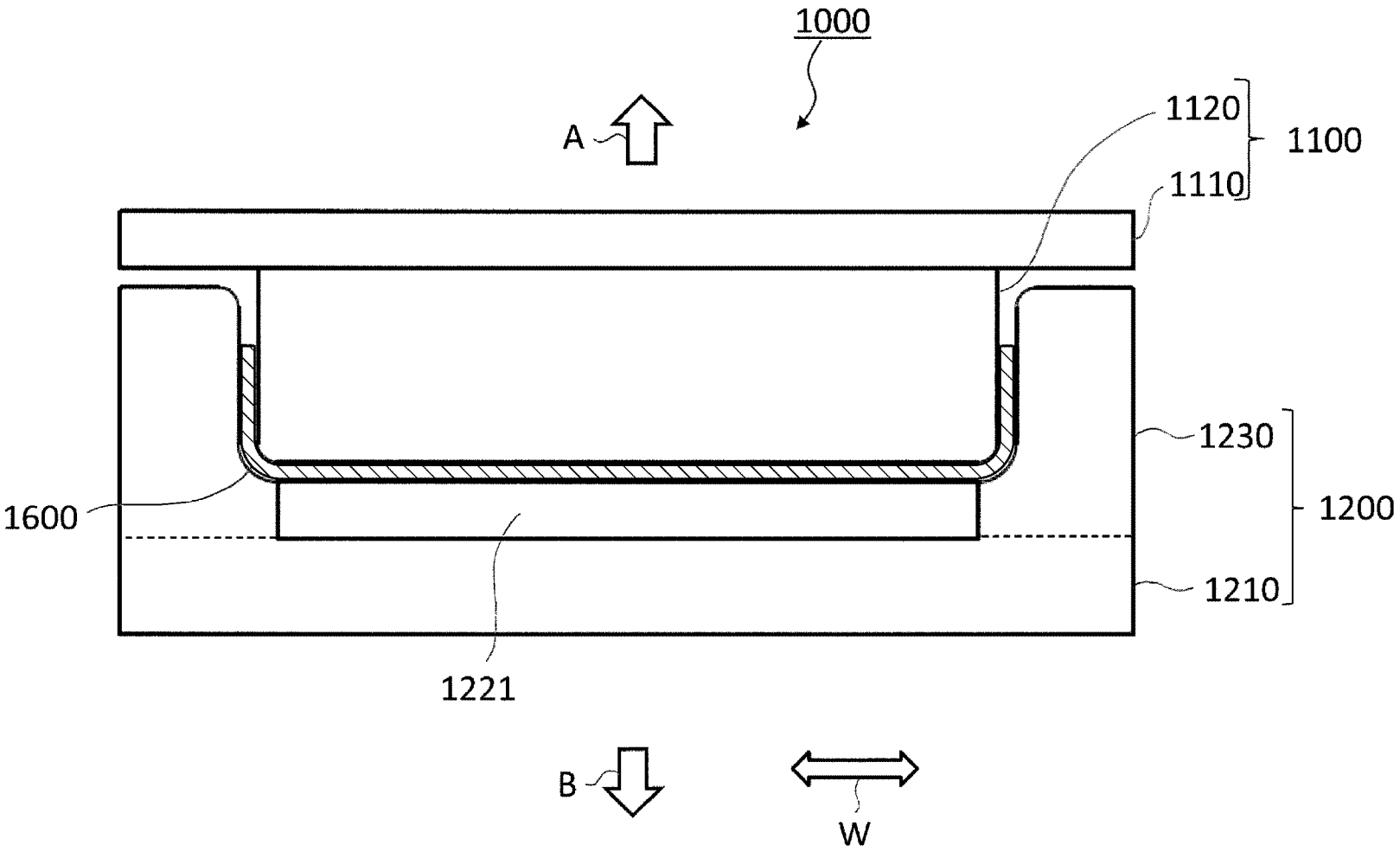
FIG. 28 is a schematic view illustrating the first step (a state when the press forming is completed) of the comparative example.

FIGS. 27 and 28 are schematic views illustrating the first step of a comparative example. FIG. 27 illustrates a state before press forming is started, and FIG. 28 illustrates a state when the press forming is completed. In the first step of the comparative example, a first pressing apparatus 1000, which forms a first intermediate formed article 1600 by pressing a flat-plate-shaped blank 1500, is used. The first pressing apparatus 1000 includes a first punch 1100 disposed on an upper side (a direction of an arrow A in the drawings) in a press direction, and a first die 1200 disposed on a lower side (a direction of an arrow B in the drawings) in the press direction. In a width direction (a direction of an arrow W in the drawings) of the first pressing apparatus 1000, a central axis of the first punch 1100 coincides with a central axis of the first die 1200.

The first punch 1100 has a punch baseplate 1110 of which the length (that is, width) in the width direction W of the first pressing apparatus 1000 is W100, and a punch body 1120 provided so as to protrude toward the lower side in the press direction from a center portion of the punch baseplate 1110. The punch body 1120 has a width W110 shorter than the width W100 of the punch baseplate 1110.

A punch tip end surface 1121, which is a surface parallel to the width direction W, is provided at the tip (lower end) of the punch body 1120. Additionally, a pair of punch shoulder surfaces 1122, which is curved surfaces having a center of curvature located inside the punch body 1120 and having a predetermined curvature radius R10, is provided at both end portions of the punch tip end surface 1121 in the width direction so as to be continuous with the punch tip end surface 1121. The width W111 of the punch tip end surface 1121 is expressed by the following Formula (2).

$$W111 = W110 - (2 \times R10) \quad (2)$$

The first punch 1100 configured in this way is movable upward and downward in the press direction by a drive device (not illustrated).

The first die 1200 has a die baseplate 1210 having the same width W120 as the width W100 of the punch baseplate 1110, a die pad 1220 provided so as to be capable of being lifted and lowered in the press direction with respect to the die baseplate 1210, a pair of die wall portions 1230 that rises toward the upper side in the press direction from both end portions of the die baseplate 1210 in the width direction.

The die pad 1220 has a pad plate 1221 having a width W130, and a pad lifting mechanism 1222 that supports the pad plate 1221 so as to be capable of being lifted and lowered with respect to the die baseplate 1210. The pad plate 1221 is provided so as to be parallel to and face the punch tip end surface 1121. The width W130 of the pad plate 1221 is the same as a width W111 of the punch tip end surface 1121. The pad lifting mechanism 1222 is, for example, a gas cushion, a hydraulic device, a spring, or an electric actuator.

Die tip end surfaces 1231, which are surfaces parallel to the width direction W, are provided at tips (upper ends) of the pair of die wall portions 1230. Additionally, the pair of die wall portions 1230 have first inner wall surfaces 1232, die shoulder surfaces 1233, second inner wall surfaces 1234, and inner wall concave surfaces 1235 as surfaces that face inward in the width direction, respectively.

The first inner wall surfaces 1232 are planar surfaces that rise perpendicularly from an upper surface 1211 of the die baseplate 1210. The distance in the width direction W between the pair of first inner wall surfaces 1232 is equal to the width W130 of the pad plate 1221. Additionally, the length (height) of the first inner wall surfaces 1232 in the press direction is equal to the plate thickness of the pad plate 1221. That is, the pad plate 1221 is capable of being housed in a space (hereinafter, this space is referred to as a pad housing space) surrounded by the upper surface 1211 of the die baseplate 1210 and the pair of first inner wall surfaces 1232 (refer to FIG. 28).

The die shoulder surfaces 1233 are curved surfaces having a center of curvature located inside the die wall portions 1230, and have a predetermined curvature radius R20, and are provided so as to be continuous with the die tip end surfaces 1231. The second inner wall surfaces 1234 are planar surfaces that are continuous with the die shoulder surfaces 1233 and extend toward the lower side in the press direction from the die shoulder surfaces 1233. A distance W140 in the width direction between the pair of second inner wall surfaces 1234 is larger than the width W110 of the punch body 1120. Specifically, when the plate thickness of the blank 1500 is t, the distance W140 between the pair of second inner wall surfaces 1233 is expressed by the following Formula (3).

$$W140 \geq W110 + (2 \times t) \quad (3)$$

The inner wall concave surfaces 1235 are curved surfaces that are continuous with the first inner wall surfaces 1232 and the second inner wall surfaces 1234, in other words, curved surfaces that connect the first inner wall surfaces 1232 and the second inner wall surfaces 1234 to each other. Additionally, the inner wall concave surfaces 1235 are curved surfaces having a center of curvature located outside the die wall portions 1230 and having a predetermined curvature radius R30. The curvature radius R30 of the inner wall concave surfaces 1235 is expressed by the following Formula (4).

$$R30 \leq R10+t \quad (4)$$

In addition, the distance (height) in the press direction from upper ends of the first inner wall surfaces 1232 to the die tip end surfaces 1231 are the same as the length of the punch body 1120 in the press direction.

According to the first die 1200 configured in this way, when the pad plate 1221 is housed in the above pad housing space, it is possible to house the punch body 1120 in a space (hereinafter, this space is referred to as a punch housing space) surrounded by the pair of die shoulder surfaces 1233, the pair of second inner wall surfaces 1234, the pair of inner wall concave surfaces 1235, and the pad plate 1221 in a state where the blank 1500 (first intermediate formed article 1600) is sandwiched (refer to FIG. 28).

The configuration of the first pressing apparatus 1000 used in the first step of the comparative example has been described above. Subsequently, a method of forming the first intermediate formed article 1600 by pressing the blank 1500 by the first pressing apparatus 1000 will be described.

As illustrated in FIG. 27, in the state before the press forming is started, the position (height) of the pad plate 1221 in the press direction is held at a maximum height position by the pad lifting mechanism 1222. That is, in this state, an upper surface of the pad plate 1221 is located above the die tip end surfaces 1231. In this way, the blank 1500 is placed on the upper surface of the pad plate 1221 held at the maximum height position. In this case, the center of the blank 1500 in the width direction coincides with a central axis of the pad plate 1221 (a central axis of the first die 1200). In addition, as can be seen from FIG. 27, the width of the blank 1500 is larger than the distance W140 between the pair of second inner wall surfaces 1234.

As the first punch 1100 is lowered toward the first die 1200, after the blank 1500 is placed on the upper surface of the pad plate 1221, as illustrated in FIG. 27, the blank 1500 is sandwiched between the punch tip end surface 1121 and the upper surface of the pad plate 1221.

When the first punch 1100 is further lowered from the state illustrated in FIG. 27, the pad plate 1221 is pressed downward from the maximum height position, and the blank 1500 is brought into contact with the pair of die tip end surfaces 1231. When the first punch 1100 is further lowered from this state, the blank 1500 starts to be bent with positions corresponding to both end surfaces of the pad plate 1221 in the width direction as starting points such that both end portions of the blank 1500 in the width direction face the upper side in the press direction.

Then, as illustrated in FIG. 28, when the first punch 1100 is finally lowered to the bottom dead point, the pad plate 1221 is housed in the pad housing space and the punch body 1120 is housed in the punch housing space in a state where the blank 1500 (first intermediate formed article 1600) is sandwiched. As a result, the first intermediate formed article 1600 having the shape as illustrated in FIG. 29 is obtained.

Figure 29:
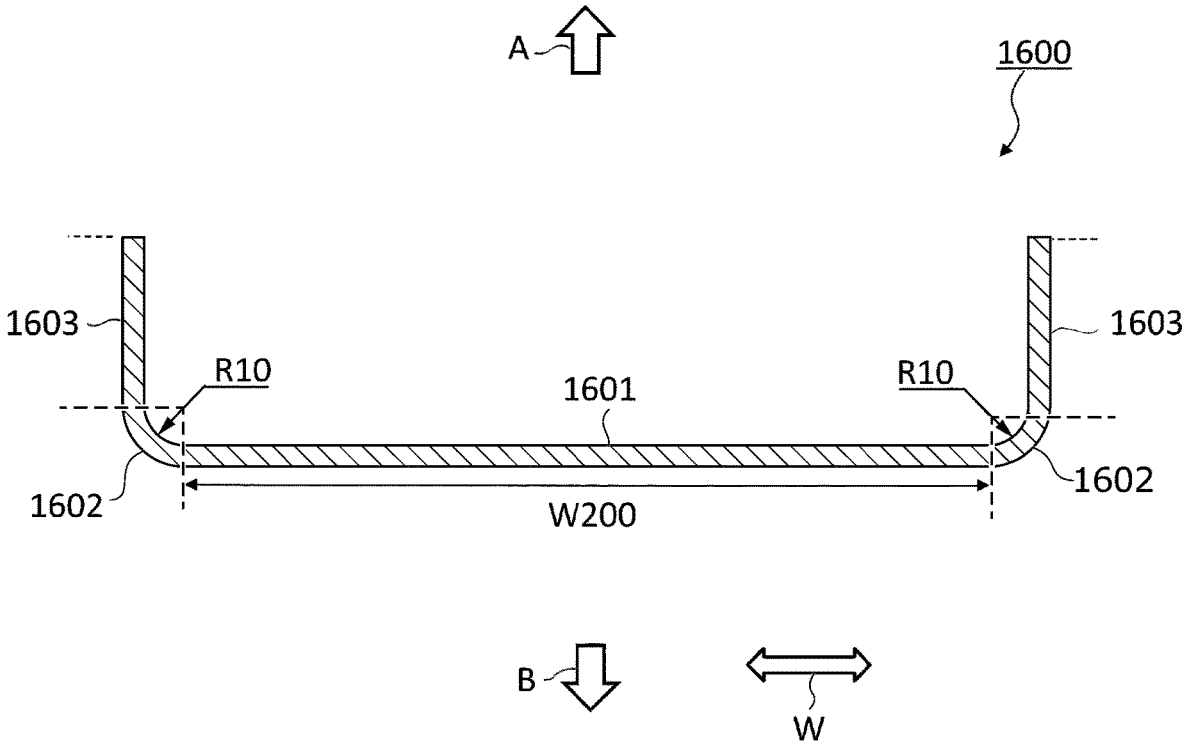
FIG. 29 is a sectional view of a first intermediate formed article 1600 obtained by the first step of the comparative example as seen from the front.

As illustrated in FIG. 29, the first intermediate formed article 1600 has a flat plate portion 1601, a pair of bent portions 1602, and a pair of flanges 1603. The flat plate portion 1601 has a width W200 equal to the width W130 of the pad plate 1221. One of the pair of bent portions 1602 is a region that is continuous with one end portion of the flat plate portion 1601 in the width direction and is curved toward the upper side in the press direction. The other of the pair of bent portions 1602 is a region that is continuous with the other end portion of the flat plate portion 1601 in the width direction, and curves toward the upper side in the press direction.

Each of the pair of bent portions 1602 has an inner curvature radius equal to the curvature radius R10 of each punch shoulder surfaces 1122 and has an outer curvature radius equal to the value of R10+t. Additionally, the bending angle of each of the pair of bent portions 1602 is 90 degrees.

One of the pair of flanges 1603 is a region that is continuous with one of the pair of bent portions 1602 and extends perpendicularly to the width direction W toward the upper side in the press direction. The other of the pair of flanges 1603 is a region that is continuous with the other of the pair of bent portions 1602 and extends perpendicularly to the width direction W toward the upper side in the press direction.

As can be seen from FIG. 29, the first step of the comparative example is intended to press the blank 1500, thereby obtaining the first intermediate formed article 1600 in which the flanges 1603 corresponding to flanges of an end product (press-formed article) are formed. Here, in the process of the pressing, the bent portions 1602 are additionally formed in the first intermediate formed article 1600. However, it should be noted that the bent portions 1602 of the first intermediate formed article 1600 is different from the bent portions 14B of the first intermediate formed article 14 obtained in the first step 12 of the present embodiment.

That is, the bent portions 14B of the first intermediate formed article 14 obtained in the first step 12 of the present embodiment are "the bent portions that are bent to one side in the plate thickness direction" and are regions, which are provided in regions corresponding to a top plate of an end product, among the regions of the first intermediate formed article 14. On the other hand, the bent portions 1602 of the first intermediate formed article 1600 obtained in the first step of the comparative example are "the bent portions that are bent to one side in the plate thickness direction", but are regions provided between regions (flanges 1603) corresponding to flanges of an end product, and the other region (flat plate portion 1601), among the regions of the first intermediate formed article 1600.

In this way, the first intermediate formed article 14 obtained in the first step 12 of the present embodiment has the bent portions 14B, whereas the first intermediate formed article 1600 obtained in the first step of the comparative example does not have regions equivalent to the bent portions 14B.

Second Step of Comparative Example

Figure 30:
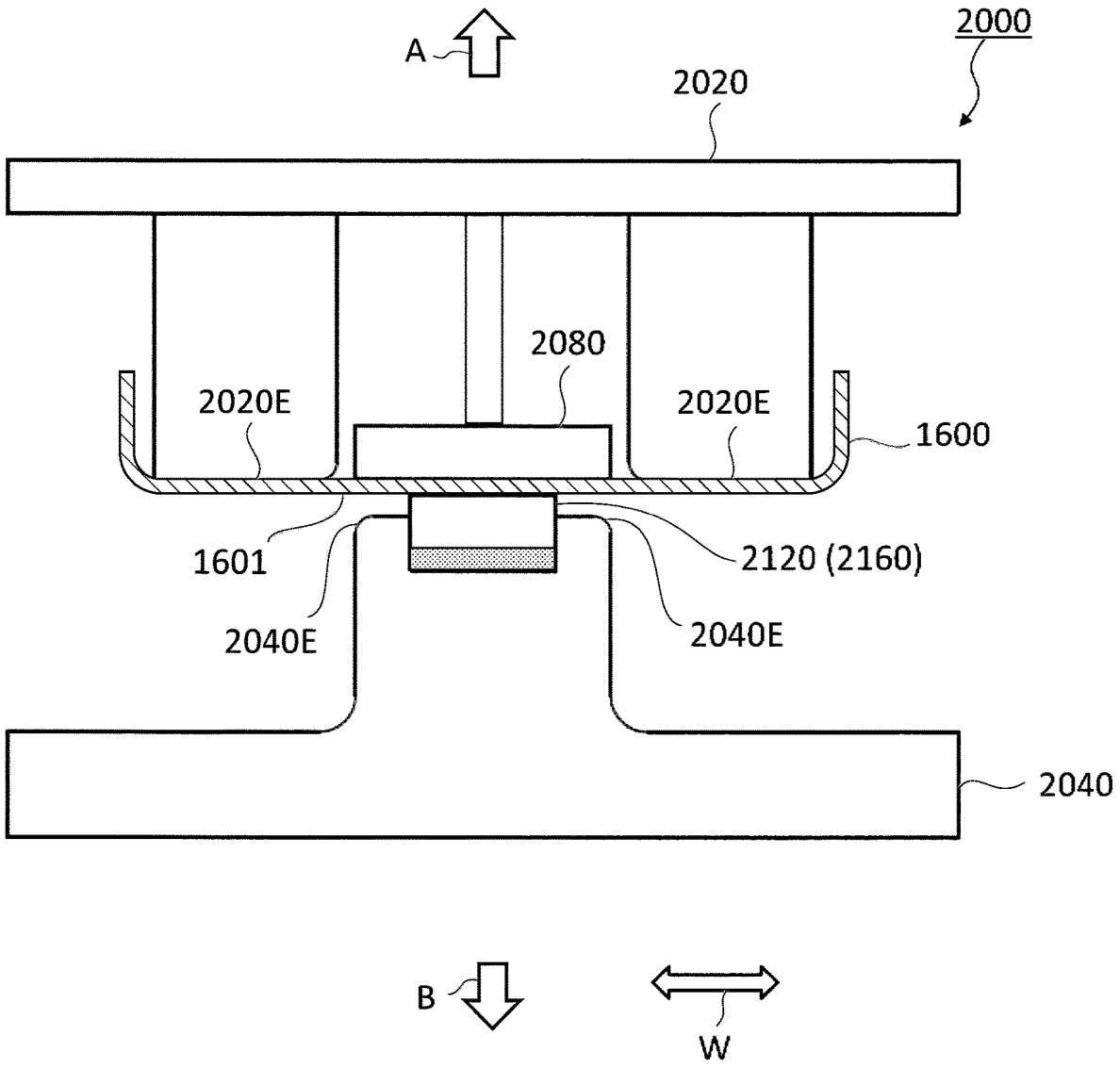
FIG. 30 is a schematic view illustrating a second step (a state before press forming is started) of the comparative example.
Figure 31:
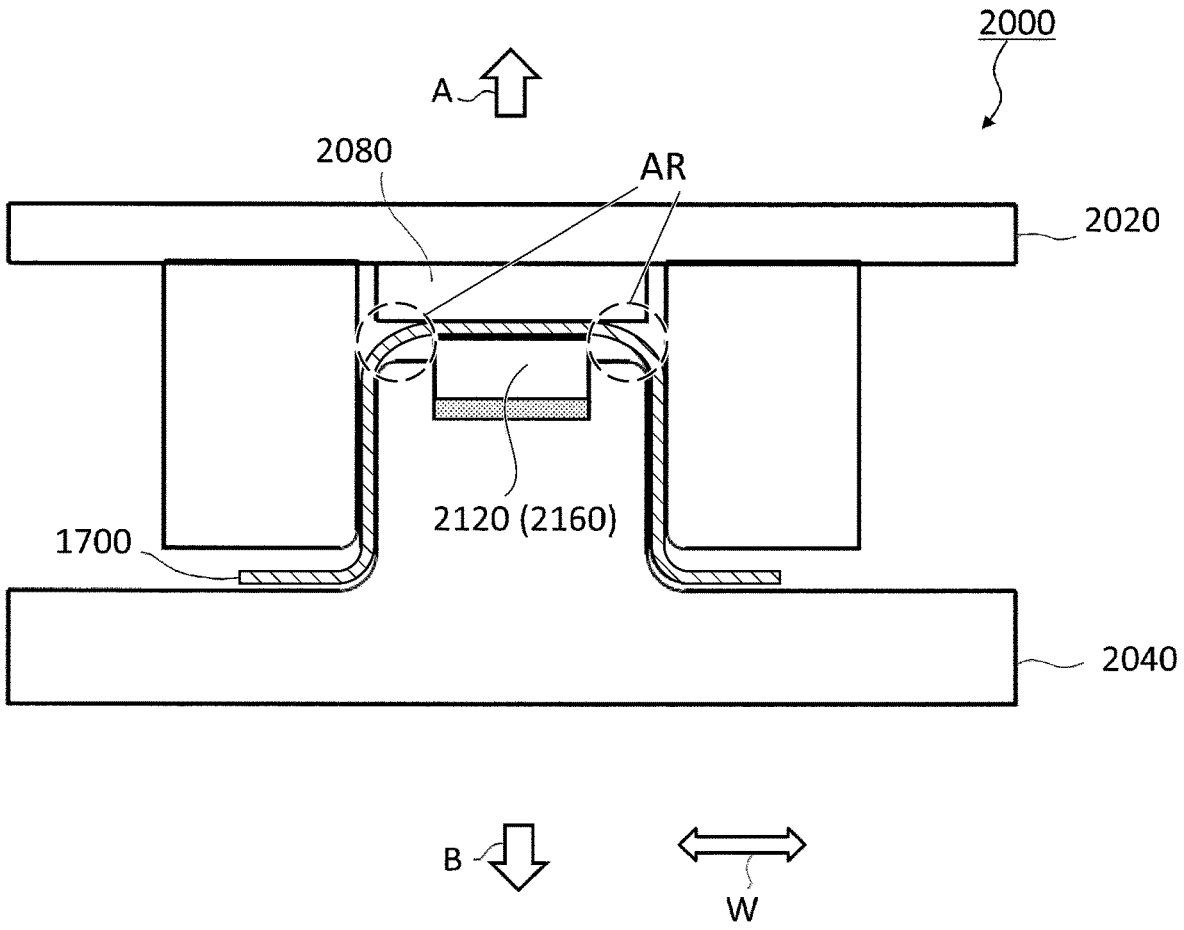
FIG. 31 is a schematic view illustrating the second step (a state when the press forming is completed) of the comparative example.

Subsequently, a second step of the comparative example will be described. FIGS. 30 and 31 are schematic views illustrating the second step of the comparative example. FIG. 30 illustrates a state before press forming is started, and FIG. 31 illustrates a state when the press forming is completed. In the second step of the comparative example, a second pressing apparatus 2000, which forms a second intermediate formed article 1700 by pressing the first intermediate formed article 1600, is used.

The second pressing apparatus 2000 includes the same configuration as the second pressing apparatus 200 of the present embodiment. That is, the second pressing apparatus 2000 has a second die 2020 having the same configuration as the second die 202 of the present embodiment, and a second punch 2040 having the same configuration as the second punch 204 of the present embodiment. Therefore, the detailed description of the configuration of the second pressing apparatus 2000 is omitted.

As the second die 2020 is lowered toward the second punch 2040 after the first intermediate formed article 1600 is placed on a split die 2120 (convex portion 2160) of the second punch 2040, as illustrated in FIG. 30, a flat plate portion 1601 of the first intermediate formed article 1600 is sandwiched between a second die pad 2080 of the second die 2020 and the split die 2120 of the second punch 2040. Additionally, in this state, a pair of second die end surfaces 2020E is in contact with the flat plate portion 1601 of the first intermediate formed article 1600.

While the second die 2020 is lowered toward the bottom dead point from the state illustrated in FIG. 30, the first intermediate formed article 1600 is processed in order of the following (i) to (iii).

(i) The flat plate portion 1601 of the first intermediate formed article 1600 is bent toward the lower side in the press direction with positions corresponding to both end surfaces of the split die 2120 in the width direction as starting points.

(ii) The bent flat plate portion 1601 comes into contact with second punch shoulder portions 2040E.

(iii) The flat plate portion 1601 is further bent with positions where the flat plate portion comes into contact with the second punch shoulder portions 2040E as starting points.

As described above, while the second die 2020 is lowered toward the bottom dead point, the flat plate portion 1601 of the first intermediate formed article 1600 is subjected to two steps of bending work. Then, as illustrated in FIG. 31, when the second die 2020 is finally lowered to the bottom dead point, the second intermediate formed article 1700 having a shape close to an end product is obtained.

Figure 32:
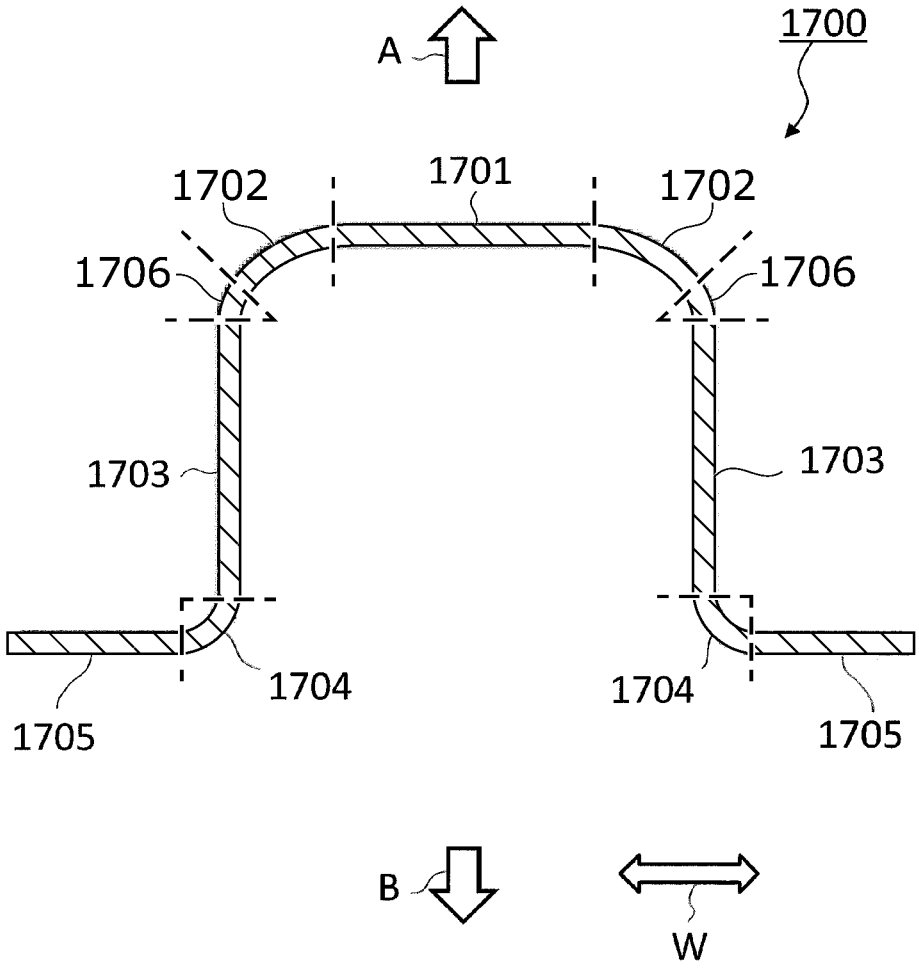
FIG. 32 is a sectional view of a second intermediate formed article 1700 obtained by the second step of the comparative example as seen from the front.

As illustrated in FIG. 32, the second intermediate formed article 1700 has a top plate portion 1701, a pair of loose portions 1702, a pair of punch shoulder bent portions 1706, a pair of standing wall portions 1703, a pair of ridge portions 1704, and a pair of flanges 1705. The top plate portion 1701, the pair of loose portions 1702, the pair of punch shoulder bent portions 1706, and the pair of standing wall portions 1703, are regions that are formed by the flat plate portion 1601 of the first intermediate formed article 1600 being subjected to two steps of bending work. The ridge portions 1704 and the flanges 1705 are regions corresponding to the bent portions 1602 and the flanges 1603 of the first intermediate formed article 1600.

The top plate portion 1701 is a region that extends in the width direction W, and the width thereof is substantially equal to the width of the split die 2120. One of the pair of loose portions 1702 is a region that is continuous with one end portion of the top plate portion 1701 in the width direction, is gently curved toward the lower side in the press direction, and is continuous with one of the pair of punch shoulder bent portions 1706. The other of the pair of loose portions 1702 is a region that is continuous with the other end portion of the top plate portion 1701 in the width direction, is gently curved toward the lower side in the press direction, and is continuous with the other of the pair of punch shoulder bent portions 1706.

One of the pair of punch shoulder bent portions 1706 is a region that is bent by one of the pair of second punch shoulder portions 2040E, an upper end thereof is continuous with one of the pair of loose portions 1702, and a lower end thereof is continuous with one of the pair of standing wall portions 1703. The other of the pair of punch shoulder bent portions 1706 is a region that is bent by the other of the pair of second punch shoulder portions 2040E, an upper end is continuous with the other of the pair of loose portions 1702, and a lower end thereof is continuous with the other of the pair of standing wall portions 1703.

One of the pair of standing wall portions 1703 is a region that extends perpendicularly to the width direction W toward the lower side in the press direction, an upper end thereof is continuous with one of the pair of punch shoulder bent portions 1706, and a lower end thereof is continuous with one of the pair of ridge portions 1704. The other of the pair of standing wall portions 1703 is a region that extends perpendicularly to the width direction W toward the lower side in the press direction, an upper end thereof is continuous with the other of the pair of punch shoulder bent portions 1706, and a lower end thereof is continuous with the other of the pair of ridge portions 1704.

One of the pair of ridge portions 1704 is a region that is continuous with one of the pair of standing wall portions 1703 and is curved toward the outside in the width direction. The other of the pair of ridge portions 1704 is a region that is continuous with the other of the pair of standing wall portions 1703 and is curved toward the outside in the width direction. The pair of ridge portions 1704 has the same inner curvature radius and outer curvature radius as the bent portions 1602 of the first intermediate formed article 1600, respectively. Additionally, the bending angles of the pair of ridge portions 1704 are 90 degrees, respectively.

One of the pair of flanges 1705 is a region that is continuous with one of the pair of ridge portions 1704 and extends toward the outside in the width direction. The other of the pair of flanges 1705 is a region that is continuous with the other of the pair of ridge portions 1704 and extends toward the outside in the width direction (opposite side of one flange 1705).

Third Step of Comparative Example

Figure 33:
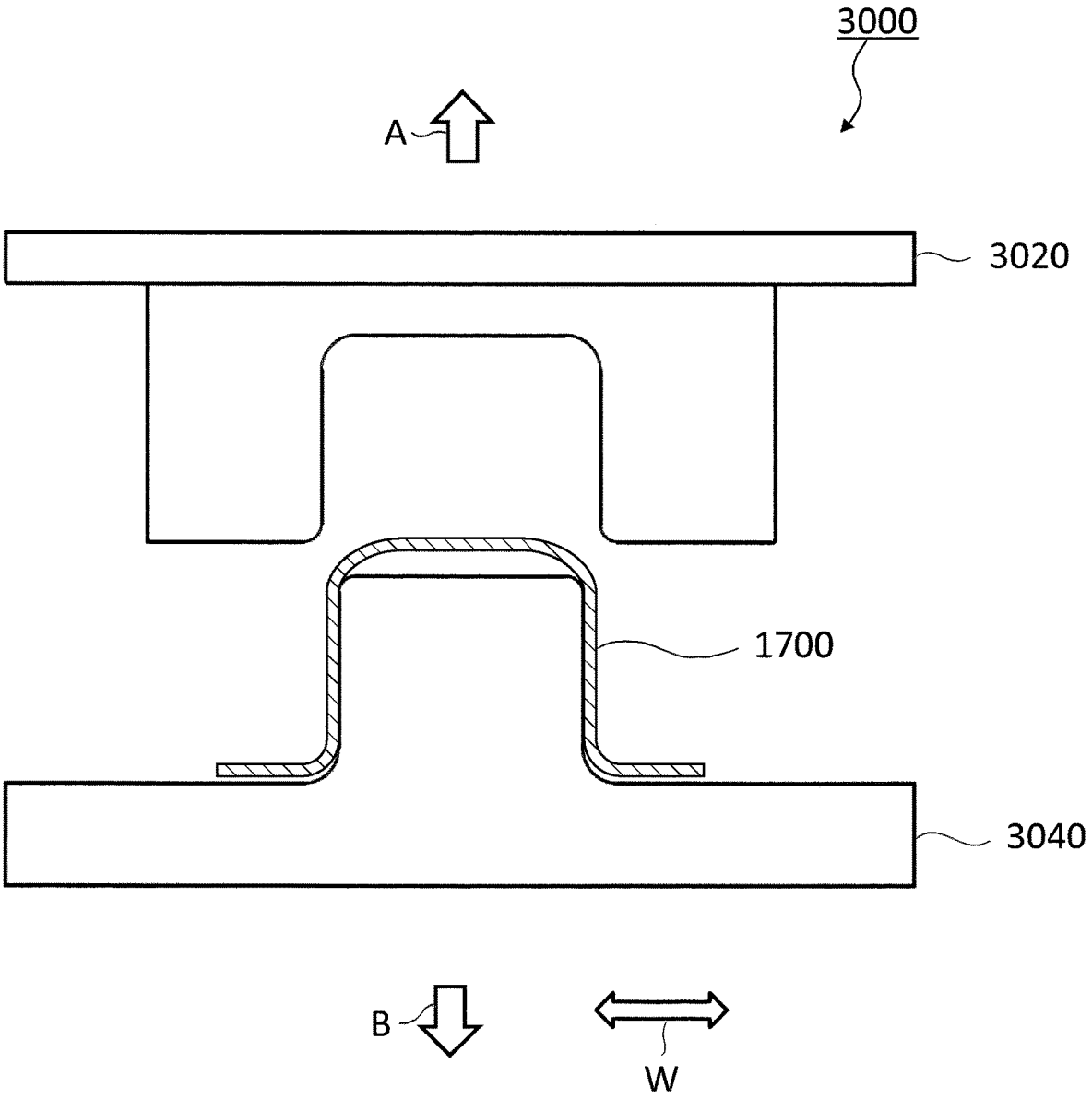
FIG. 33 is a schematic view illustrating a third step (a state before press forming is started) of the comparative example.
Figure 34:
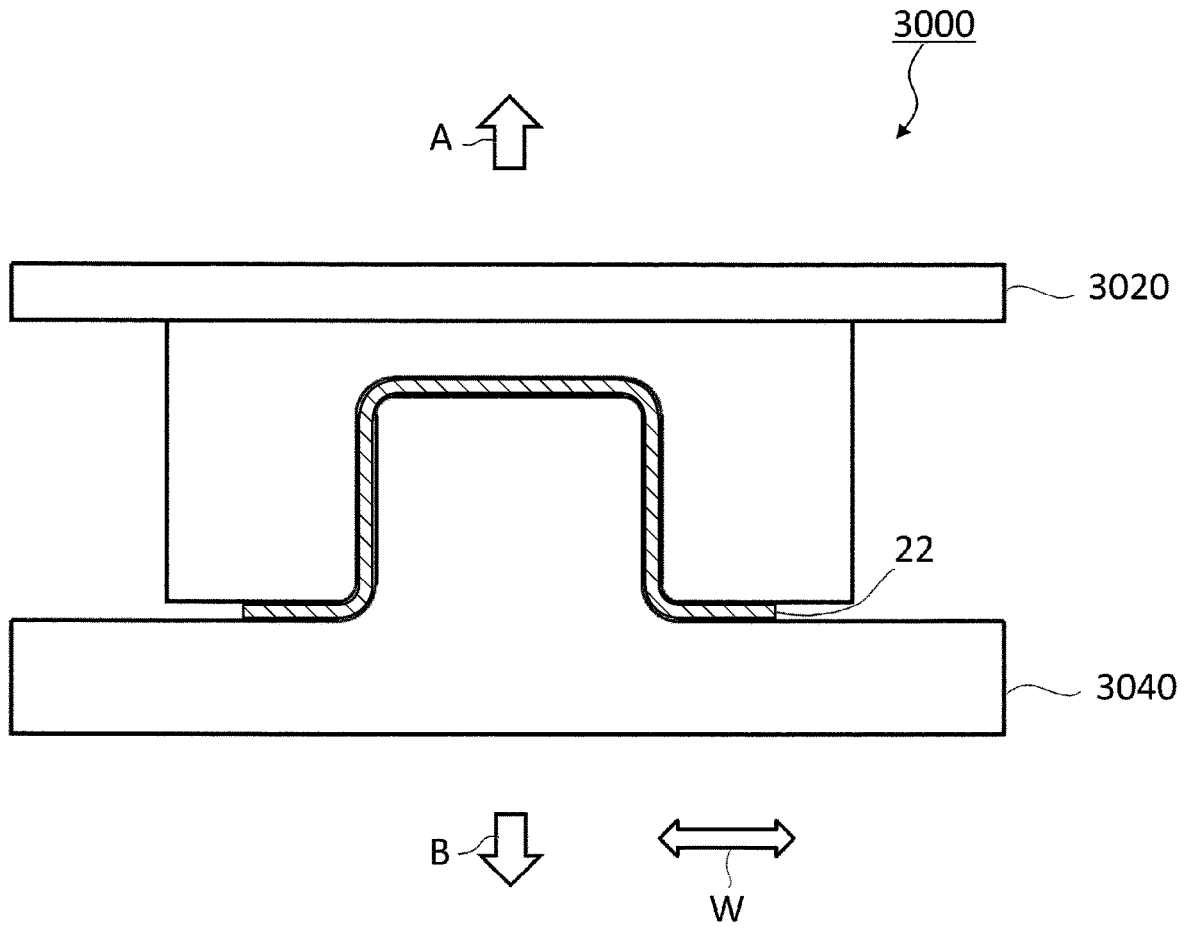
FIG. 34 is a schematic view illustrating the third step (a state when the press forming is completed) of the comparative example.

Subsequently, a third step of the comparative example will be described. FIGS. 33 and 34 are schematic views illustrating the third step of the comparative example. FIG. 33 illustrates a state before press forming is started, and FIG. 34 illustrates a state when the press forming is completed. In the third step of the comparative example, a third pressing apparatus 3000, which forms the press-formed article 22 that is an end product by pressing the second intermediate formed article 1700, is used.

The third pressing apparatus 3000 includes the same configuration as the third pressing apparatus 300 of the present embodiment. That is, the third pressing apparatus 3000 includes a third die 3020 having the same configuration as the third die 302 of the present embodiment, and a third punch 3040 having the same configuration as the third punch 304 of the present embodiment. Therefore, the detailed description of the configuration of the third pressing apparatus 3000 is omitted.

As illustrated in FIG. 33, after the second intermediate formed article 1700 is placed on the third punch 3040, the third die 3020 is lowered toward the third punch 3040. As illustrated in FIG. 34, when the third die 3020 is finally lowered to the bottom dead point, the hat-shaped press-formed article 22, which is an end product is obtained by crushing swelled portions (portions that are formed by the top plate portion 1701 and the pair of loose portions 1702 and are swelled to the upper side in the press direction) of the second intermediate formed article 1700.

FIG. 11 is an enlarged view of an area AR illustrated in FIG. 31.

In the second step of this comparative example, the second die 2020 is pushed into the second punch 2040 side to form a standing wall portion 1703 of the second intermediate formed article 1700 in a state where the first intermediate formed article 1600 is placed on the split die 2120 (convex portion 2160) of the second punch 2040. In this case, the split die 2120 protrudes to the second die 2020 side with respect to the second punch 2040. For this reason, a portion (that is, a loose portion 1702) of the second intermediate formed article 1700 from a shoulder portion 2120A of the split die 2120 to a second punch shoulder portion 2040E is obliquely bent to the lower side B as being closer to the outside of the second pressing apparatus 2000 in the width direction. Accordingly, the loose portion 1702 is curved so as to be convex to the front side of the second intermediate formed article 1700.

Additionally, the length L1 along the loose portion 1702 is longer than a length L2 between the split die 2120 and the second punch shoulder portion 2040E in the width direction W. For this reason, when the second die 2020 is moved from this state to the bottom dead point, a part of a portion (portion a) bent by the second punch shoulder portion 2040E is pushed out to the lower side B and is formed as the standing wall portion 1703. Additionally, in the subsequent third step, a portion (portion b portion) of the loose portion 1702 on the split die 2120 side is crushed and t becomes a part of the top plate 22A of the press-formed article 22.

Figure 12:
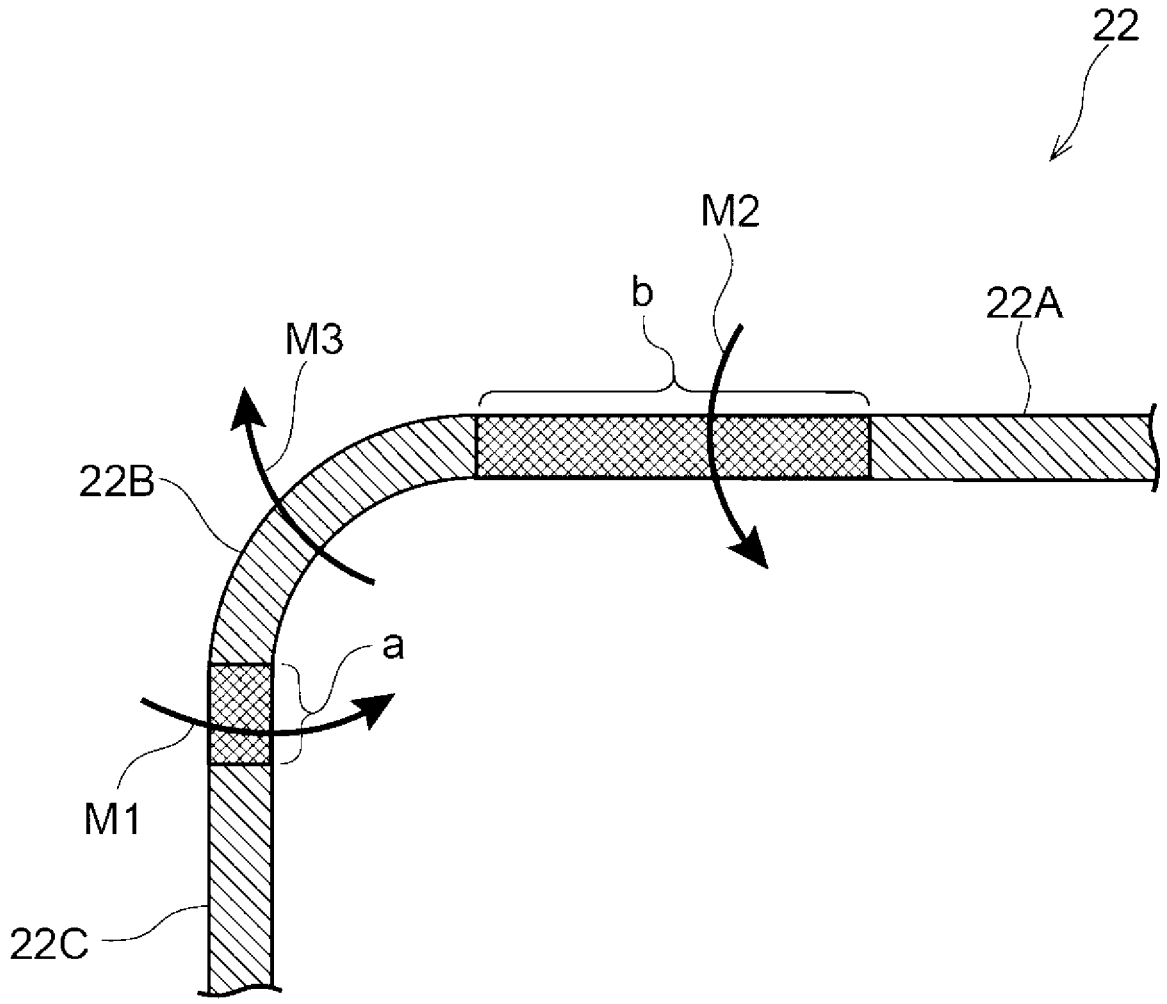
FIG. 12 is a sectional view for illustrating a moment generated around a ridge in the press-formed article.

Accordingly, in the press-formed article 22 of the comparative example, as illustrated in FIG. 12, the above portion a constitutes a base end portion of a standing wall 22C, and the above portion b constitutes each of both the side portions of the top plate 22A in the width direction. Also, as illustrated in FIG. 11, in the second step of a comparative example, after the portion a is bent in an arc shape, which is convex to the outside of the second intermediate formed article 1700, by the second punch shoulder portion 2040E, as illustrated in FIG. 12, in the third step of the comparative example, the portion a is pushed out to the standing wall 22C side and is bent back as the standing wall 22C of the press-formed article 22.

In this case, in the bent-back portion a, a compressive stress is generated outside the press-formed article 22, and a tensile stress is generated inside the press-formed article 22. For this reason, in the portion a of the press-formed article 22 before release, a first moment M1, which faces the inside of the press-formed article 22, is generated.

Additionally, the portion b of the loose portion 1702 is bent back and formed in a flat plate shape as the top plate 22A of the press-formed article 22 after being curved so as to be convex to the outside of the press-formed article 22, that is, the front side of the second intermediate formed article 1700. In this case, in the portion b that is formed in a flat plate shape, a compressive stress is generated outside the press-formed article 22, and a tensile stress is generated inside the press-formed article 22. For this reason, in the portion b of the press-formed article 22 before release, a second moment M2, which faces the inside of the press-formed article 22, is generated.

Moreover, a ridge portion 22B formed between the portion a and the portion b of the press-formed article 22 is bent in an arc shape, which is convex to the outside of the press-formed article 22, by the second punch shoulder portion 2040E. In the ridge portion 22B, a tensile stress is generated outside the press-formed article 22 and a compressive stress is generated inside the press-formed article 22. For this reason, a third moment M3, which faces the outside of the press-formed article 22, is generated in the ridge portion 22B of the press-formed article 22 before release.

On the other hand, in the present embodiment, in the first, first step 12, the first intermediate formed article 14, which has a bent portion 14B that is bent to one side in the plate thickness direction (refer to FIG. 26), is formed. Accordingly, when the first intermediate formed article 14 is pressed into the second intermediate formed article 18 in the subsequent second step 16, an inclined wall 18C in which the curved deformation is suppressed can be formed between a bent portion 18B that is similarly bent to one side in the plate thickness direction and a punch shoulder bent portion 18D. In other words, in the second intermediate formed article 18 of the present embodiment, a curved region, which is equivalent to the loose portion 1702 formed in the second intermediate formed article 1700 of the comparative example is not formed between the bent portion 18B and the punch shoulder bent portions 18D. For this reason, in the final third step 20, when the press-formed article 22 is obtained by pressing the second intermediate formed article 18, the generation of the aforementioned second moment M2 is suppressed in the press-formed article 22 that is an end product. As a result, management of the dimensional accuracy of the standing wall 22C of the press-formed article 22 becomes easy.

Figure 13:
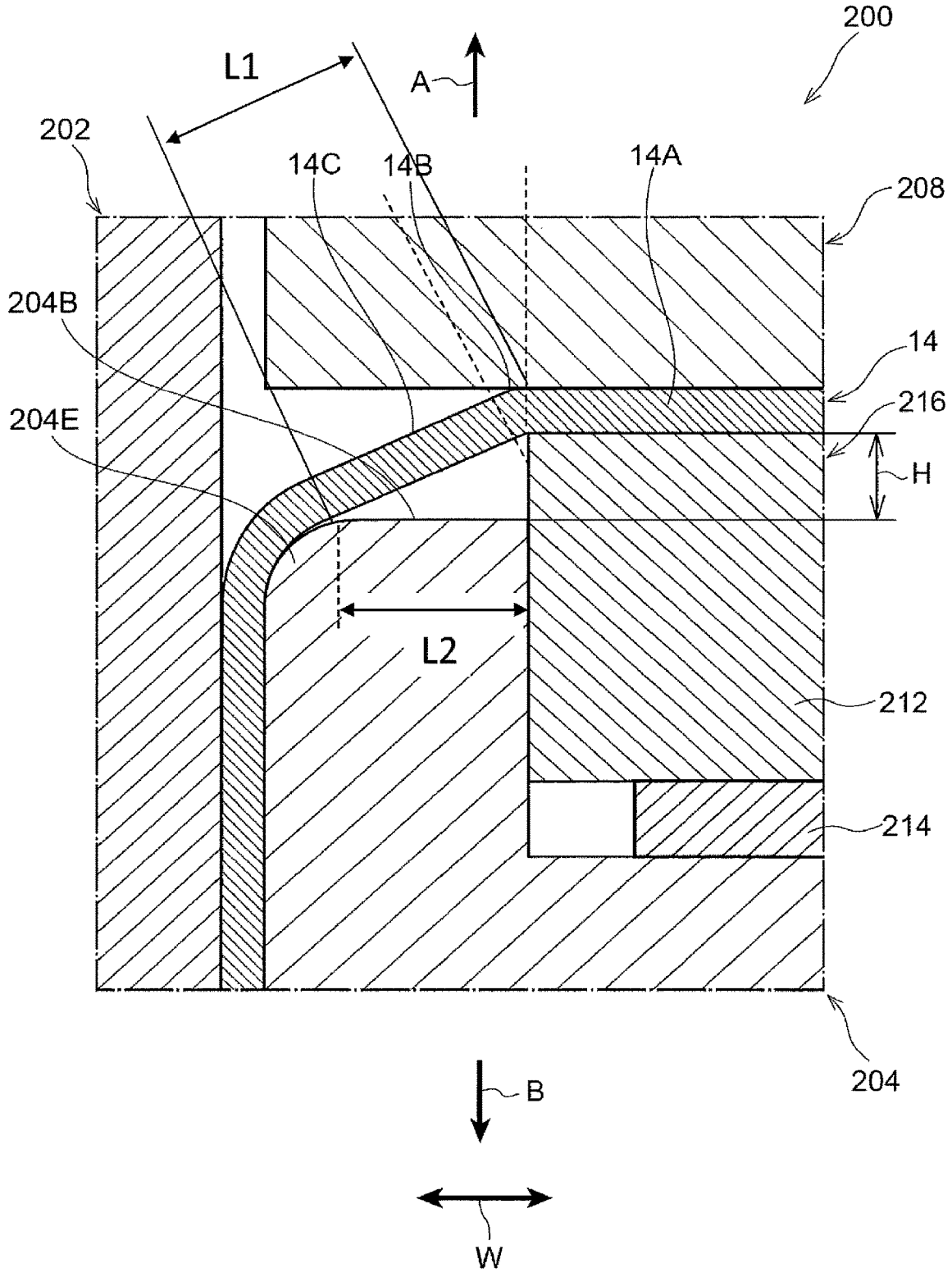
FIG. 13 is a sectional view equivalent to essential portions of FIG. 8.

Specifically, as illustrated in FIG. 13, the bent portion 14B, which is bent to one side in the plate thickness direction, is formed at an intermediate portion of the first intermediate formed article 14 in the width direction, and the inclined wall 14C of the first intermediate formed article 14 corresponding to the above loose portion 1702 is bent in advance to a second punch shoulder portion 204E side of the second pressing apparatus 200. Accordingly, compared to the above comparative example (refer to FIG. 11), the inclined wall 14C of the first intermediate formed article 14 approaches the second punch shoulder portion 204E. Additionally, as illustrated in FIG. 13, in the length L1 including the bent portion 14B and the inclined wall 14C, the length of the bent portion 14B is extremely small.

For this reason, when the second die 202 is pushed to the second punch 204 side to form a standing wall portion 18E of the second intermediate formed article 18, convexly curved deformation of the portion of the inclined wall 14C corresponding to the loose portion 1702 to the front side of the inclined wall 14C is suppressed.

Accordingly, in the press-formed article 22 formed using this second intermediate formed article 18, in the above-described portion b, the generation of the second moment M2 is suppressed and the influence of the second moment on the standing wall 22C of the press-formed article 22 can be suppressed.

For this reason, a change in the opening amount (position), in the width direction, of the standing wall 22C that appears sensitively with respect to a change in the protruding amount H of the convex portion 216 from the second punch 204 can be made small, the allowable range of the protruding amount H of the convex portion 216 can be expanded.

In other words, by suppressing the second moment M2, the moment of the press-formed article 22 can be limited mainly to the first moment M1 that faces outward at the base end portion of the standing wall 22C and the third moment M3 that faces outward at the ridge portion 22B.

For this reason, the third moment M3 can be offset mainly by only the first moment M1, and the opening amount (position) of the standing wall 22C in the width direction W can be adjusted. Thus, management of the dimensional accuracy of the standing wall 22C of the press-formed article 22 becomes easy.

Hence, regarding the protruding amount H of the convex portion 216 protruding from the second punch 204, the allowable range for maintaining the dimensional accuracy of the press-formed article 22 can be expanded.

Additionally, since the allowable range of the protruding amount H of the convex portion 216 is expanded, adjustment of the protruding amount H adapted to the strength of material metal becomes easy.

Additionally, after the inclined wall 18C (extra line portion) is formed between the bent portion 18B and the punch shoulder bent portion 18D by forming the second intermediate formed article 18 from the first intermediate formed article 14 by the second pressing apparatus 200, the inclined wall 18C (extra line portion) is crushed by forming the press-formed article 22 from the second intermediate formed article 18 by using the third pressing apparatus 300. For this reason, since it is not necessary to crush the inclined wall 18C (extra line portion) by the second pressing apparatus 200, the punch-side pad of the second punch 204 can be eliminated in the second pressing apparatus 200. Additionally, in the third pressing apparatus 300, it is only necessary to crush the inclined wall 18C (extra line portion) of the second intermediate formed article 18. Therefore, also in the third pressing apparatus 300, the punch-side pad of the third punch 304 is unnecessary.

Hence, compared to a case where the second pressing apparatus 200 and the third pressing apparatus 300 are used as one pressing apparatus and the punch-side pad is provided in the second punch 204 of the second pressing apparatus 200, the second pressing apparatus 200 and the third pressing apparatus 300 can be simplified, and the press line 24 can be configured by the combination of the simplified pressing apparatuses.

Additionally, the convex portion 216 of the second punch 204 is constituted of the split die 212 split from the second punch body 204D. For this reason, the press-formed article 22 having a different product shape can be formed by changing the split die 212 to one in which the shape of the convex portion top surface 216A is different.

Also, the spacer 214 is disposed between the split die 212 and the second punch body 204D in the press direction. For this reason, the protruding amount of the convex portion 216 from the second punch top surface 204B can be changed by changing the spacer 214 to one having a different height.

(Comparative Test)

A comparative test will be described using FIGS. 14 and 15.

Figure 14:
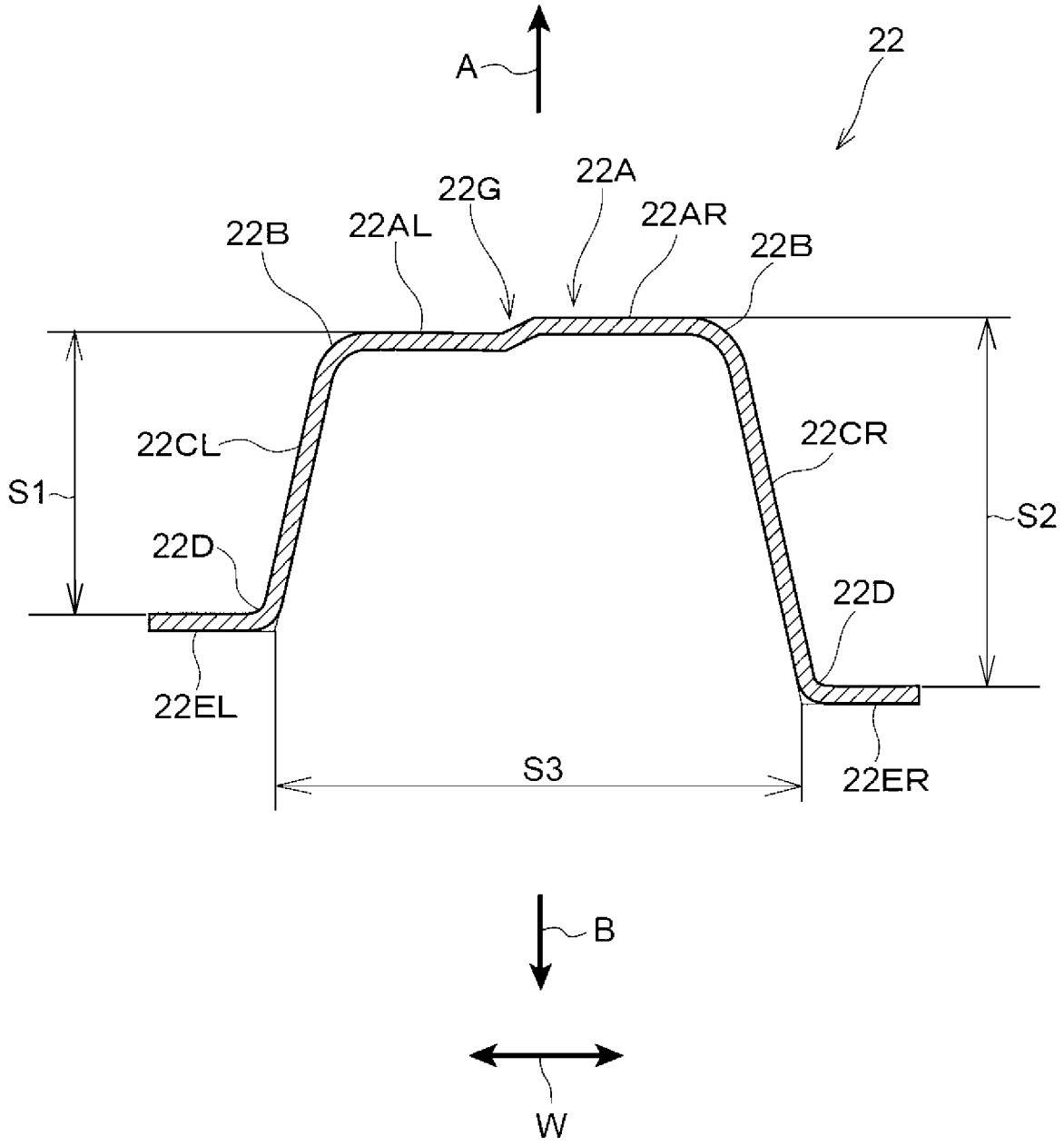
FIG. 14 is the sectional view of a press-formed article formed in a comparative test as seen from the front.

In this comparative test, the experimental results when the press-formed article 22 having the shape illustrated in FIG. 14 is formed by the manufacturing methods of the comparative example and the first embodiment are compared with each other. A relationship between swelling amount applied to the top plate 22A in a forming step and opening amount on one side of a standing wall of the press-formed article 22 is illustrated in a graph illustrated in FIG. 15. The opening means that the standing wall 22C falls inward or outward with respect to the normal shape of the press-formed article 22.

First, the press-formed article 22 to be formed will be described with reference using FIG. 14. The press-formed article 22 is different from the press-formed article 22 illustrated in the first embodiment in the shape of the top plate 22A, and the height of the standing wall 22C that extends from the top plate 22A to the lower side B.

The tensile strength of the press-formed article 22 to be formed is 1180 MPa, and the plate thickness thereof is 1.4 mm. A stepped part 22G is formed on a part of the top plate 22A, and a level difference is provided between a first top plate portion 22AL on one side with the stepped part 22G as a boundary, and a second top plate portion 22AR on the other side.

A dimension S1 from the surface of the first top plate portion 22AL on the upper side A to the surface of a first flange 22EL on the upper side A is 50 mm, and a dimension S2 from the surface of the second top plate portion 22AR on the upper side A to the surface of a flange 22ER on the upper side A is 75 mm. A separation distance S3 between an end portion of a first standing wall 22CL on the lower side B and an end portion of a second standing wall 22CR lower side B is 140 mm.

In this comparative test, in the press-formed article 22 taken out (released) from the die and punch after forming, an opening amount indicating a displacement in the width direction W as compared with the normal-shaped press-formed article 22 is measured at an R stop that is a boundary between the standing wall 22CR and a curved ridge portion 22D. This measurement is performed at the higher standing wall 22CR in which the influence on the opening caused by a change in angle with the top plate 22A is significant.

In the manufacturing method of the first embodiment, the second intermediate formed article 18 is formed from the first intermediate formed article 14 with the protruding amount H of the convex portion 216 from the punch top surface 204B of the second pressing apparatus 200 as a first set value and a second set value larger than the first set value. Then, the press-formed article 22 is formed using the second intermediate formed article 18, and the opening amount in each protruding amount H is measured and recorded. In addition, the swelling amount applied to the top plate 22A is determined depending on the protruding amount H of the convex portion 216.

Additionally, in the manufacturing method of the comparative example, the second intermediate formed article 1700 is formed from the first intermediate formed article 1600 with the protruding amount H of the convex portion 2160 from a second punch top surface 2040B of the second pressing apparatus 2000 (refer to FIG. 11) as the first set value and a third set value between the first set value and the second set value. Also, the press-formed article 22 is formed using the second intermediate formed article 1700, and the opening amount in each protruding amount H is measured and recorded. In addition, the swelling amount applied to the top plate 22A is determined by the protruding amount H of the convex portion 2160 of the second punch 2040.

Next, a graph illustrated in FIG. 15 will be described. In this graph, a horizontal axis represents the swelling amount applied to the top plate 22A, that is, the protruding amount H. Additionally, a vertical axis represents the position deviation amount (displacement) of one standing wall 22CR of the press-formed article 22 in the width direction with respect to the normal shape of the front end section as the opening amount.

In addition, a plus side of the vertical axis indicates that the standing wall 22CR after release is located on the outer side in the width direction with respect to the normal shape (position), and a minus side of the vertical axis indicates that the standing wall 22CR after release is located on the inner side in the width direction with respect to the normal shape (position).

Moreover, in this graph, a region illustrated by a dot indicates an area within a tolerance with respect to the normal shape of the standing wall 22CR.

Figure 15:
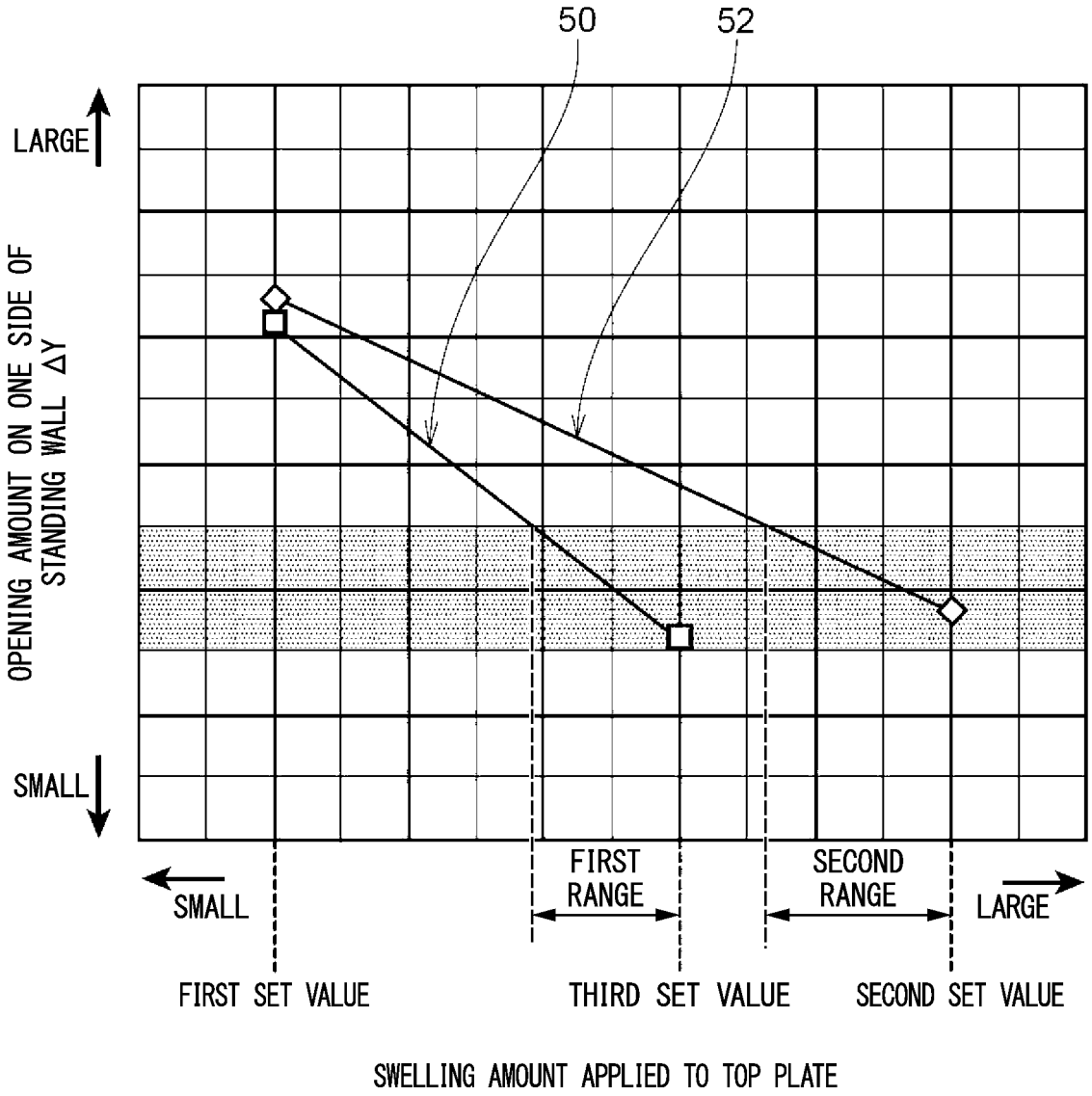
FIG. 15 is a diagram illustrating the opening amount on one side of a standing wall with respect to the swelling amount applied to a top plate.

As illustrated in FIG. 15, in the press-formed article 22 formed by the manufacturing method of the comparative example 50, the inclination of the graph showing the relationship between the swelling amount applied to the top plate 22A and the opening amount on one side of the standing wall is relatively large. Also, in the comparative example, in order to form the standing wall 22CR within the tolerance of the normal shape, it is necessary to set the protruding amount H as a first range, the allowable range of the protruding amount H become the first range in terms of manufacturing. That is, in the comparative example, in the second pressing apparatus 2000, it is necessary to adjust the position of the convex portion 2160 with respect to the second punch top surface 2040B to be within the first range of the allowable protruding amount H to manufacture the press-formed article 22.

In contrast, in the first embodiment 52, the inclination of the graph indicating the relationship between the swelling amount applied to the top plate 22A and the opening amount on one side of the standing wall becomes small compared to the comparative example 50.

Also, in the first embodiment 52, the protruding amount H for forming the standing wall 22CR within the tolerance of the normal shape is in a second range wider than the first range, and the allowable range of the protruding amount H is expanded to a second range in terms of manufacturing.

Hence, according to the press-formed article manufacturing method of the first embodiment, the allowable range (a difference between an upper limit value and a lower limit value) of the protruding amount H of the convex portion 216 from the punch top surface 204B, for settling the standing wall 22CR after forming within the tolerance of the normal shape in the width direction by the combination of the pressing apparatuses simplified without including the punch-side pad, can be expanded. Moreover, in the second pressing apparatus 200, since the adjustment range of the convex portion 216 can be expanded, it is possible to contribute to productivity improvement for the press-formed article 22.

Second Embodiment

Figure 16:
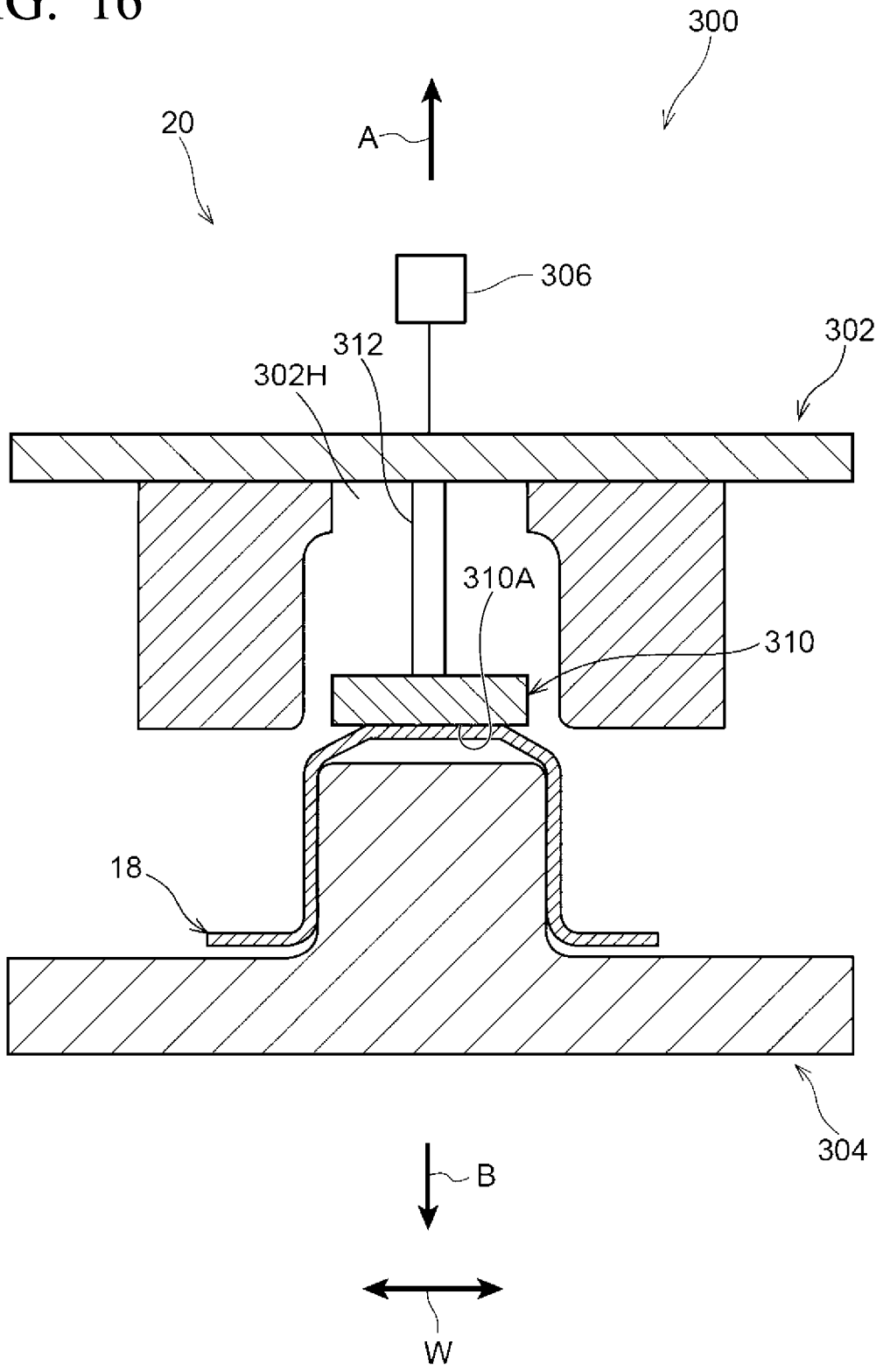
FIG. 16 is a sectional view, seen from the front of the third pressing apparatus, illustrating the third step of pressing the second intermediate formed article by the third pressing apparatus related to a second embodiment of the invention, to manufacture the press-formed article.
Figure 17:
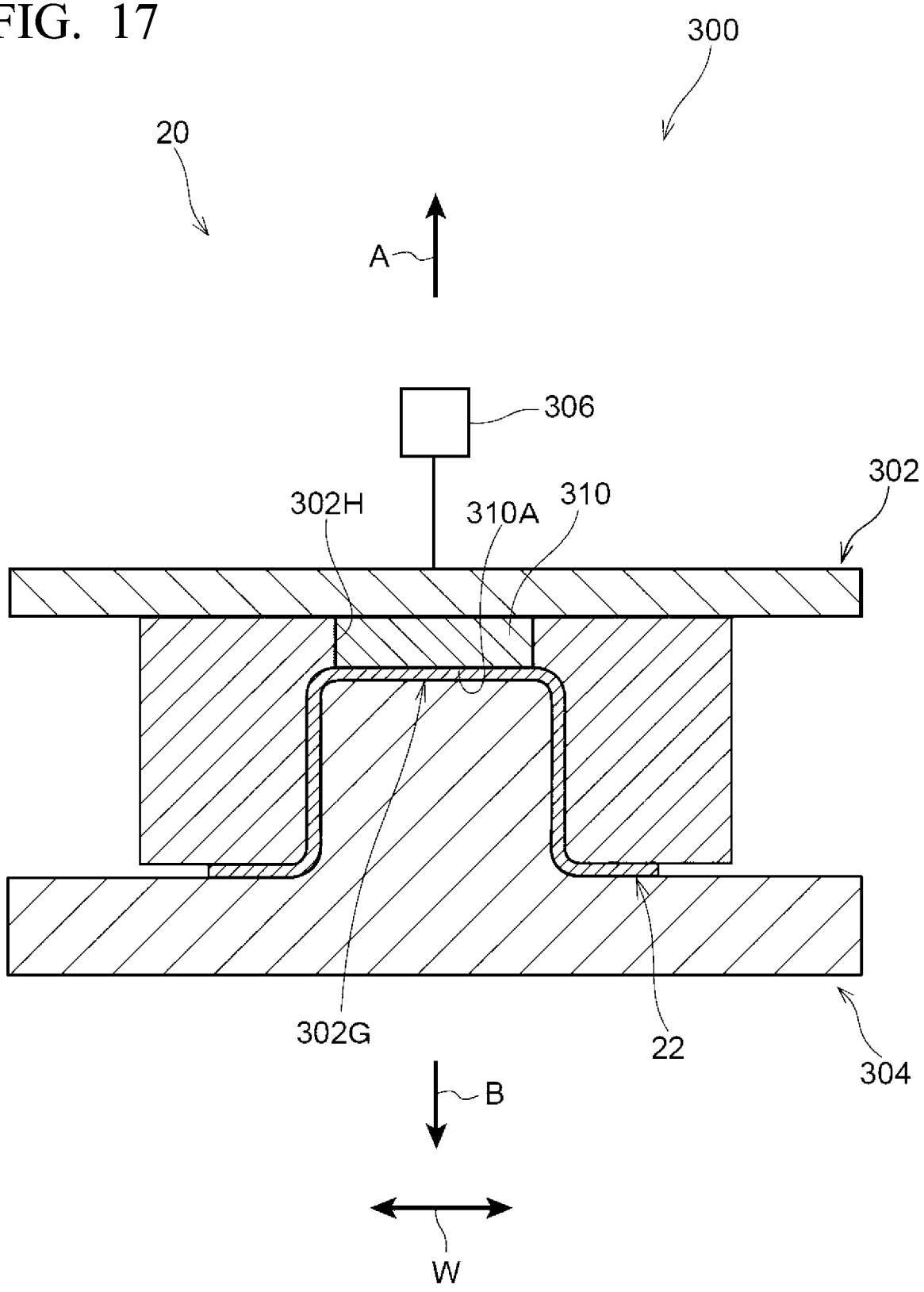
FIG. 17 is a sectional view, seen from the front of the third pressing apparatus, illustrating the third step subsequent to FIG. 16.

FIGS. 16 and 17 are views illustrating a second embodiment of the invention, and the same or equivalent portions as those of the first embodiment will be designated by the same reference signs and will be described, or different portions will be described. The second embodiment is different from the first embodiment in that the third pressing apparatus 300 used in the third step 20 is different, and only the third pressing apparatus 300 will be described.

That is, the third die 302 of the third pressing apparatus 300 includes a third die pad 310 as illustrated in FIG. 16, and a third die bottom 302G of the third die 302 is configured to include the third die pad 310 as illustrated in FIG. 17.

The third die pad 310 is coupled to the third die 302 by the third pad pressing device 312 as illustrated in FIG. 16, and the third pad pressing device 312 includes, for example, a gas cushion, a hydraulic device, a spring, an electric drive device, or the like. The third pad pressing device 312 moves the third die pad 310 relative to the third die 302 in the device upward-downward direction that is the press direction. At the bottom dead point where the third die 302 approaches the third punch 304 most, the third die pad 310 is housed in a third pad housing portion 302H of the third die 302 as illustrated in FIG. 17.

Also in the second embodiment, the same working effects as those of the first embodiment can be obtained.

Third Embodiment

Figure 18:
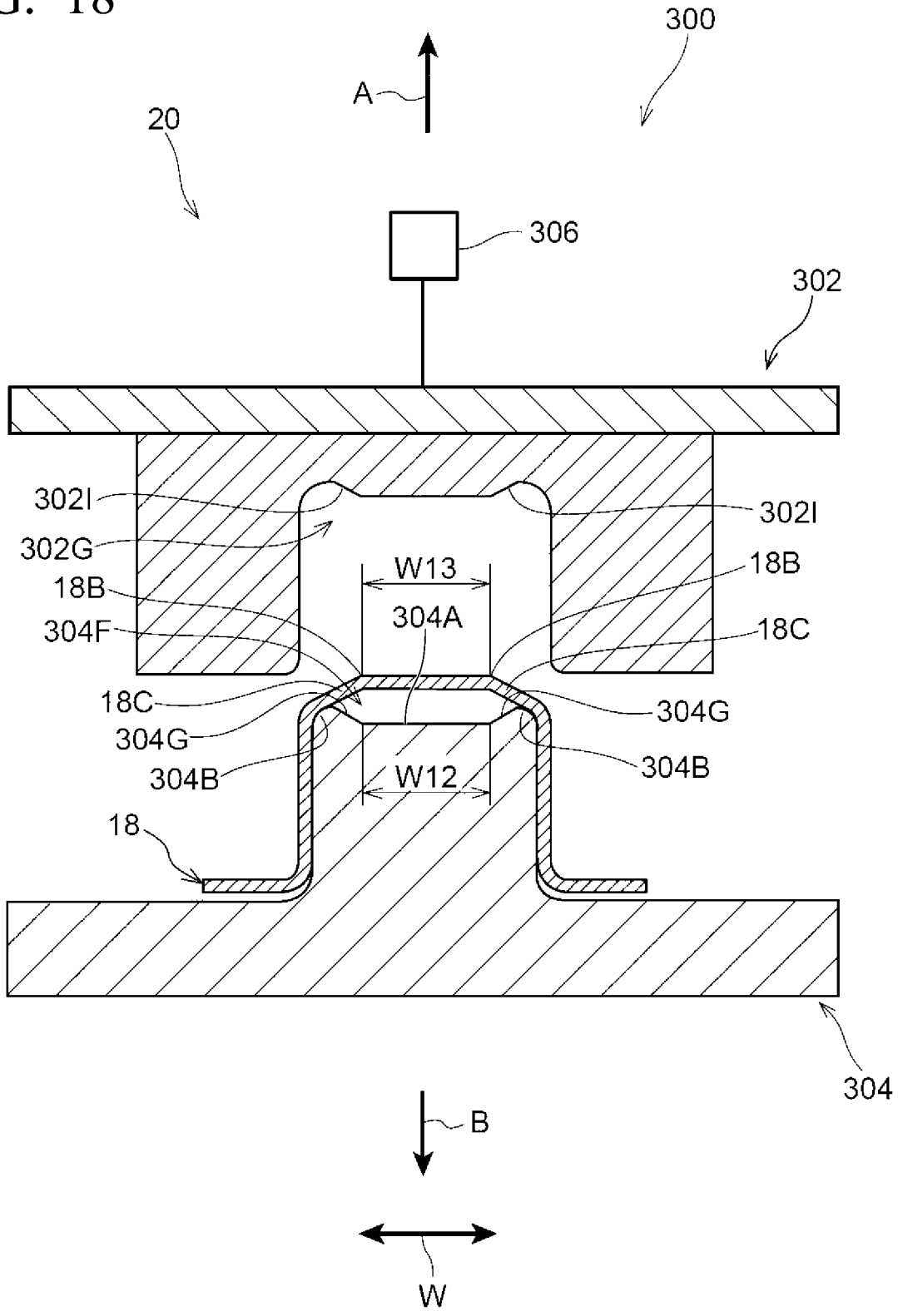
FIG. 18 is a sectional view, seen from the front of the third pressing apparatus, illustrating the third step of pressing the second intermediate formed article by the third pressing apparatus related to a third embodiment of the invention, to manufacture the press-formed article.
Figure 19:
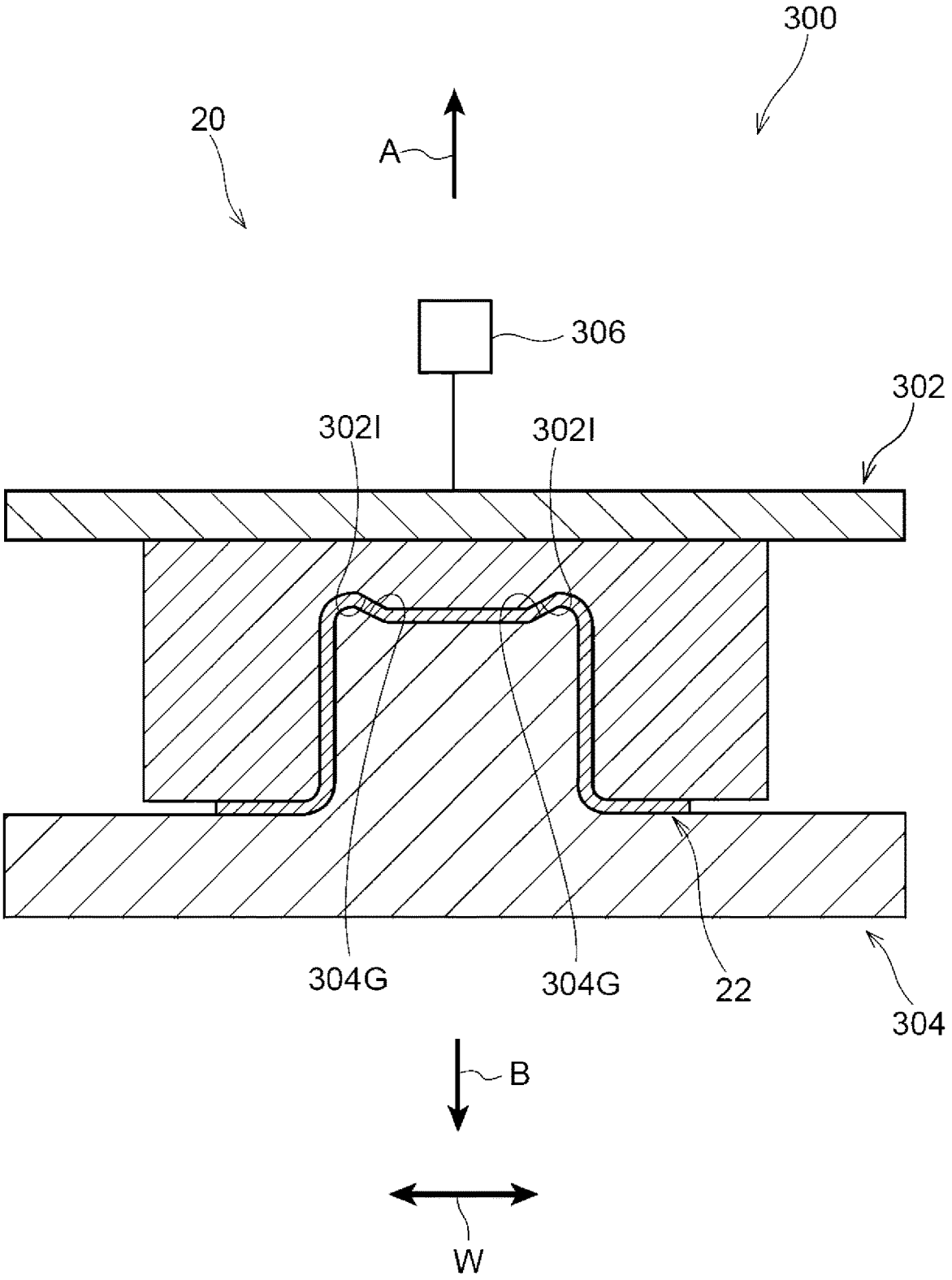
FIG. 19 is a sectional view, seen from the front of the third pressing apparatus, illustrating the third step subsequent to FIG. 18.

FIGS. 18 and 19 are views illustrating a third embodiment of the invention, and the same or equivalent portions as those of the first embodiment will be designated by the same reference signs and will be described, or only different portions will be described. The third embodiment is different from the first embodiment in that the third pressing apparatus 300 used in the third step 20 is different, and only the third pressing apparatus 300 will be described.

As illustrated in FIG. 18, a punch-side inclined surface 304G, which is recessed as being closer to a central side of the third punch 304 in the width direction from the third punch shoulder portion 304B, is formed in the third punch top surface 304A that constitutes a third punch top portion of the third punch 304 in the third pressing apparatus 300.

The punch-side inclined surface 304G is formed in each of a pair of the third punch shoulder portions 304B. Although the punch-side inclined surfaces 304G are provided the third punch shoulder portions 304B on both sides, the punch-side inclined surface 304G may be provided only on one third punch shoulder portion 304B side.

A spacing W12 between end portions of both the punch-side inclined surfaces 304G on the central side of the third punch 304 in the width direction is equal to the width W4 of the first punch top surface 104A indicating the spacing between the first punch shoulder portions 104B in the first punch 104 of the first pressing apparatus 100. Moreover, the distance from a first punch shoulder portion 104B from the center of the first punch in the width direction, and the distance from the center of the third punch 304 in the width direction to an end portion of a punch-side inclined surface 304G on the center portion side in the width direction are equal to each other. Accordingly, the position of the end portion of the punch-side inclined surface 304G on the center portion side in the width direction and the position of the bent portion 18B are aligned with each other in the width direction.

Die-side inclined surfaces 3021, which are corresponding to the punch-side inclined surfaces 304G and parallel to the punch-side inclined surfaces 304G, are formed at the third die bottom 302G of the third die 302 that faces the third punch top portion 304F.

Also in the third embodiment, the same working effects as those of the first embodiment can be obtained.

Additionally, the inclined walls 18C of the second intermediate formed article 18 can be bent back at the bottom dead point where the third die 302 approaches the third punch 304 most. Accordingly, even in a case where the second intermediate formed article 18 formed with the bent portions 18B are formed of a high strength steel sheet, the top plate 22A of the press-formed article 22 can be made flat.

Moreover, in the third step 20, the bent portions 18B of the second intermediate formed article 18 are bent back to the rear surface side of the top plate 18A by the punch-side inclined surfaces 304G, respectively, and the bending tendency of the bent portions 18B can be removed.

Accordingly, when the top plate 22A forms the flat press-formed article 22, the top plate 22A of the press-formed article 22 formed using the second intermediate formed article 18 can be effectively flattened.

Fourth Embodiment

Figure 20:
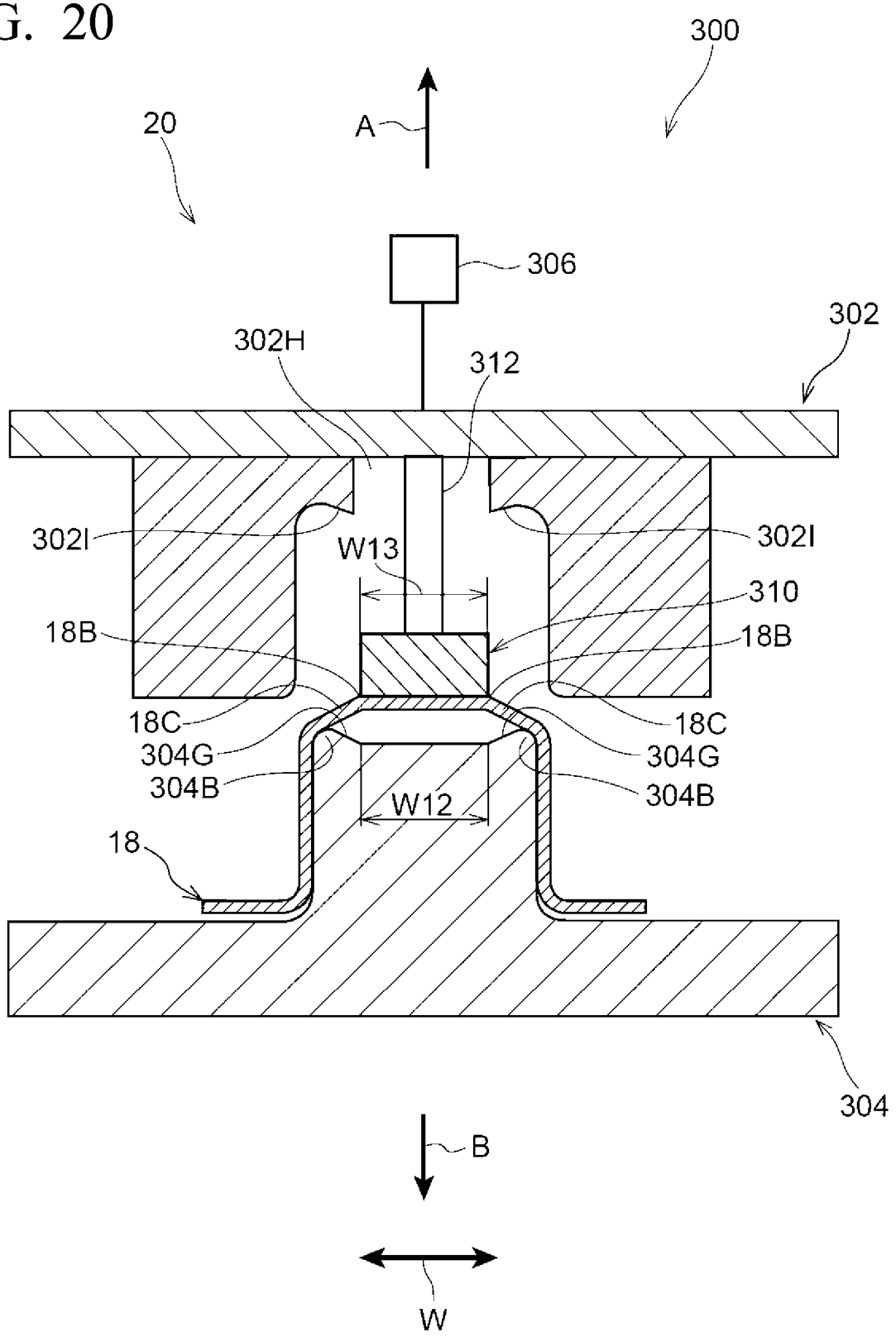
FIG. 20 is a sectional view, seen from the front of the third pressing apparatus, illustrating the third step of pressing the second intermediate formed article by the third pressing apparatus related to a fourth embodiment of the invention, to manufacture the press-formed article.
Figure 21:
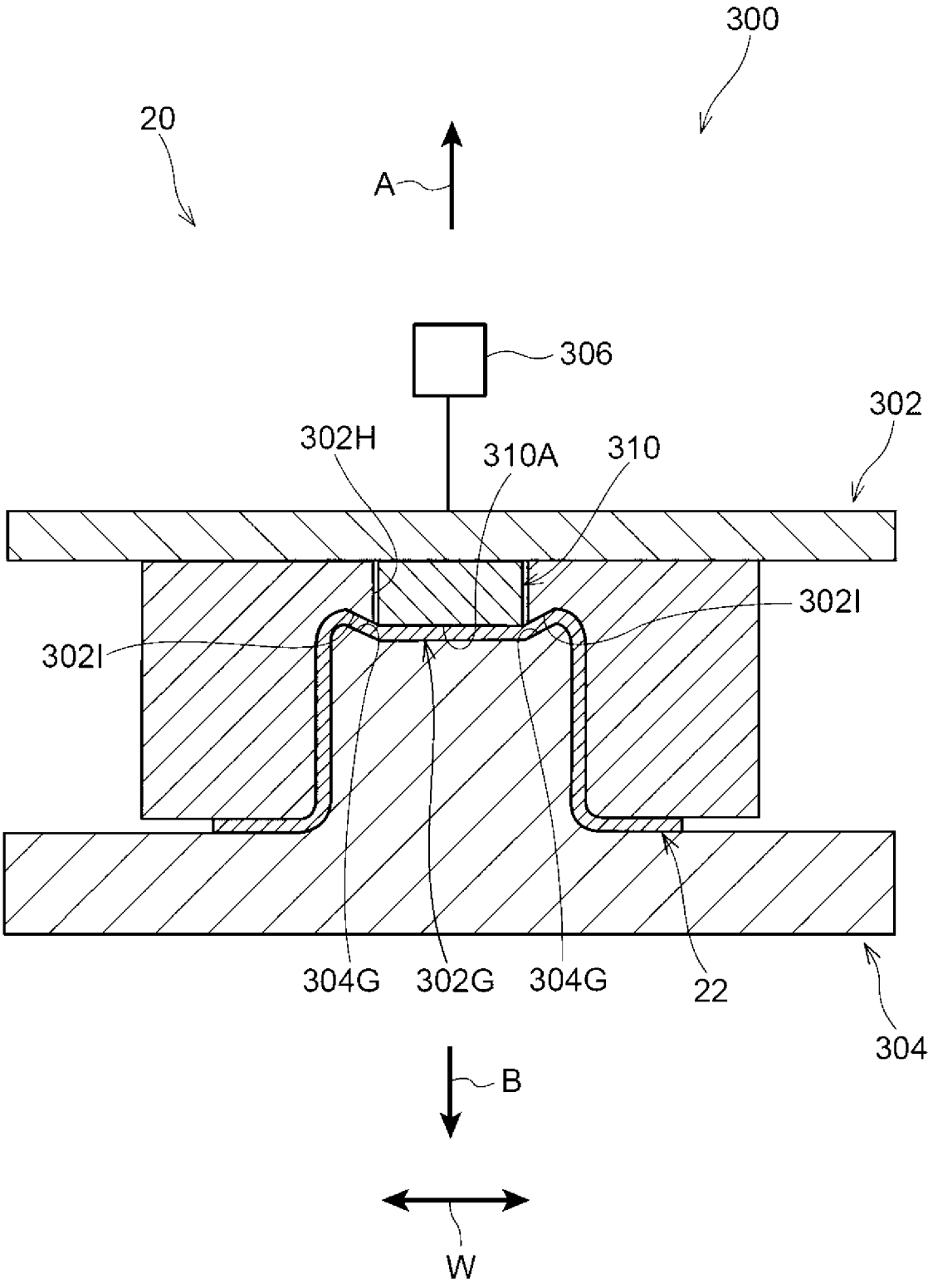
FIG. 21 is a sectional view, seen from the front of the third pressing apparatus, illustrating the third step subsequent to FIG. 20.

FIGS. 20 and 21 are views illustrating a fourth embodiment of the invention, and the same or equivalent portions as those of the first embodiment and the third embodiment will be designated by the same reference signs and will be described, or only different portions will be described. The fourth embodiment is different from the third embodiment in that the third pressing apparatus 300 used in the third step 20 is different, and only the third pressing apparatus 300 will be described.

The third die 302 of the third pressing apparatus 300 includes a third die pad 310 as illustrated in FIG. 20, and a third die bottom 302G of the third die 302 is configured to include the third die pad 310 as illustrated in FIG. 21.

A width W13 of the third die pad 310 is equal to the spacing W12 between the end portions of the respective punch-side inclined surfaces 304G and the width W4 of the first punch top surface 104A indicating the spacing between the first punch shoulder portions 104B in the first punch 104 of the first pressing apparatus 100. Moreover, the positions of the end portions of the third die pad 310, the positions of the end portions of the punch-side inclined surfaces 304G on the center portion in the width direction, and the positions of the bent portions 18B are aligned with each other the width direction.

Also in the fourth embodiment, the same working effects as those of the first embodiment and the third embodiment can be obtained.

Fifth Embodiment

Figure 22:
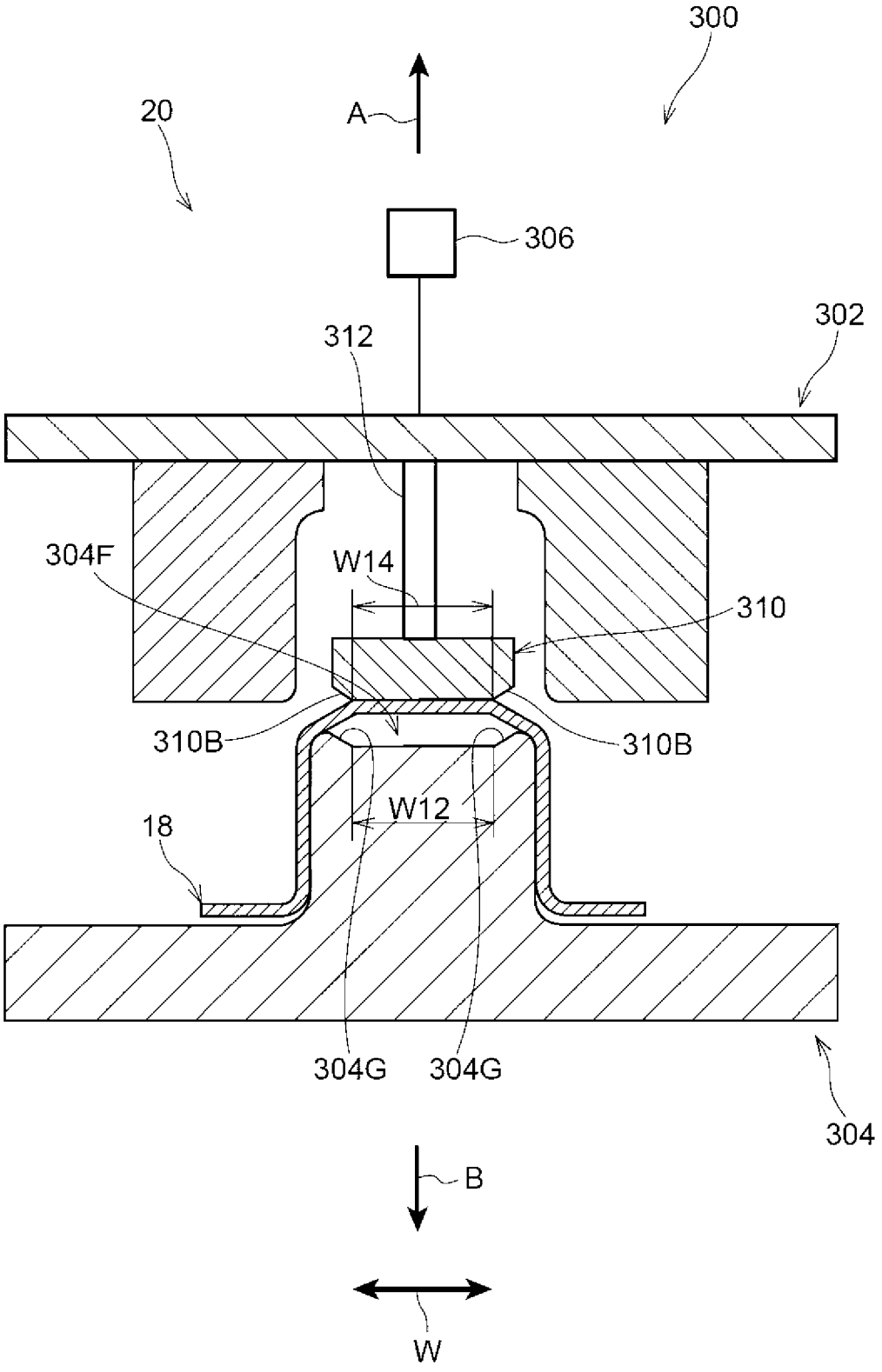
FIG. 22 is a sectional view, seen from the front of the third pressing apparatus, illustrating the third step of pressing the second intermediate formed article by the third pressing apparatus related to a fifth embodiment of the invention, to manufacture the press-formed article.
Figure 23:
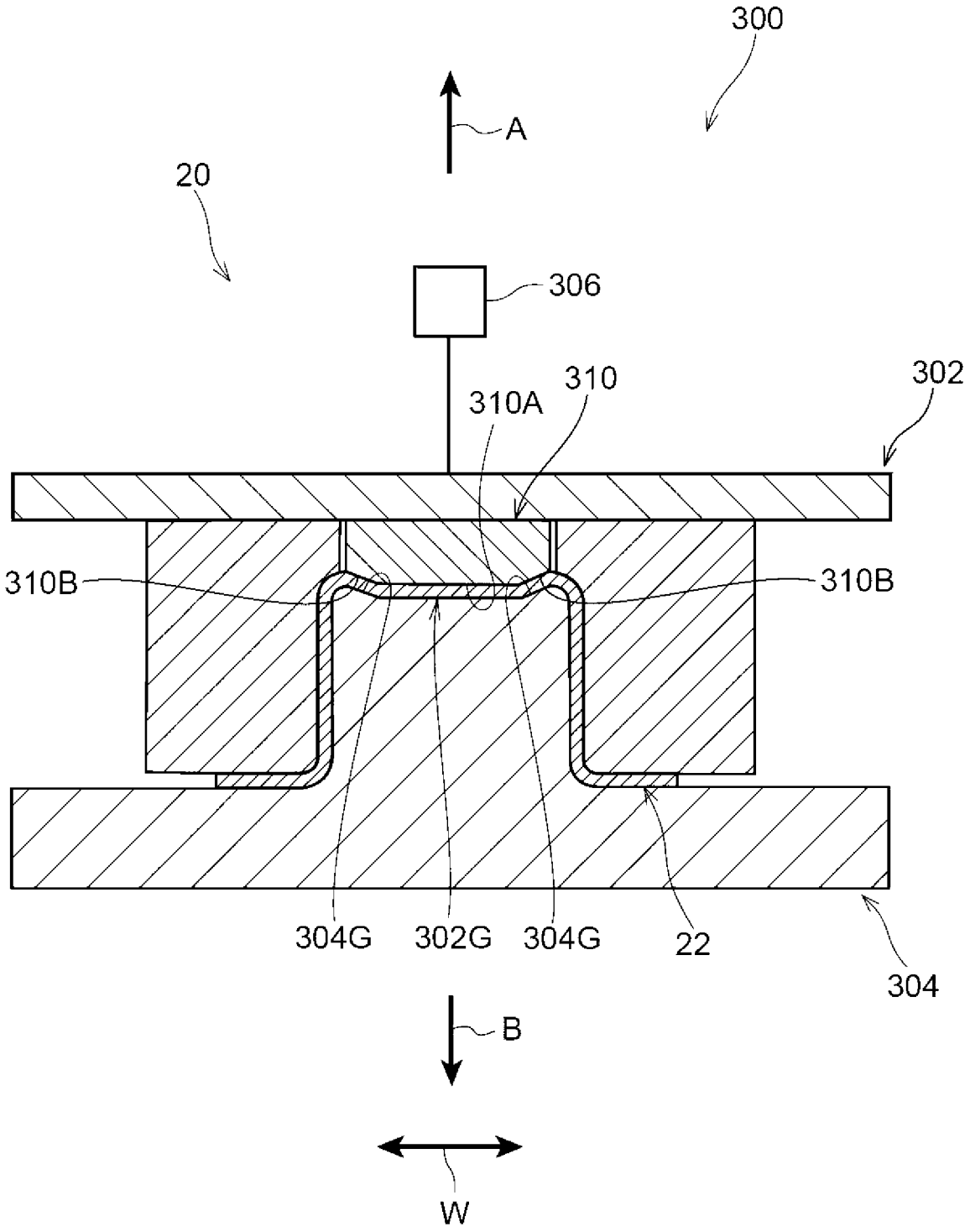
FIG. 23 is a sectional view, seen from the front of the third pressing apparatus, illustrating the third step subsequent to FIG. 22.

FIGS. 22 and 23 are views illustrating a fifth embodiment of the invention, and the same or equivalent portions as those of the aforementioned other embodiments will be designated by the same reference signs and will be described, or only different portions will be described. The fifth embodiment is different from the other embodiments in that the third pressing apparatus 300 used in the third step 20 is different, and only the third pressing apparatus 300 will be described.

That is, the third die 302 of the third pressing apparatus 300 includes a third die pad 310 as illustrated in FIG. 22, and a third die bottom 302G of the third die 302 is configured to include the third die pad 310 as illustrated in FIG. 23.

Die-pad-side inclined surfaces 310B serving as die-side inclined surfaces are formed at a third die pad lower surface 310A of the third die pad 310 that faces the third punch top portion 304F and constitutes the third die bottom 302G. The die-pad-side inclined surfaces 310B correspond to the punch-side inclined surfaces 304G and are parallel to the punch-side inclined surfaces 304G.

A spacing W14 between end portions of the pair of die-pad-side inclined surfaces 310B on the central side of the third die pad 310 in the width direction, and the spacing W12 between the end portions of the pair of punch-side inclined surfaces 304G on the central side of the third punch 304 in the width direction are equal to each other. Additionally, the spacing W14 between the end portions of the pair of die-pad-side inclined surfaces 310B on the central side of the third die pad 310 in the width direction, and the width W4 of the first punch top surface 104A indicating the spacing between the first punch shoulder portions 104B in the first punch 104 of the first pressing apparatus 100 are equal to each other. Moreover, the positions of end portions of the third die pad lower surface 310A, the positions of the end portions of the punch-side inclined surfaces 304G on the center portion side in the width direction, and the position of the bent portions 18B are aligned with each other in the width direction.

Also in the fifth embodiment, the same working effects as the aforementioned other embodiments can be obtained.

Sixth Embodiment

Figure 24:
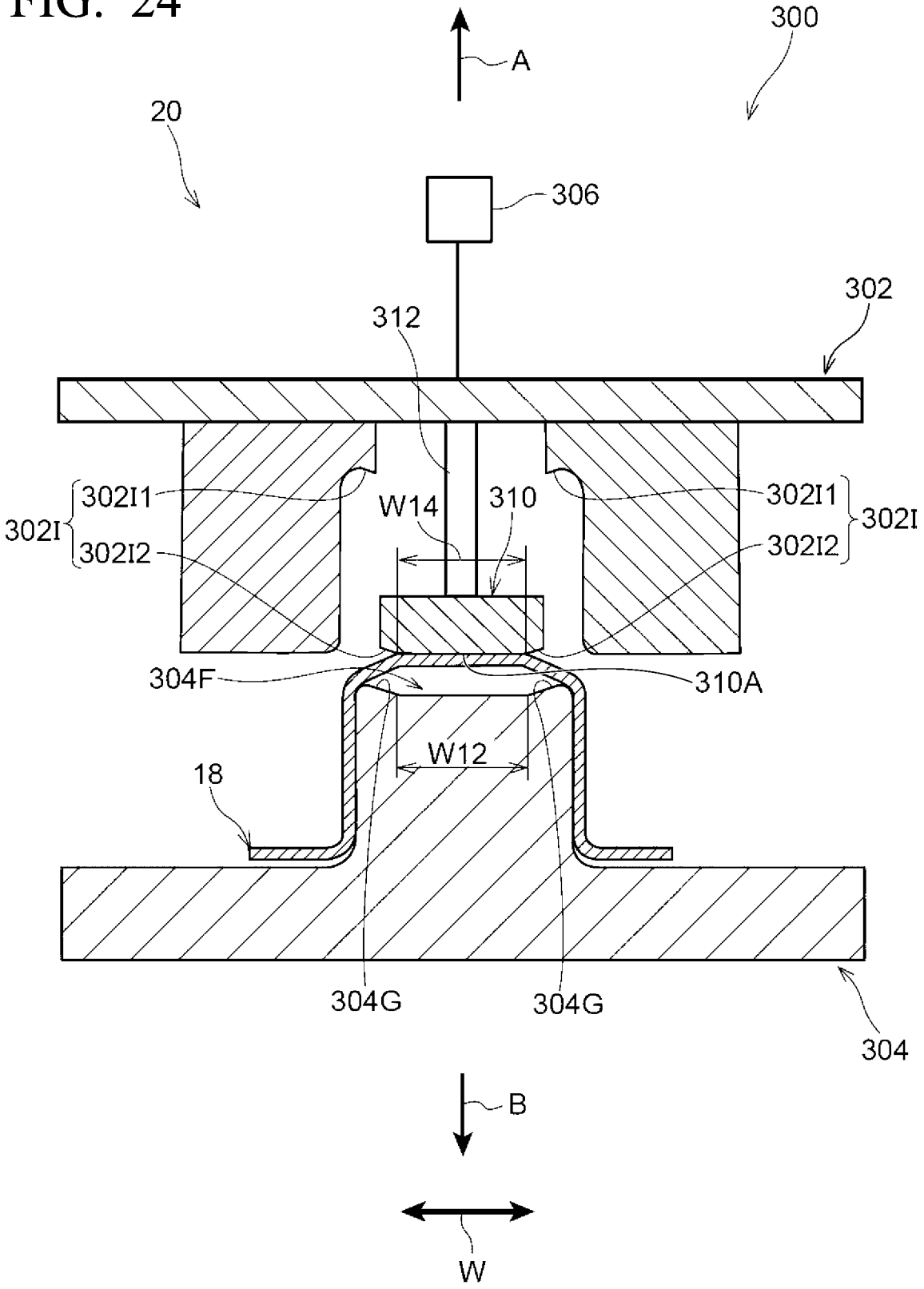
FIG. 24 is a sectional view, seen from the front of the third pressing apparatus, illustrating the third step of pressing the second intermediate formed article by the third pressing apparatus related to a sixth embodiment of the invention, to manufacture the press-formed article.
Figure 25:
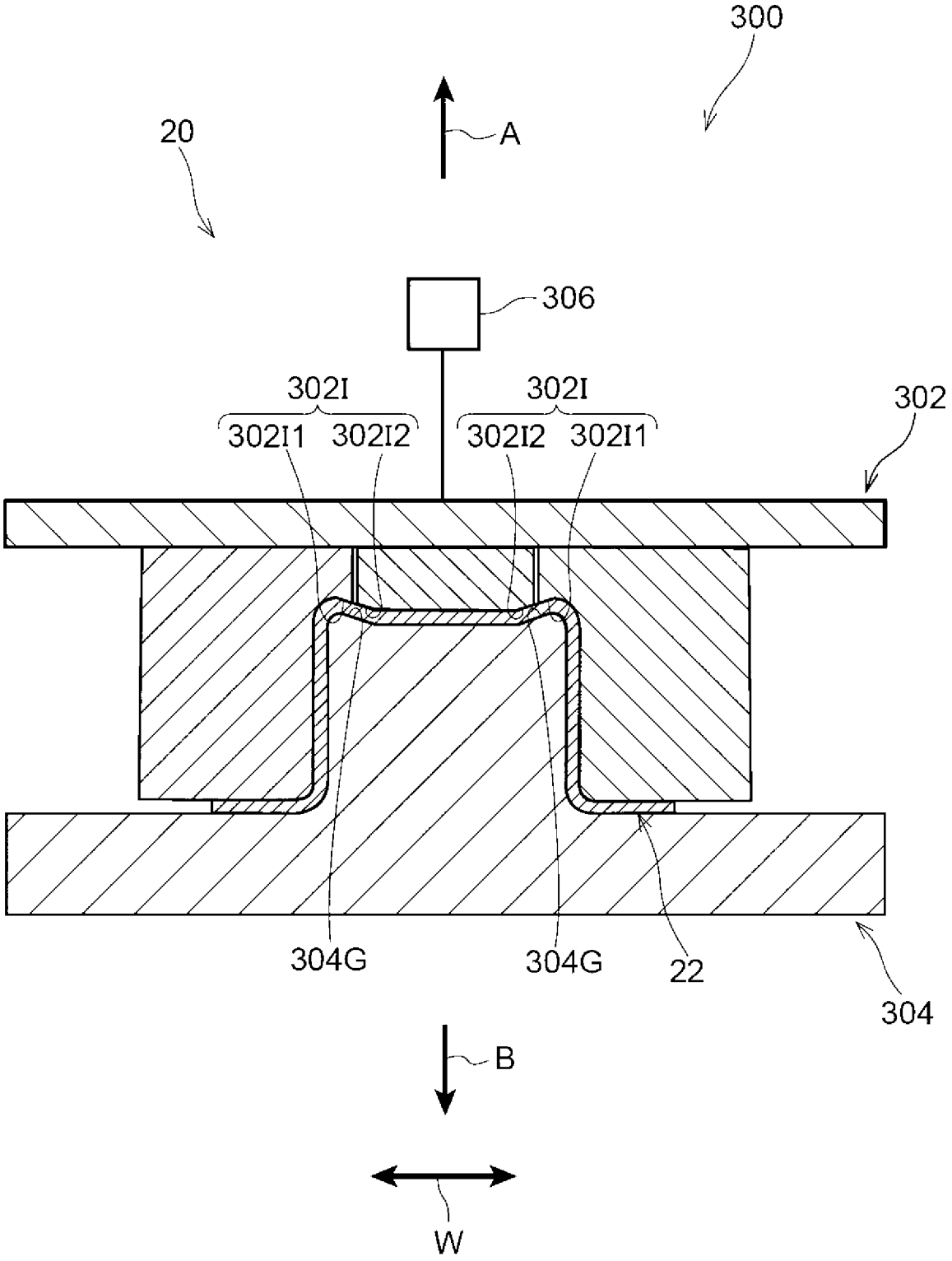
FIG. 25 is a sectional view, seen from the front of the third pressing apparatus, illustrating the third step subsequent to FIG. 24.

FIGS. 24 and 25 are views illustrating a sixth embodiment of the invention, and the same or equivalent portions as those of the aforementioned fifth embodiment will be designated by the same reference signs and will be described, or only different portions will be described. The sixth embodiment is different from the fifth embodiment in that the third pressing apparatus 300 used in the third step 20 is different, and only the third pressing apparatus 300 will be described.

That is, as illustrated in FIG. 25, die-side inclined surfaces 3021, which are corresponding to the punch-side inclined surfaces 304G and parallel to the punch-side inclined surfaces 304G, are formed at the third die bottom 302G of the third die 302 that faces the third punch top portion 304F.

Each of the die-side inclined surfaces 3021 is constituted of a first die-side inclined surface 30211 formed in the third die 302, and a second die-side inclined surface 30212 formed in the third die pad lower surface 310A of the third die pad 310.

Accordingly, at the bottom dead point where the third die 302 approaches the third punch 304 most, the die-side inclined surface 3021 constituted of the first die-side inclined surface 30211 and the second die-side inclined surface 30212 faces each punch-side inclined surface 304G. Also in the sixth embodiment, the positions of end portions of the third die pad lower surface 310A, the positions of the end portions of the punch-side inclined surfaces 304G on the center portion side in the width direction, and the position of the bent portions 18B are aligned with each other in the width direction.

Also in the sixth embodiment, the same working effects as the aforementioned other embodiments can be obtained.

INDUSTRIAL APPLICABILITY

According to the above aspects of the invention, since the allowable range of the protruding amount of the convex portion protruding from a punch can be expanded, industrial applicability is high.

BRIEF DESCRIPTION OF THE REFERENCE SYMBOLS

10: blank
12: first step
14: first intermediate formed article
14A: top plate
14B: bent portion
14C: inclined wall
16: second step
18: second intermediate formed article
20: third step
22: press-formed article
22A: top plate
22B: ridge portion
22C: standing wall

24: press line
100: first pressing apparatus
102: first die
104: first punch
104A: first punch top surface
104B: first punch shoulder portion
104C: first punch inclined surface
200: second pressing apparatus
202: second die
202A: second die hole
202B: second die hole wall surface
204: second punch
204A: second punch top portion
204D: second punch body
204E: second punch shoulder portion
208: second die pad
208A: convex-portion facing surface
212: split die
214: spacer
216: convex portion
216A: convex portion top surface
300: third pressing apparatus
302: third die
302A: third die hole
302B: third die hole wall surface
304: third punch
304A: third punch top surface
304B: third punch shoulder portion

The invention claimed is:

1. A press-formed article manufacturing method of manufacturing a press-formed article, using a first pressing apparatus, a second pressing apparatus, and a third pressing apparatus, the first pressing apparatus being configured to include a first die, and a first punch that is disposed to face the first die and includes a pair of first punch shoulder portions, the second pressing apparatus being configured to include a second die including a die pad, and a second punch that is disposed to face the second die, has a convex portion having a width equal to or less than a spacing between the first punch shoulder portions at a top portion thereof, and includes a pair of second punch shoulder portions having a spacing wider than the spacing between the first punch shoulder portions, the third pressing apparatus being configured to include a third die having a width of a die hole equal to a width of a die hole of the second die, and a third punch including a pair of third punch shoulder portions having a spacing equal to the spacing between the second punch shoulder portions, and the press-formed article having a top plate, a pair of ridge portions located on both sides of the top plate in a width direction, and a pair of standing walls extending from the ridge portions to one side of the top plate in a plate thickness direction, the press-formed article manufacturing method comprising:

a first step of pressing a blank with the first pressing apparatus to form a first intermediate formed article having a pair of bent portions that is bent to one side in the plate thickness direction and having a spacing between the bent portions that is narrower than a width of the top plate and equal to or more than a width of the top portion of the convex portion;

a second step of moving the second die to the second punch side relative to the die pad and the second punch and forming a second intermediate formed article, having the standing wall formed therein, with the second die and the second punch, in a state where a portion between the bent portions is sandwiched between the die pad protruding from the second die to the second punch side, and the convex portion, with one side of the first intermediate formed article in the plate thickness direction as the convex portion side of the second pressing apparatus; and a third step of pressing the second intermediate formed article with the third die and the third punch of the third pressing apparatus to form the press-formed article in which the pair of bent portions are bent and stretched, wherein a relative position of the convex portion to the second punch in a press direction is fixed.

2. The press-formed article manufacturing method according to claim 1, wherein the third pressing apparatus includes punch-side inclined surfaces, and the punch-side inclined surfaces, which are recessed as being closer to a central side of the third punch in the width direction from the third punch shoulder portions, are formed at a top portion of the third punch, and wherein die-side inclined surfaces corresponding to the punch-side inclined surfaces are formed at a die bottom of the third die that faces the top portion of the third punch.

3. The press-formed article manufacturing method according to claim 2, wherein a spacing between end portions of the two punch-side inclined surfaces on the central side of the third punch in the width direction and a spacing between the pair of the bent portions of the second intermediate formed article are equal to each other.

4. The press-formed article manufacturing method according to claim 1, wherein the third pressing apparatus includes punch-side inclined surfaces, and the punch-side inclined surfaces, which are recessed as being closer to a central side of the third punch in the width direction from the third punch shoulder portions, are formed at a top portion of the third punch, and wherein a die bottom of the third die is configured to include a die pad, and die-pad-side inclined surfaces corresponding to the punch-side inclined surfaces are formed on a facing surface of the die pad of the third die that faces the top portion of the third punch.

5. The press-formed article manufacturing method according to claim 4, wherein a spacing between end portions of the two punch-side inclined surfaces on the central side of the third punch in the width direction and a spacing between the pair of the bent portions of the second intermediate formed article are equal to each other.

6. The press-formed article manufacturing method according to claim 1, wherein the second punch includes a split die that constitutes the convex portion, and a second punch body that constitutes a portion other than the convex portion, a spacer is provided between the split die and the second punch body in a press direction, and a relative position of the convex portion to the second punch in the press direction is fixed by the spacer.

7. A press line comprising:

a first pressing apparatus configured to include a first die, and a first punch that is disposed to face the first die in a press direction and includes a pair of first punch shoulder portions;

a second pressing apparatus including a second punch including a top portion that crosses a press direction, a convex portion that is disposed at the top portion and has a width equal to or less than a spacing between the first punch shoulder portions, a pair of second punch shoulder portions provided on both sides of the top portion, and punch wall surfaces that extend from the respective second punch shoulder portions, a second die including a die hole having a die hole wall surface corresponding to the punch wall surface, and a die pad that has a convex-portion facing surface facing the convex portion, is disposed in the die hole, and is movable in a press direction; and a third pressing apparatus configured to include a third die having a width of a die hole equal to a width of the die hole of the second die, and a third punch including a pair of third punch shoulder portions having a spacing equal to a spacing between the second punch shoulder portions, wherein a relative position of the convex portion to the second punch in a press direction is fixed.

8. The press line according to claim 7, wherein the third pressing apparatus includes punch-side inclined surfaces, and the punch-side inclined surfaces, which are recessed as being closer to a central side of the third punch in the width direction from the third punch shoulder portions, are formed at a top portion of the third punch, and wherein die-side inclined surfaces corresponding to the punch-side inclined surfaces are formed at a die bottom of the third die that faces the top portion of the third punch.

9. The press line according to claim 8, wherein a spacing between end portions of the two punch-side inclined surfaces on the central side of the third punch in the width direction and a spacing between the first punch shoulder portions of the first punch are equal to each other.

10. The press line according to claim 7, wherein the third pressing apparatus includes punch-side inclined surfaces, and the punch-side inclined surfaces, which are recessed as being closer to a central side of the third punch in the width direction from the third punch shoulder portions, are formed at a top portion of the third punch, and wherein a die bottom of the third die is configured to include a die pad, and die-pad-side inclined surfaces corresponding to the punch-side inclined surfaces are formed on a facing surface of the die pad of the third die that faces the top portion of the third punch.

11. The press line according to claim 10, wherein a spacing between end portions of the two punch-side inclined surfaces on the central side of the third punch in the width direction and a spacing between the first punch shoulder portions of the first punch are equal to each other.

12. The press line according to claim 7, wherein the second punch includes a split die that constitutes the convex portion, and a second punch body that constitutes a portion other than the convex portion.

13. The press line according to claim 12, wherein a spacer is provided between the split die and the second punch body in a press direction.

14. The press line according to claim 7, wherein the second punch includes a split die that constitutes the convex portion, and a second punch body that constitutes a portion other than the convex portion, a spacer is provided between the split die and the second punch body in a press direction, and a relative position of the convex portion to the second punch in the press direction is fixed by the spacer.

* * * * *